United States Patent [19]

Gremillet

[11] 3,990,561

[45] Nov. 9, 1976

[54] ESCAPEMENT MECHANISM FOR SYLLABIC KEYBOARD CONTROLLED DEVICES

[76] Inventor: Jean Gremillet, 64 Avenue Felix Faure, Paris 15°, France

[22] Filed: Aug. 30, 1974

[21] Appl. No.: 502,192

Related U.S. Application Data

[62] Division of Ser. No. 259,051, June 2, 1972, abandoned.

[30] Foreign Application Priority Data

June 21, 1971 France ..... 71.22540

[52] U.S. Cl. ..... 197/7; 197/84 R

[51] Int. Cl.[2] ..... B41J 3/02; B41J 19/58

[58] Field of Search ..... 197/7, 9, 84 R, 84 B

[56] References Cited

UNITED STATES PATENTS

| | | | |
|---|---|---|---|
| 1,124,150 | 1/1915 | Lilleberg | 197/84 R |
| 2,850,136 | 9/1958 | Seeber | 197/7 |
| 3,018,870 | 1/1962 | Lambert | 197/84 B |
| 3,073,427 | 1/1963 | Gremillet | 197/7 |

*Primary Examiner*—Edgar S. Burr
*Assistant Examiner*—Paul T. Sewell
*Attorney, Agent, or Firm*—Robert E. Burns; Emmanuel J. Lobato; Bruce L. Adams

[57] ABSTRACT

In a syllabic keyboard-controlled device, an escapement mechanism comprising a cogged wheel provided with mobile cogs, each cog being displacable between a stop position and an escapement position. This device provides differenciated escapements. The length of each escapement comprises a number of a given interval which is equal to the number of cogs which where put in escapement position. This device may be combined with an escapement anchor, which is mobile between a stop position and an escapement position.

The displacement of the anchor alone into stop position produces an escapement of a single interval. This displacement at the same time as the displacement into escapement position of one or several cogs augments the length of the escapement by the given interval.

9 Claims, 61 Drawing Figures

Part a
252
300
305
304
621
623
624
625
628
270
669
301
269
302
303
630
637
632
627
626
772
141
746
750
763
806
805
729
745
776
759
766
778
737
777
739
741
768
722
775
778
773
771
807
730
769
773
715
707
725
271
692
280
278
739
748
760

Part b

Part c
304
305
635
634
150
633
638
636
637
632
150
742
790
745
806
805
837
780
779
707
768
Niii-Tiv
796
795
Sv
804
785
Niii-Tiv
794
793
730
769
735
729
752
722
725
761
765
738
764
774
762
706
708
750
740
767
Niii
791
792
704
767
756
789
754
755
782
703
781
798
797
799
722
Tiv
TS
800
802
788
752
RS
702
787
706
803
709
784
783
743
801

667,668
663
252
648
649
76
670
671
687
651
648
645
650
721
647
652
259
646
644
654
656
642
644
643
657

Part a

Fig.8 Part b

Part c

A
B
AA
BB
I
II
III
IV
V
271
272
273
274
275
277
278
279
280
281
282
283
284
285
286
287
288
289
290
291
292
293
294
295
298
642
693

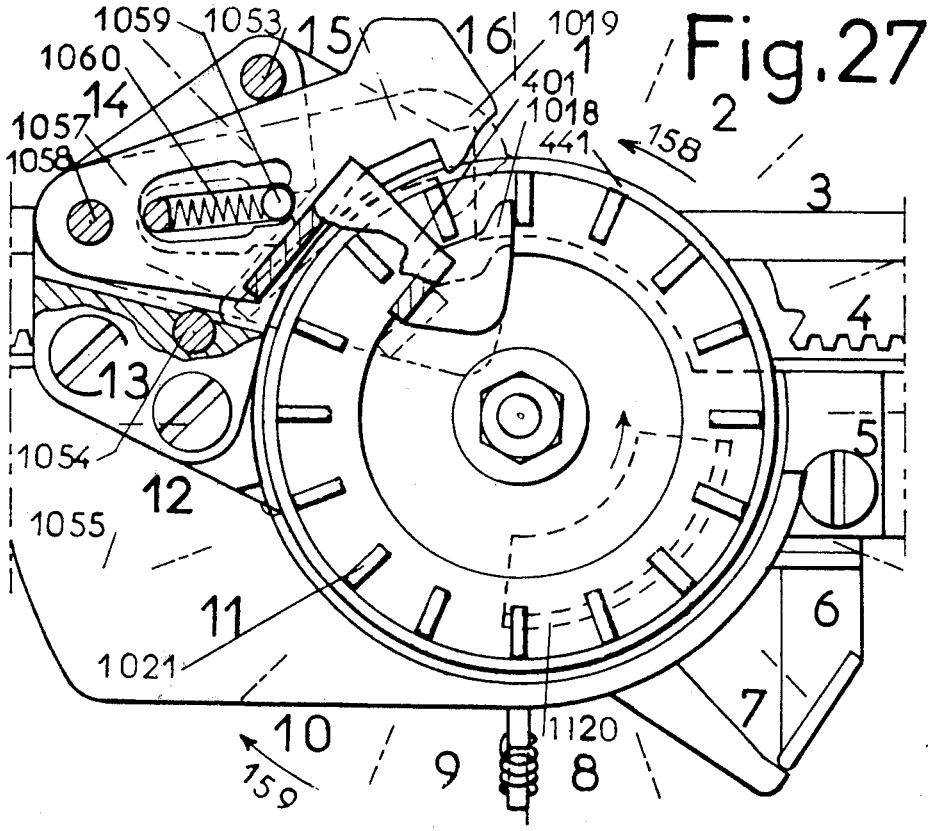
Fig.27
Fig.28
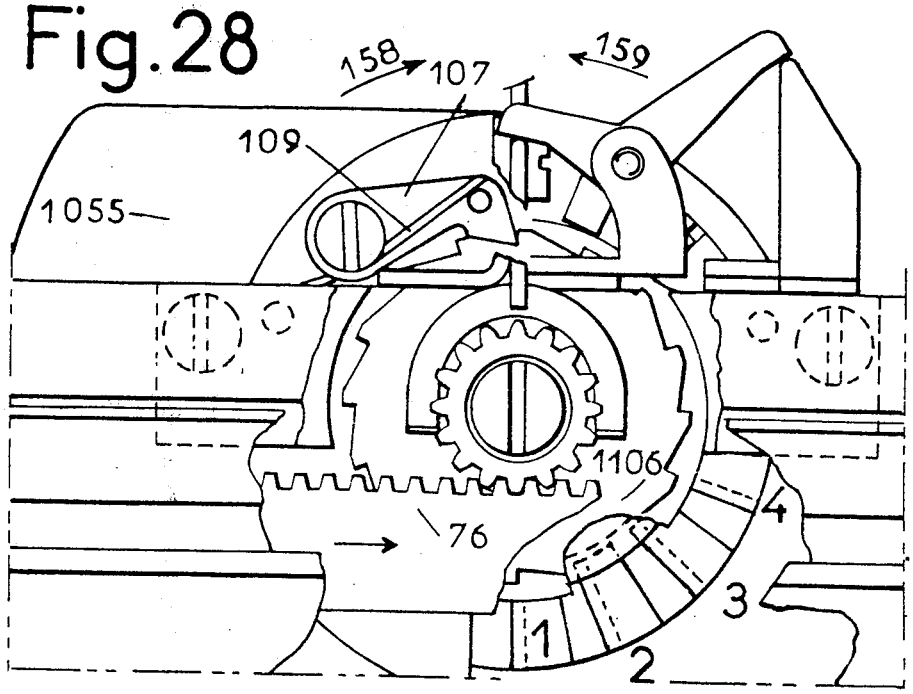

d d
252
608
601
850
321
968
817
808
607
815
809
844
881
880
879
871
869
870
609
601
851
856
854
336
360
715
337
344

Fig.45
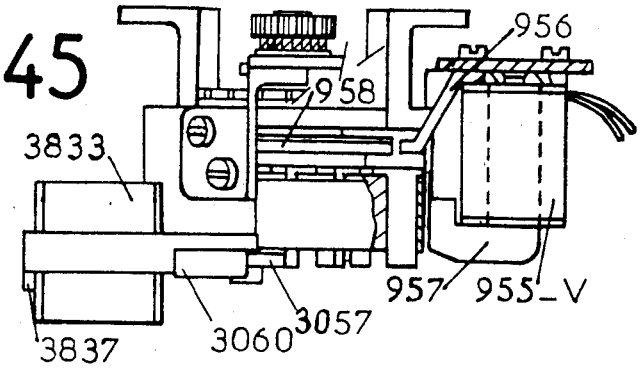
Fig.46
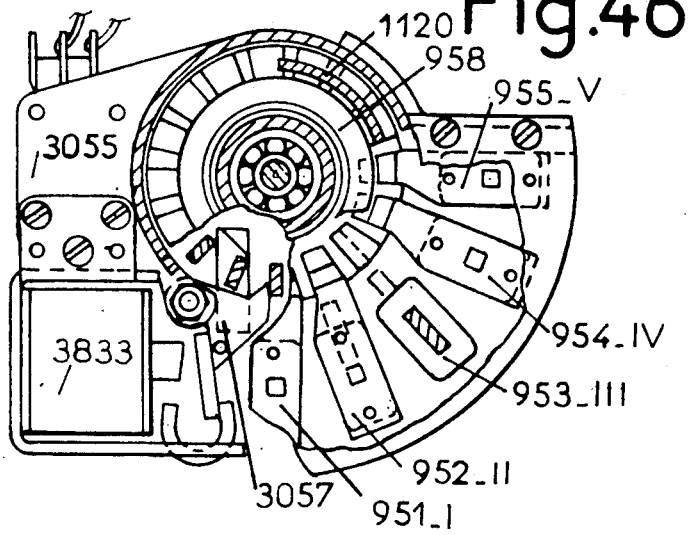
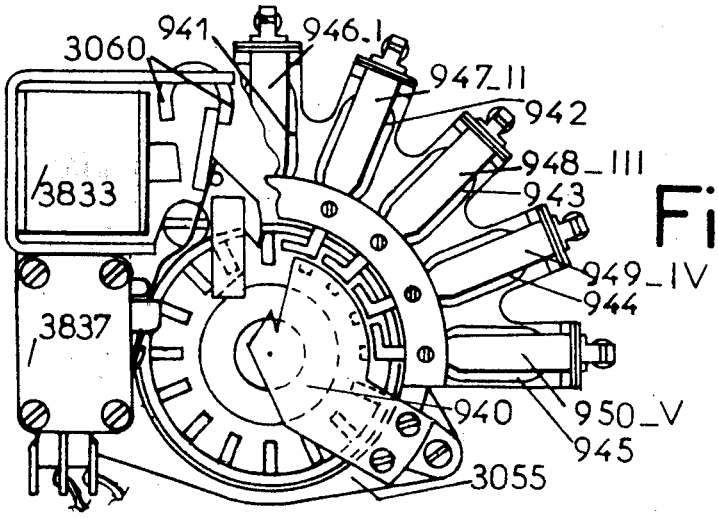
Fig.44

I
II
III
IV
V
VI
951
952
953
954
955
1000
1001
1002
1003
1004
1005
1008
ESP.

Part b
FOR THE
RÉ
YOU
972
977
990
988
983
991
989
692
992
277
773
994
960
147
337
344
267
302
614
601
890
998
999
997
808
886
843
842
941
889
887
323
885
888
336
893
(337)
907
(980)
715
771
252

Part c

Part a

ESCAPEMENT MECHANISM FOR SYLLABIC KEYBOARD CONTROLLED DEVICES

CROSS-REFERENCE TO RELATED APPLICATIONS

This is a division of Ser. No. 259,051, filed June 2, 1972, now abandoned.

U.S. Pat. No. 3,073,427 to Gremillet.

Copending applications include Ser. Nos. 502,184, 502,188 and 502,190.

BACKGROUND OF THE INVENTION

1. Field of the Invention

Syllabic-keyboard-controlled devices such as syllabic typewriters and similar devices in graphic arts.

In the syllabic typewriters the escapement mechanism of the Invention controls the advancing of the carriage.

When the devices comprise a memory unit the cogged wheel of the Invention may control the advancing of a punched or magnetic tape.

2. Description of the Prior Art

Typewriters for the simultaneous printing of several characters borne by different type bars, several of them being set in motion by striking a single key, and in which a space key may be struck at the same time as character keys, have already been put forward by the U.S. Pat. No. 3,073,427 to Gremillet. These typewriters comprise an escapement mechanism.

Moreover, there are already electric machines in which the printing, as well as certain auxiliary functions, are obtained by the engagement of the control parts on a motor-driven cylinder. But these machines print only one character at a time, and that without spacing.

There are also machines automatically operated by a storage and machines that are connected together at a distance, each being both transmitter and receiver. But all these machines print only one character at a time, and that without spacing.

SUMMARY OF THE INVENTION

In a syllabic keyboard controlled device comprising a carriage, an escapement mechanism for controlling differentiated advancings of the carriage, this mechanism comprising a cogged escapement wheel (FIG. 24 to 28) provided with mobile cogs, each cog 102 being displaceable between a stop position (FIG. 25) and an escapement position, and with a stop (1018) arranged in the path of movement of the cogs in stop position, the length of the escapement thus corresponding to the number of cogs placed in escapement position, and the device comprising a fixed cam arranged in the path of movement of the cogs in the escapement position to return them to the stop position. When no spacing is typed, the length of the escapement correspond to the number of characters simultaneously typed.

The cog-wheel may be combined with an escapement anchor (1057 FIG. 27) mounted on an axle. The anchor comprises a stop arm constituting a stop for the cogs of the wheel which are in stop position, and a return arm which is encountered by the first cog of the wheel which is in stop position, so that this cog returns the anchor in stop position.

When the anchor is displaced alone its movement produces an escapement of one single interval. When the anchor is displaced at the same time as one or several cogs of the wheel, its movement augments the escapement by one single interval. The anchor is displaced by each of the keys which must produce a space between two successive words. It results that this space may be typed at the same time as each word ending.

In a first embodiment the movement of the anchor is controlled by mechanical connexions. In an other embodiment it is controlled by an electromagnet.

In an embodiment the cogs of the wheel are placed into escapement position by mechanical connections. In other embodiments they are displaced by electromagnets.

In one embodiment the electromagnets which control the cogs have each a moving part to push the corresponding cog. In an other embodiment each of this electromagnets displaces the corresponding cog directly by its magnetic field.

In certain embodiments each of the electromagnets is put in circuit by means of a group escapement-paddle. In an other embodiment, for certain groups of characters, the corresponding electromagnet is put in circuit directly by the heads of the type-bars of the considered group, and for other groups the electromagnet is put in circuit directly by the corresponding character keys.

In a variant, the escapement anchor is replaced by an electric relay (FIG. 51).

Figures 10, 11, 12, 13, 14, 15, 16, 17, 18, 19, 20, 21, 22, 23:
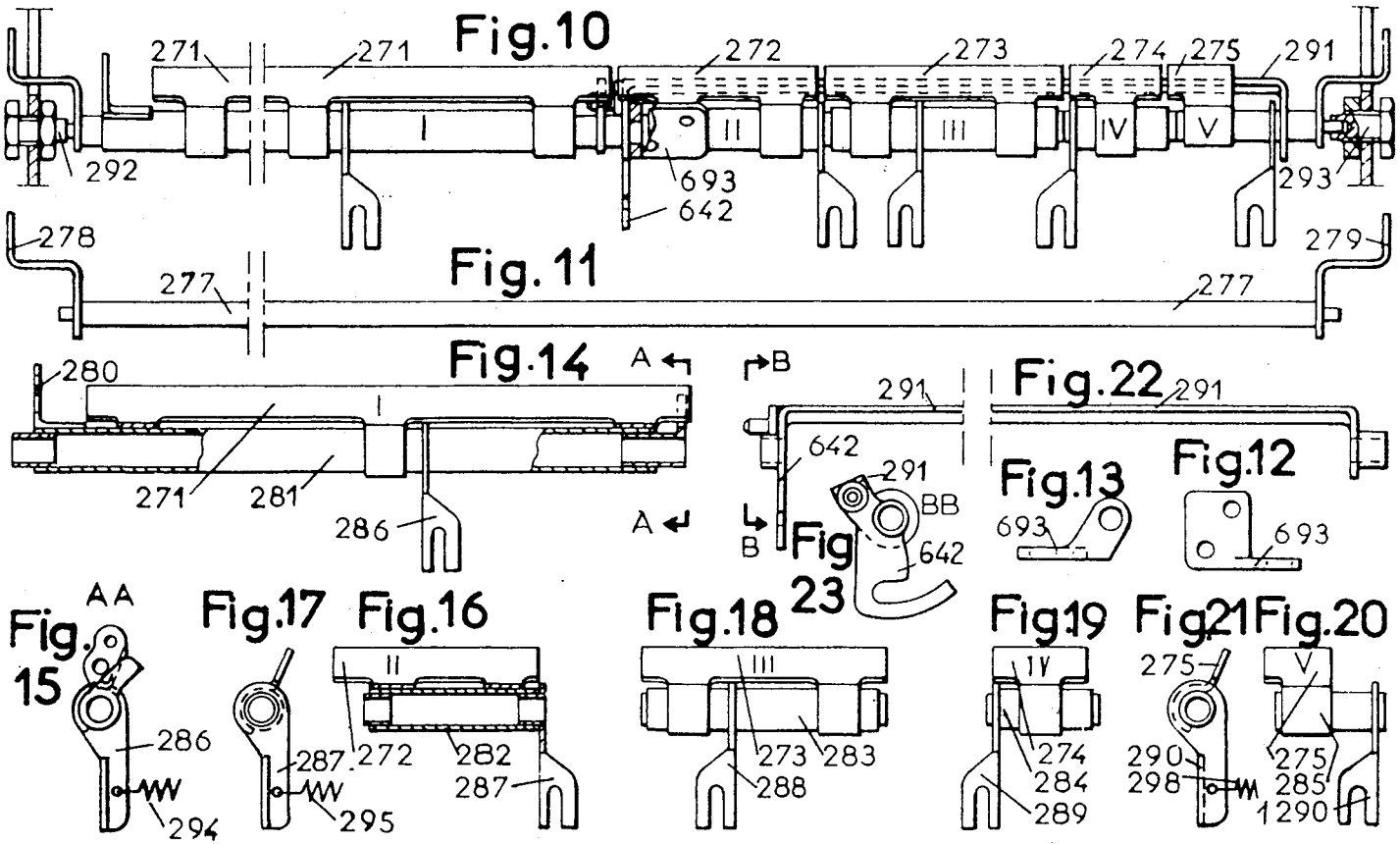
FIG. 10. The whole of the group escapement-paddles, actuated by the lower ends of the intermediate levers. Front view.
FIG. 11. Axle of the group escapement-paddles. Front view.
FIG. 12. Central bearing of the group escapement-paddle axle. Front view.
FIG. 13. Central bearing of the group escapement-paddle axle. View from the left side.

| Escapement paddle of Groups I to V | | |
|---|---|---|
| | Front view | View from the right side |
| Group I | FIG. 14 | FIG. 15 |
| Group II | FIG. 16 | FIG. 17 |
| Group III | FIG. 18 | FIG. 21 |
| Group IV | FIG. 19 | FIG. 21 |
| Group V | FIG. 20 | FIG. 21 |

FIG. 22. Stirrup for raising the ribbon, actuated by the paddles of Groups I to V. Front view.

FIG. 23. Stirrup for raising the ribbon, actuated by the paddles of Groups I to V. View from the left side.

Figure 24:
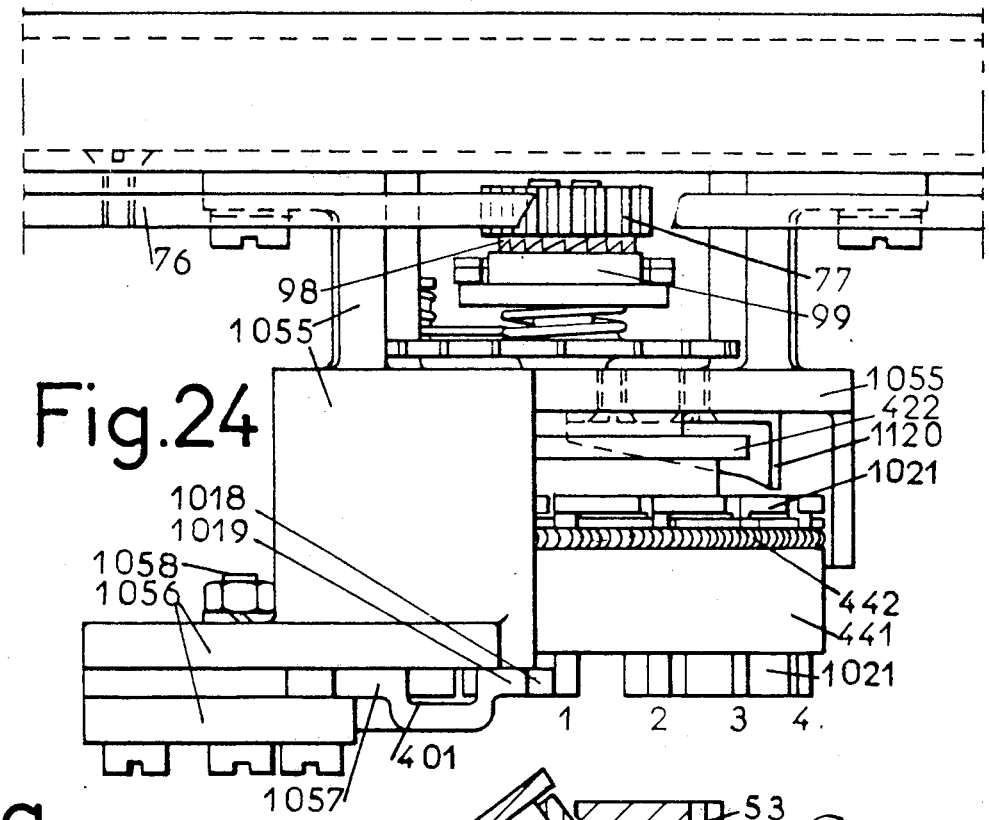

FIG. 24. Wheel with mobile cogs parallel to the axis of rotation, the anchor, and their supports. Front view, enlarged.

Figure 25:
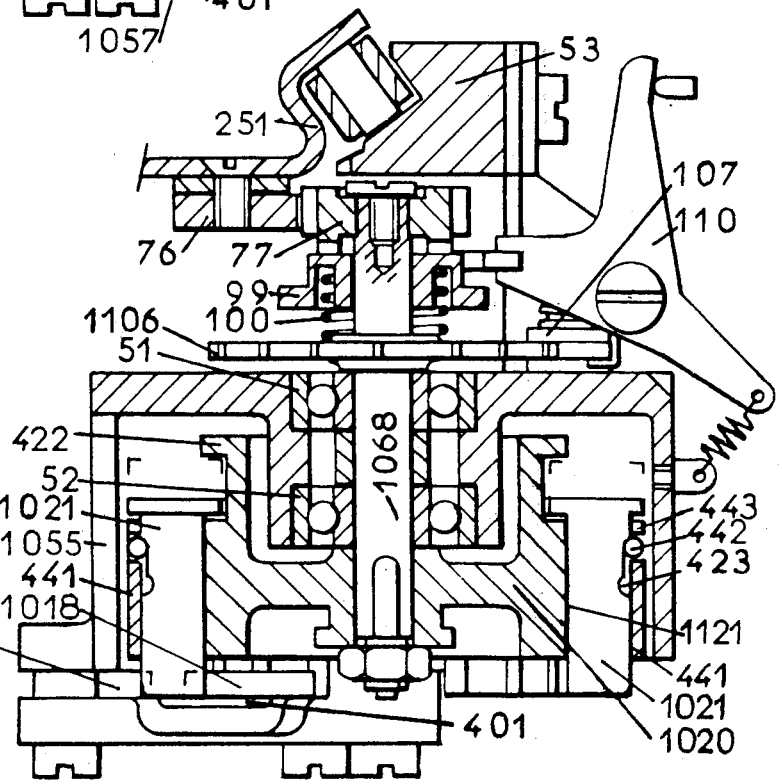

FIG. 25. Wheel with mobile cogs parallel to the axis of rotation, the anchor, and their supports. Section through the axis of rotation, seen from the right side.

Figure 26:
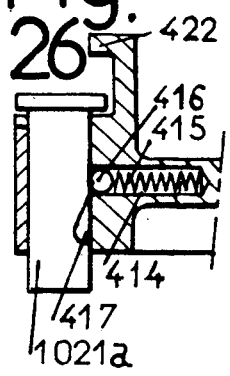

FIG. 26. Positioning of each cog by a spring and a ball. Partial section, enlarged, of the wheel.

FIG. 27. Wheel with mobile cogs parallel to the axis of rotation and the anchor. Bottom view.

FIG. 28. Wheel with mobile cogs parallel to the axis of rotation. Top view.

Figure 29:
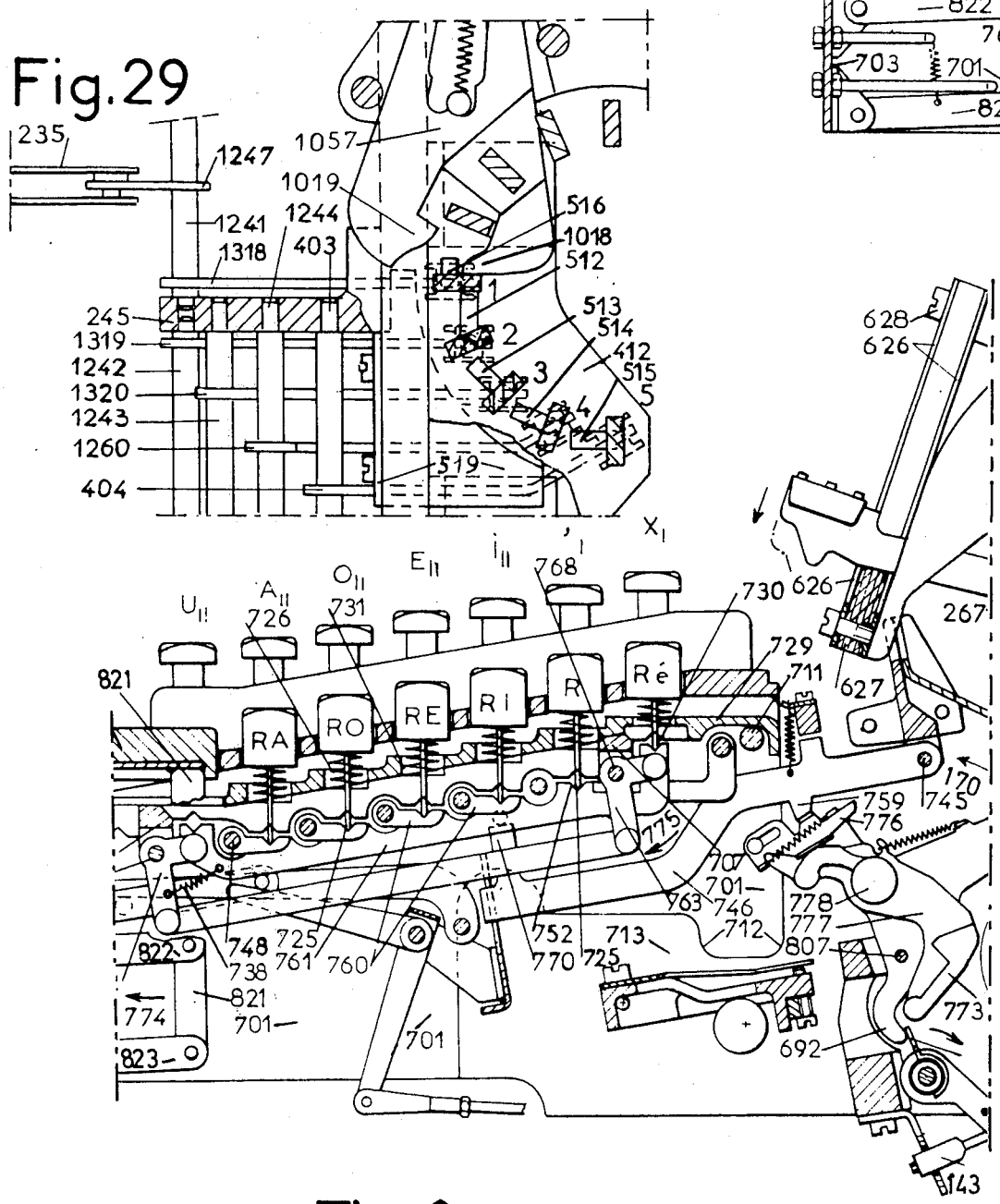
Figure 8:
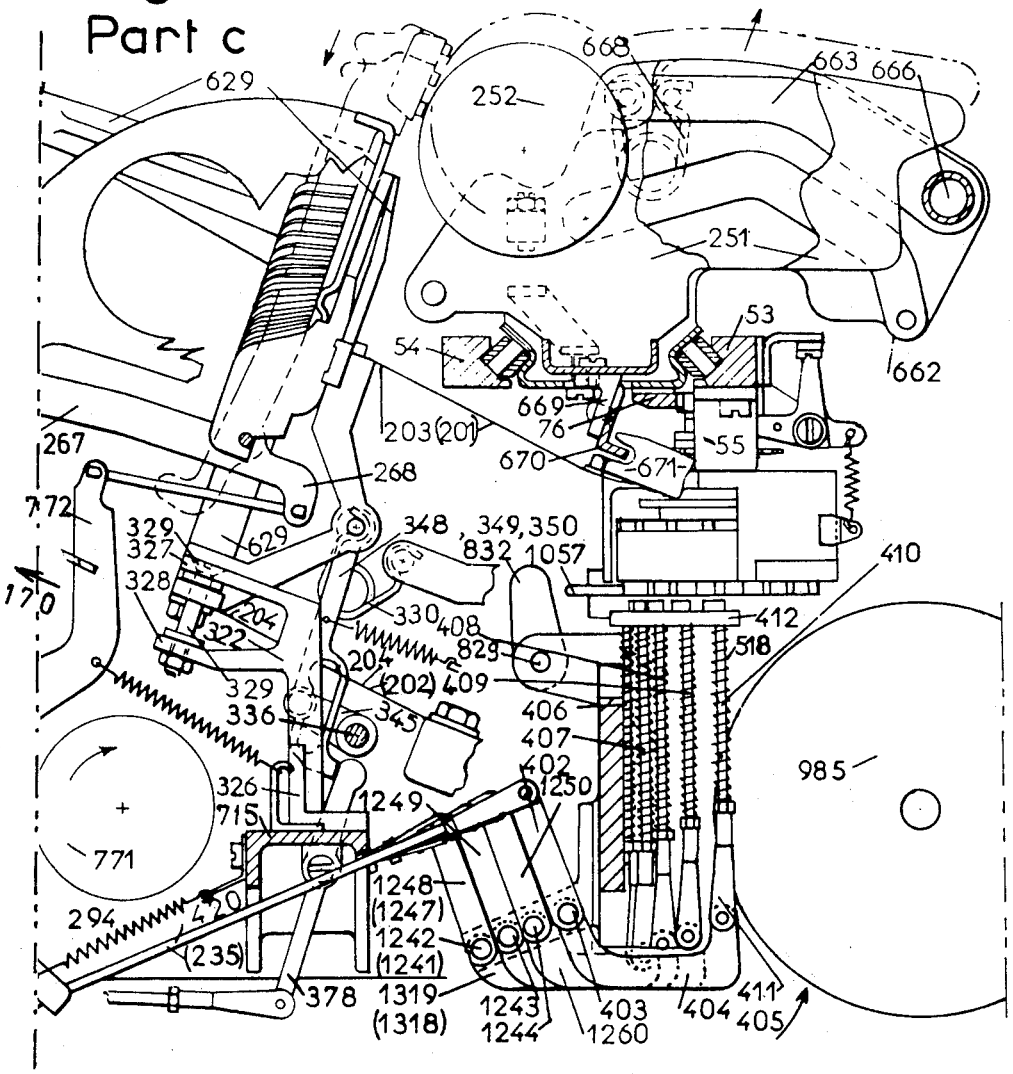

FIG. 29. Connections by which the group escapement-paddles push the cogs of the escapement cogwheel. Partial top view, enlarged.

Figure 30:
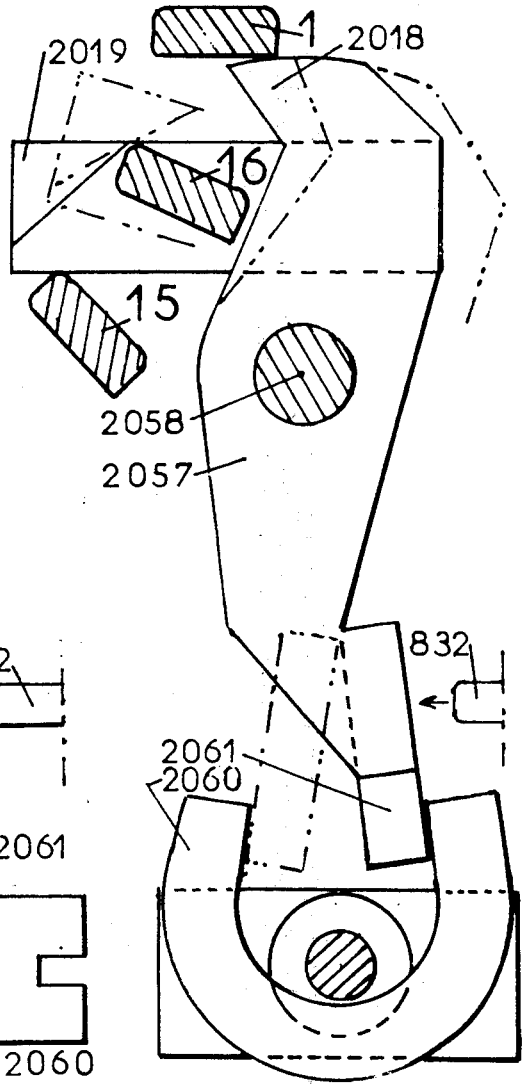

FIG. 30. Mechanically actuated anchor; variant. Top view enlarged.

Figure 31:
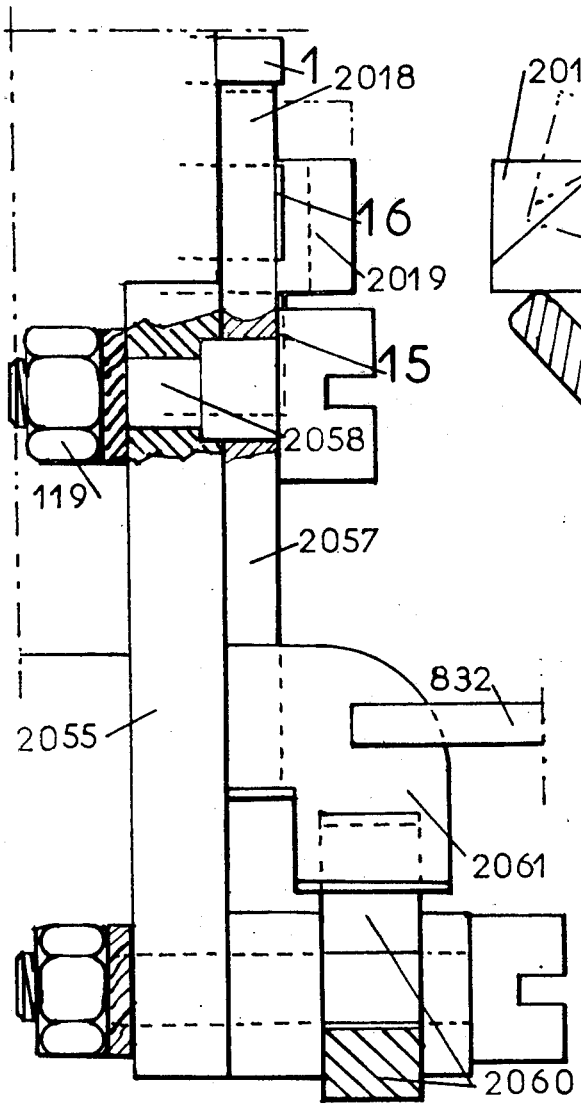

FIG. 31. Mechanically actuated anchor; variant. Front view enlarged.

Figure 32:
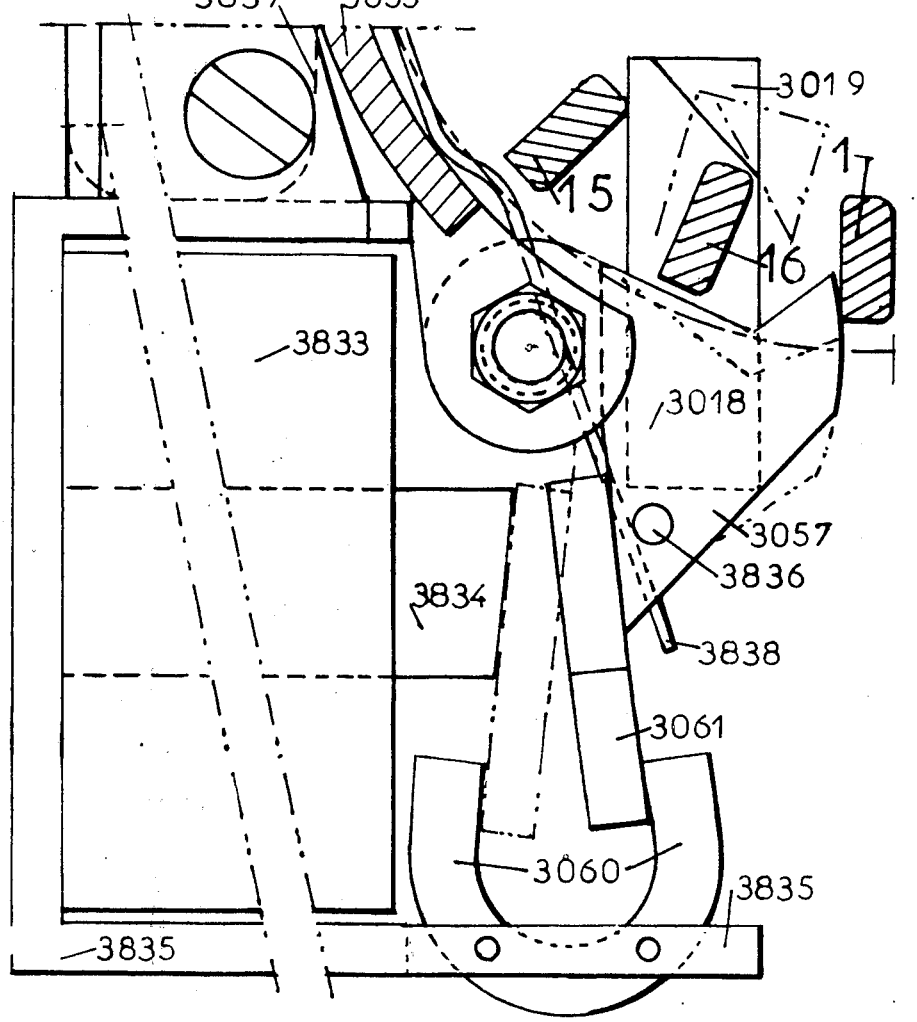

FIG. 32. Escapement anchor. Variant similar to that shown in FIGS. 30 and 31, but actuated by an electromagnet. Top view enlarged.

Figure 33:
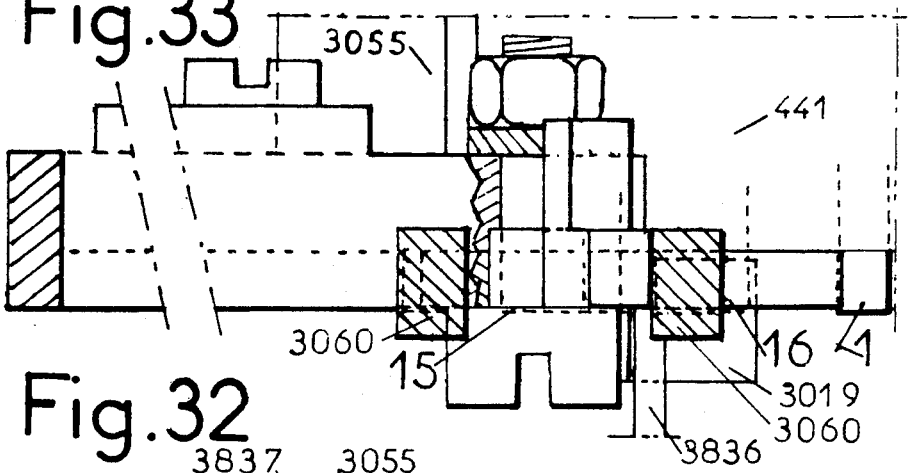

FIG. 33. Escapement anchor. Same variant as in FIG. 32. Front view enlarged.

Figures 34, 36:
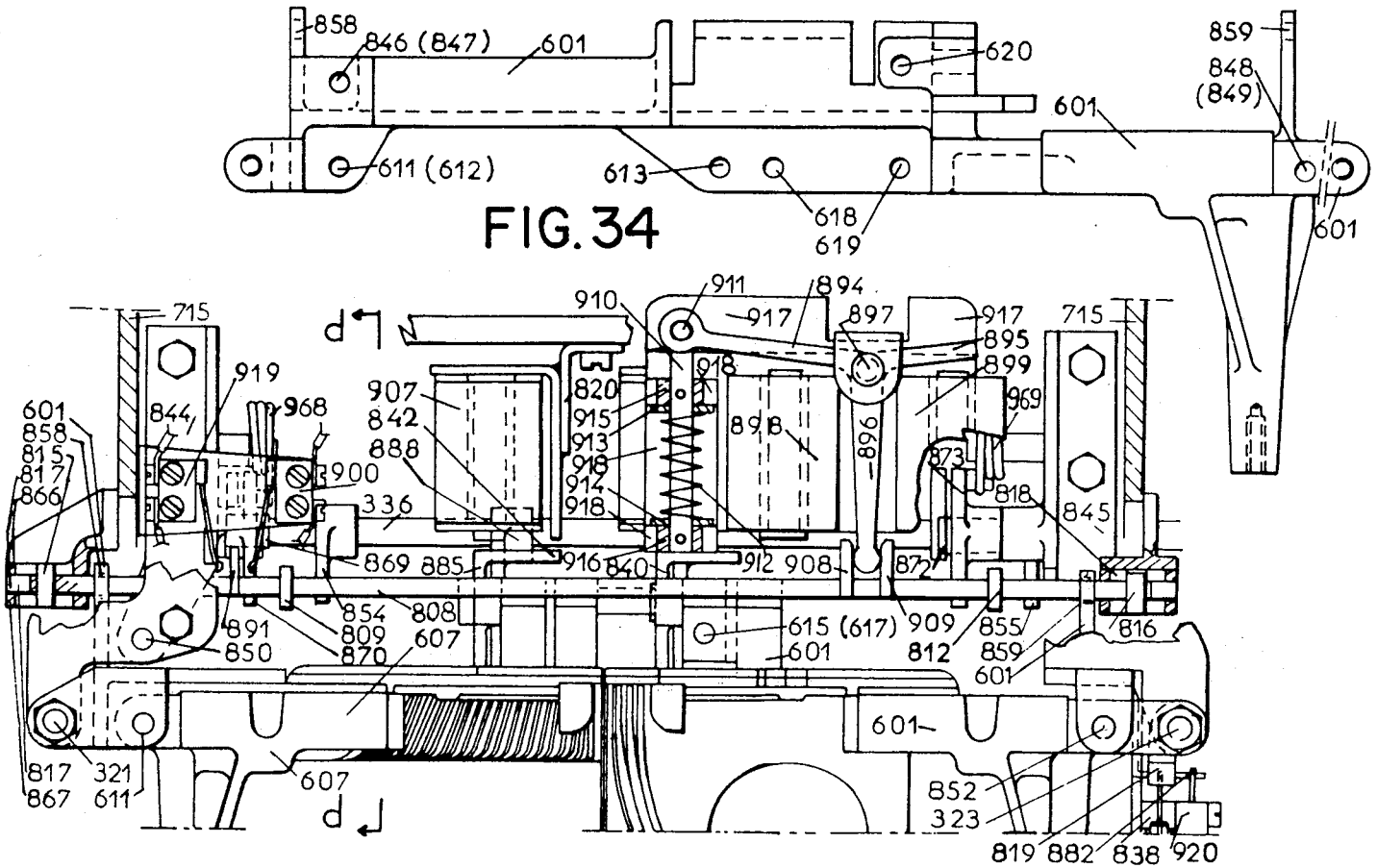

FIG. 34. Frame of the general three position "basket". Top view.

Figure 35A:
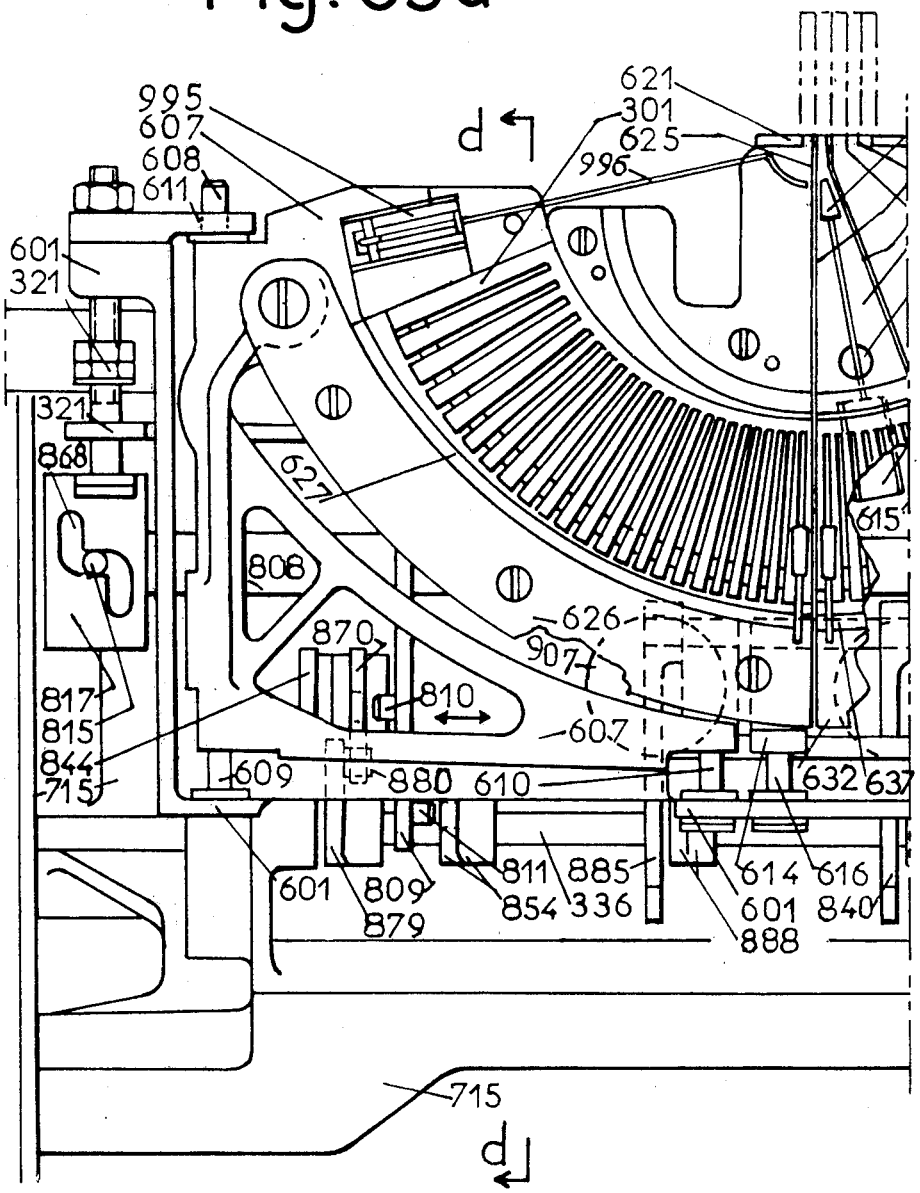
Figure 35B:
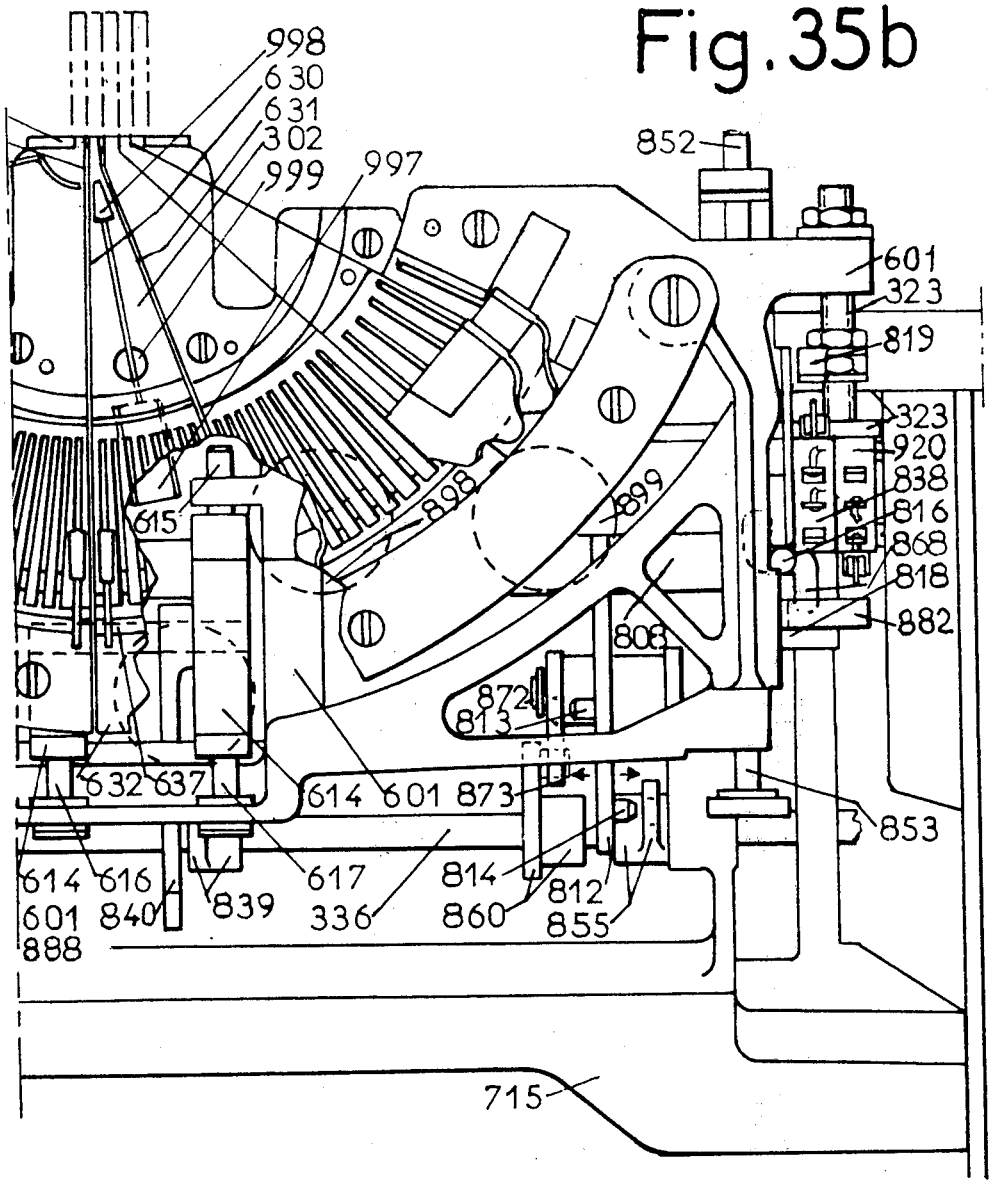

FIG. 35. comprising parts designated 35*a*, 35*b*. The three three-position baskets, assembled, bearing the sectors, and parts of the devices that actuate them. Front view.

FIG. 36. The three-position baskets, assembled, bearing the sectors, and parts of the devices that actuate them. Top view.

Figure 37:
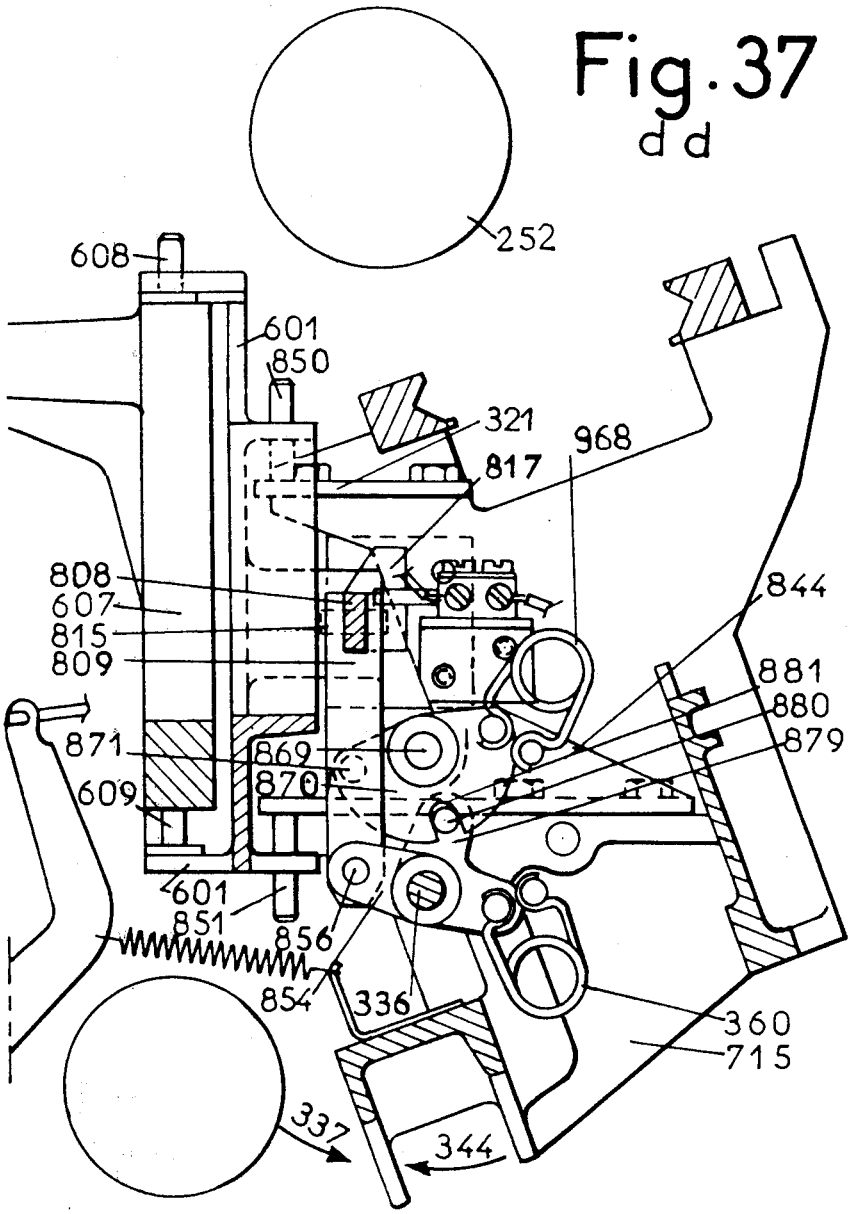

FIG. 37. Three-position basket I, mobile on the general basket, and mechanism actuating the three baskets. Section *d—d* of FIGS. 35 and 36, seen from the right side.

Figure 38:
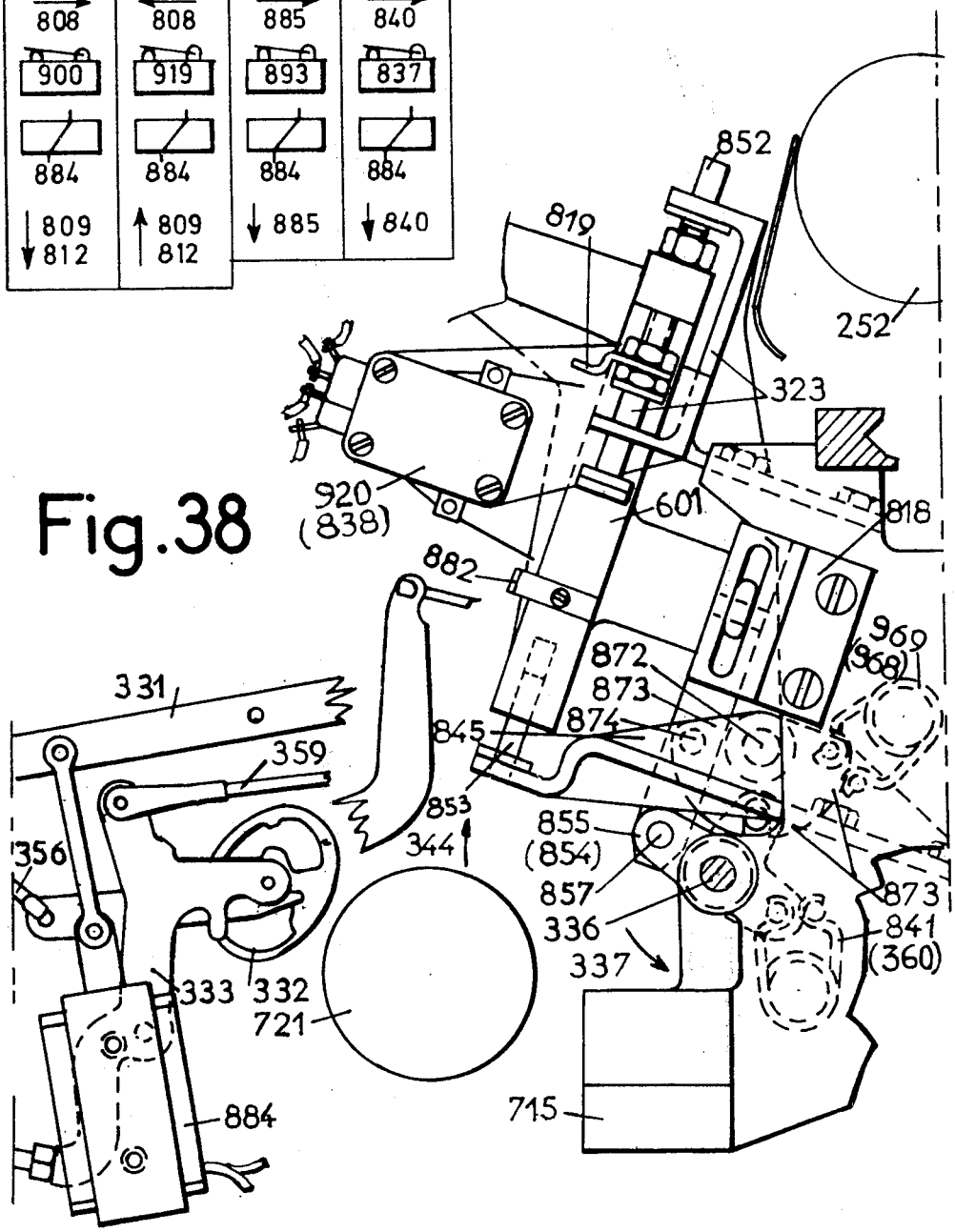

FIG. 38. General three-position basket, mobile on the frame of the machine, and device for actuating the three baskets. View from the right side.

Figure 39:
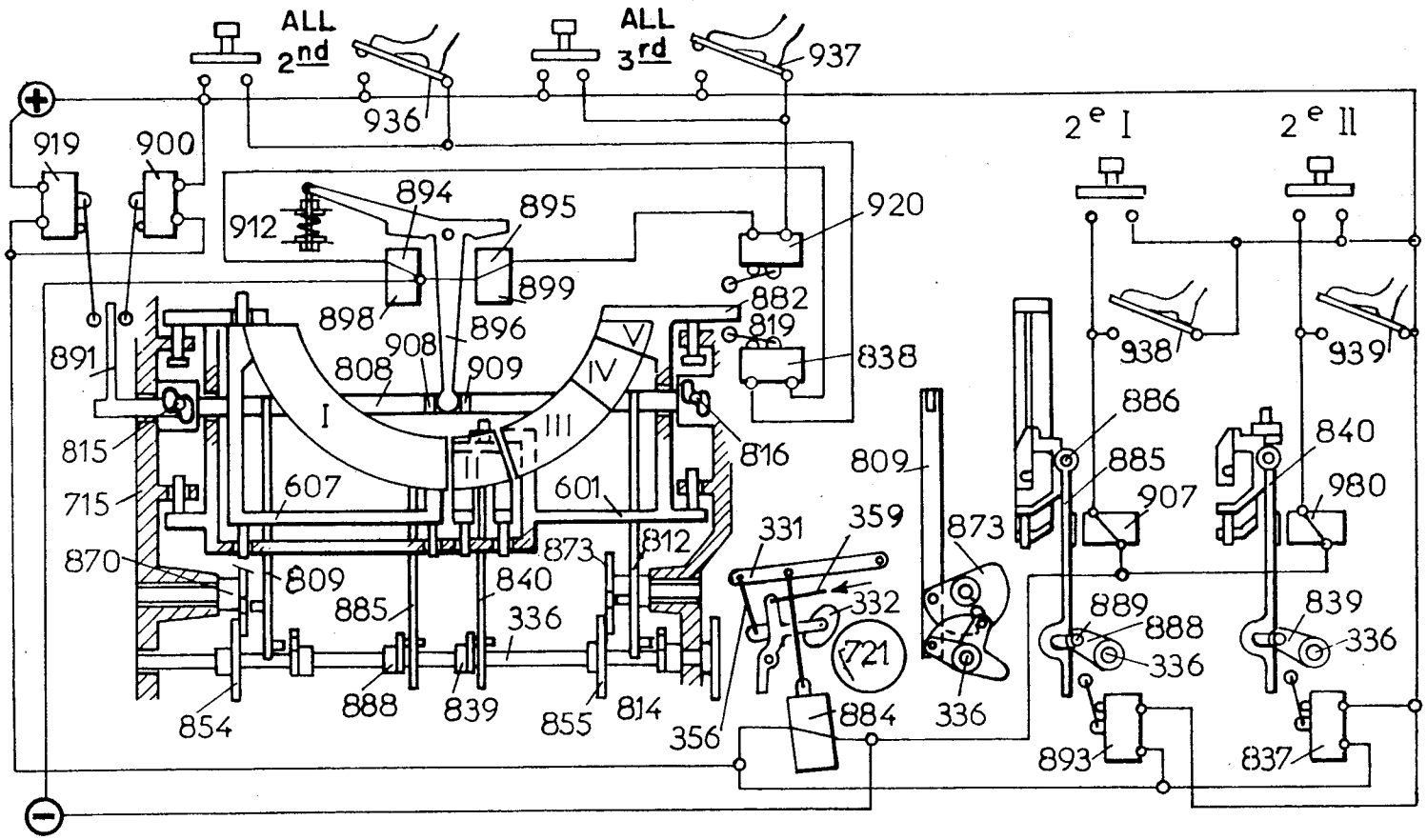

FIG. 39. Scheme of the assembly of the electric circuits that actuate the changes of case position of the three three-position baskets.

Figure 40:
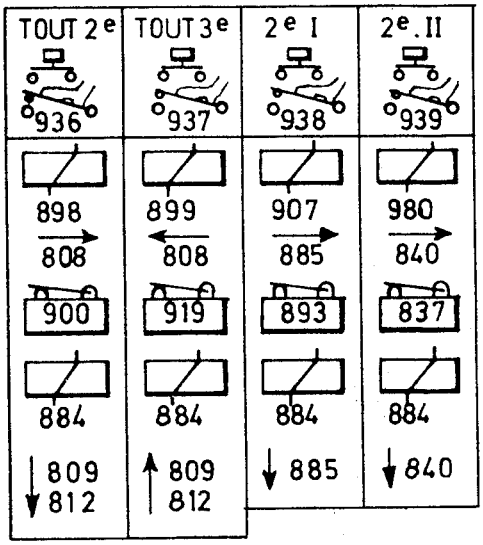

FIG. 40. Synoptic table setting out the sequence of effects produced by depressing each of the sector shift keys, or by depressing the pedal that duplicates them.

Figure 41:
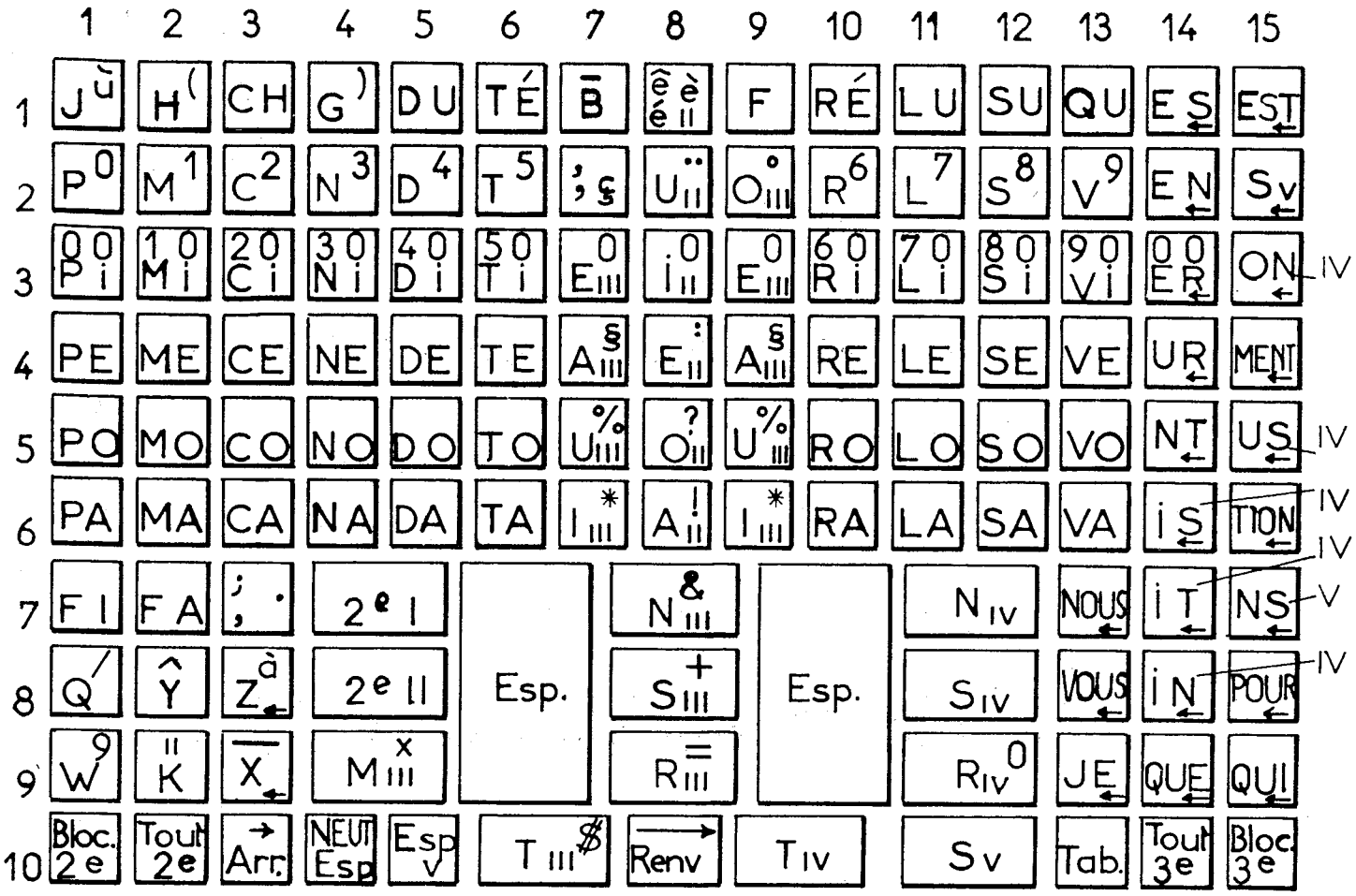

FIG. 41. Switch-board. Example of a lay-out for the French language.

Figure 42:
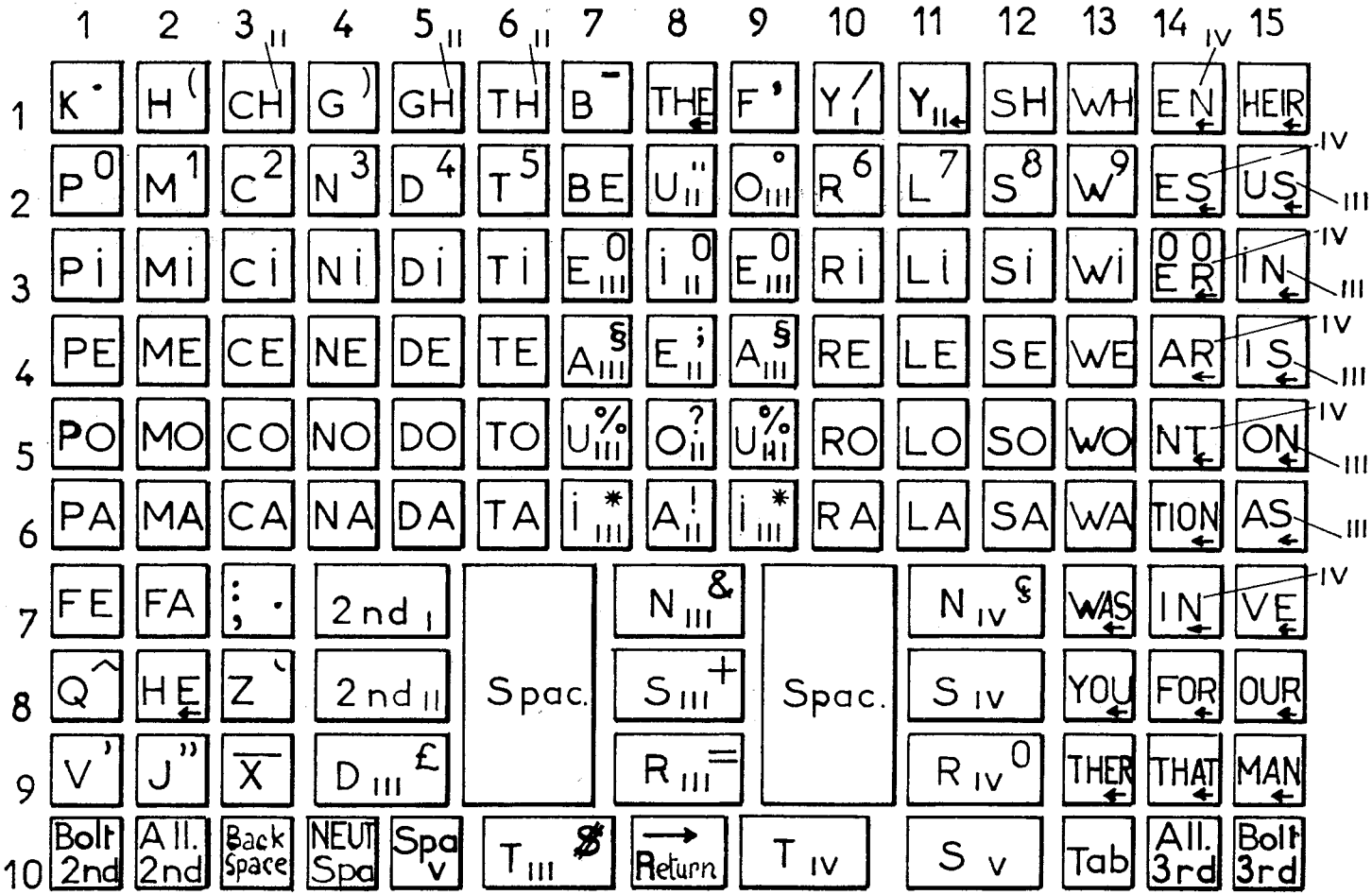

FIG. 42. Switch-board. Example of a lay-out for the English language.

Figure 43:
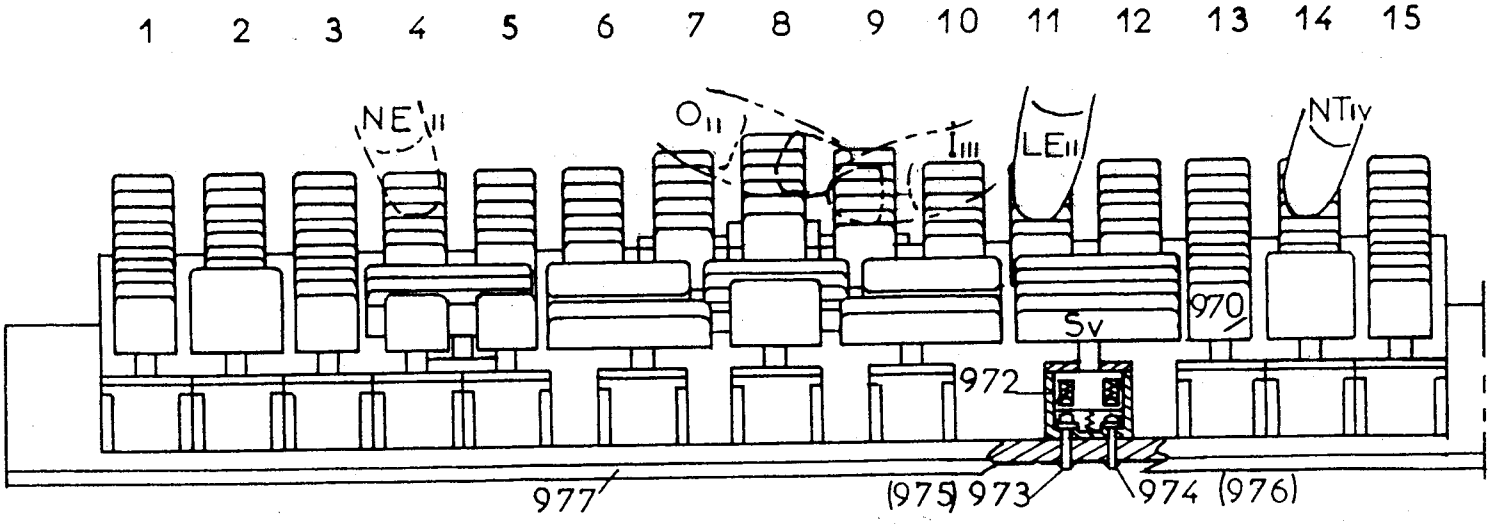

FIG. 43. Switch-board. Front view, showing the differences of level of the keys and the position of the fingers on certain keys.

FIG. 44. Displacement of the mobile cogs of the escapement wheel by electromagnets with a movable armature that pushes them, and actuating of the anchor by the magnetic field of another electromagnet. Bottom view.

FIG. 45. Displacement of the cogs of the escapement wheel and of the anchor by electromagnets with a fixed core that displaces them directly by their magnetic field. Front view; the electromagnets I to IV being removed.

FIG. 46. Displacement of the cogs of the escapement wheel and of the anchor by electromagnets with a fixed core that displaces them directly by their magnetic field. Top view; the upper part of the wheel support being removed.

Figure 47:
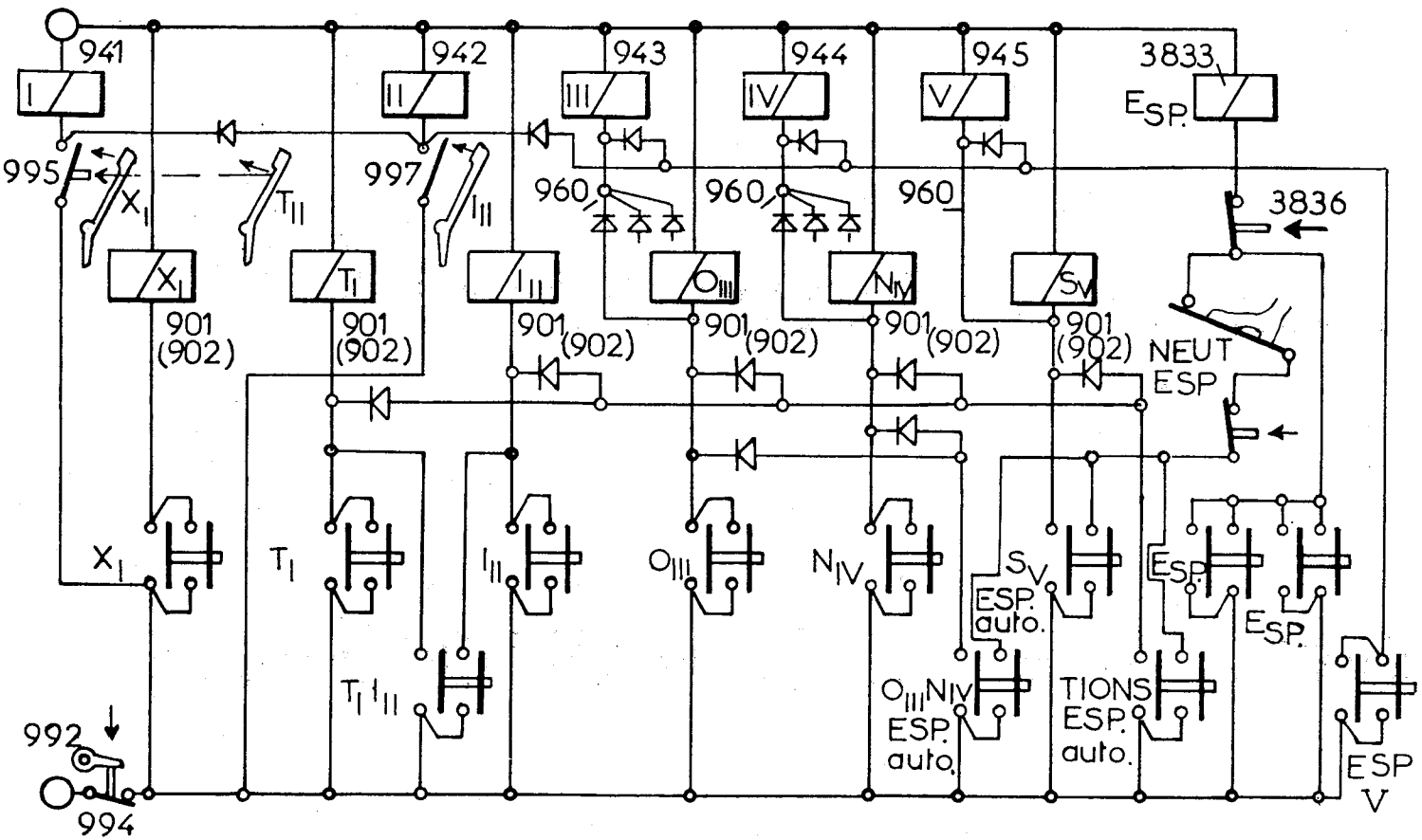

FIG. 47. Scheme of the assembly of electrical and electronic circuits by which the switches of the keyboard actuate the printings and the escapements.

Figure 48:
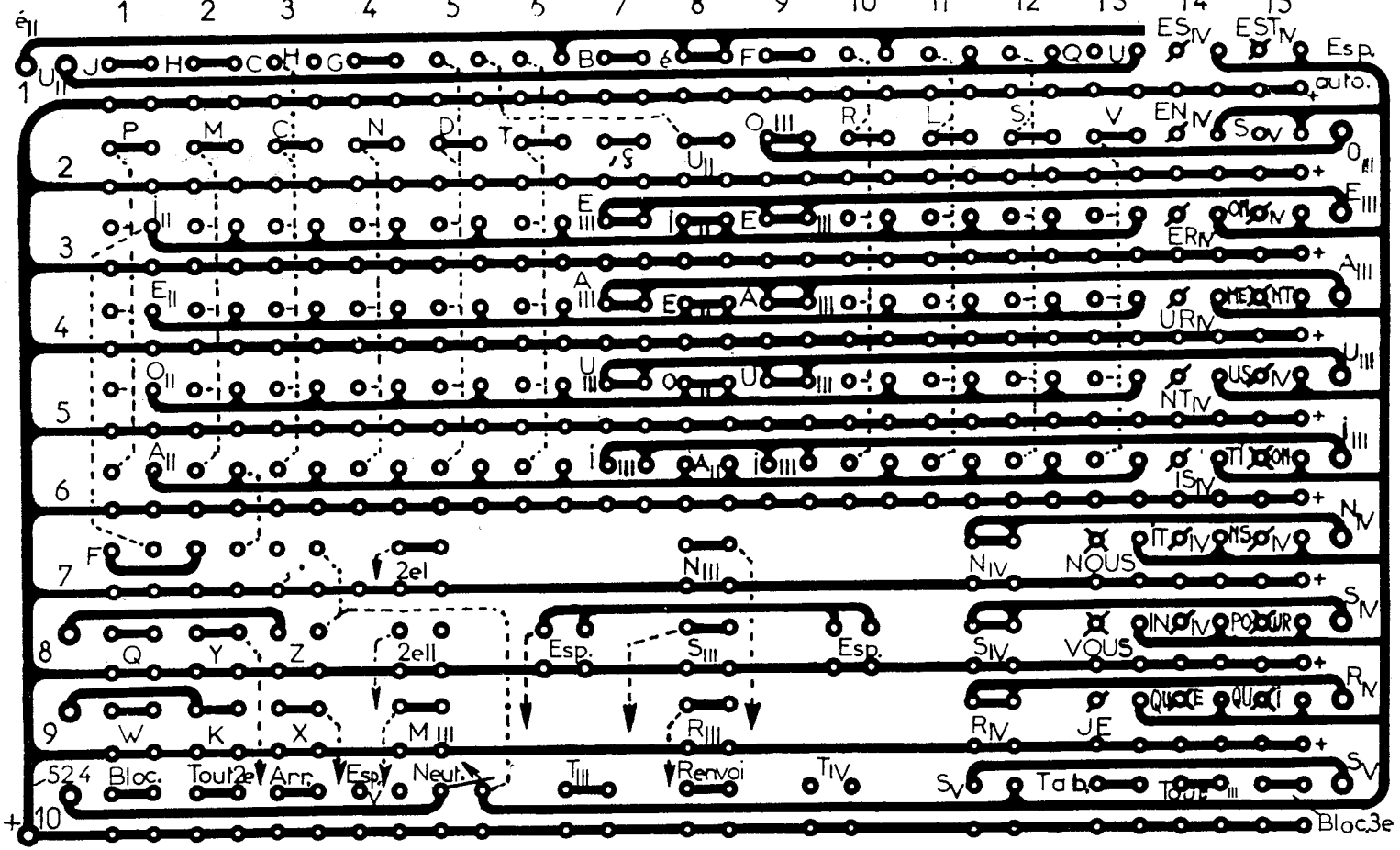

FIG. 48. The whole of the circuits that correspond to the keyboard made up of switches that each close two circuits. Part situated under the switches and which constitutes a printed network. Top view.

Figure 49:
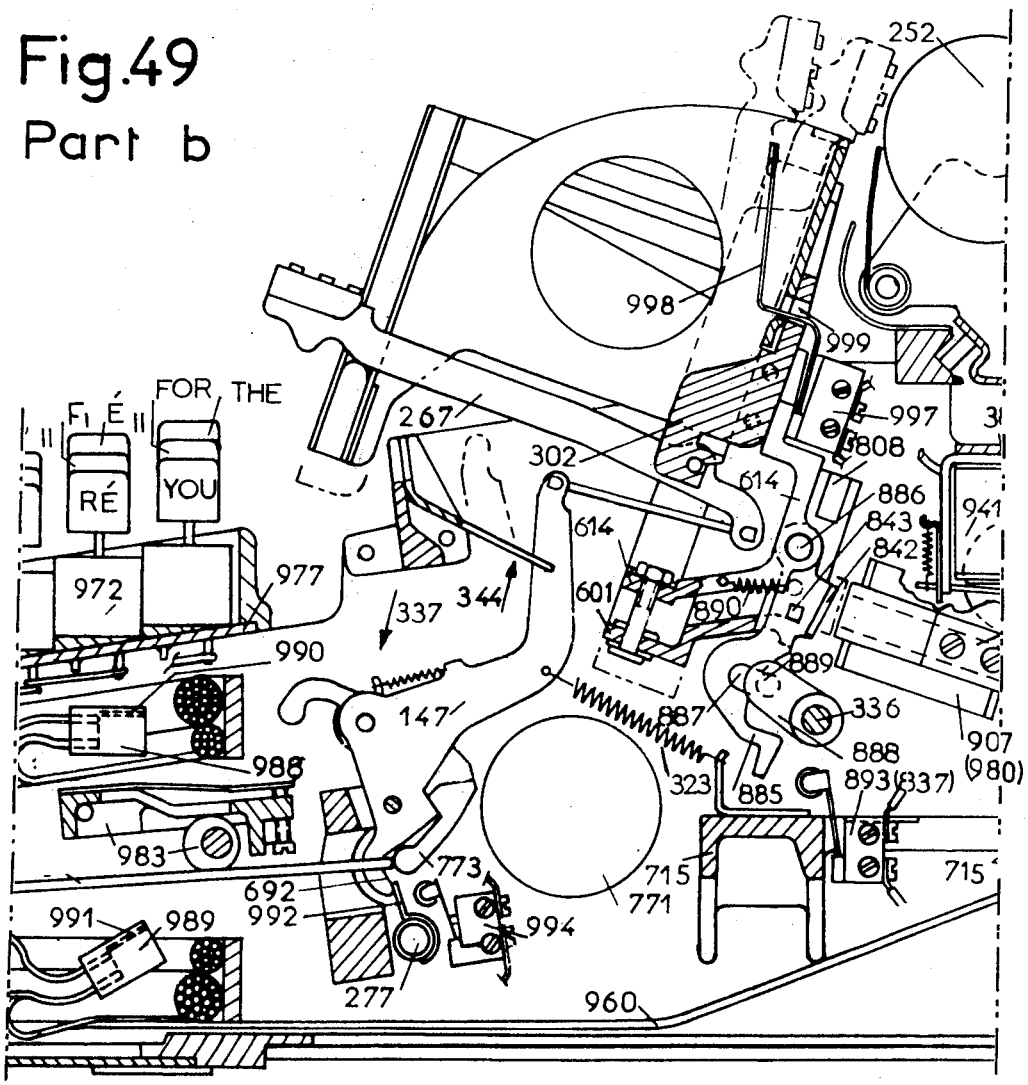
Figure 49:
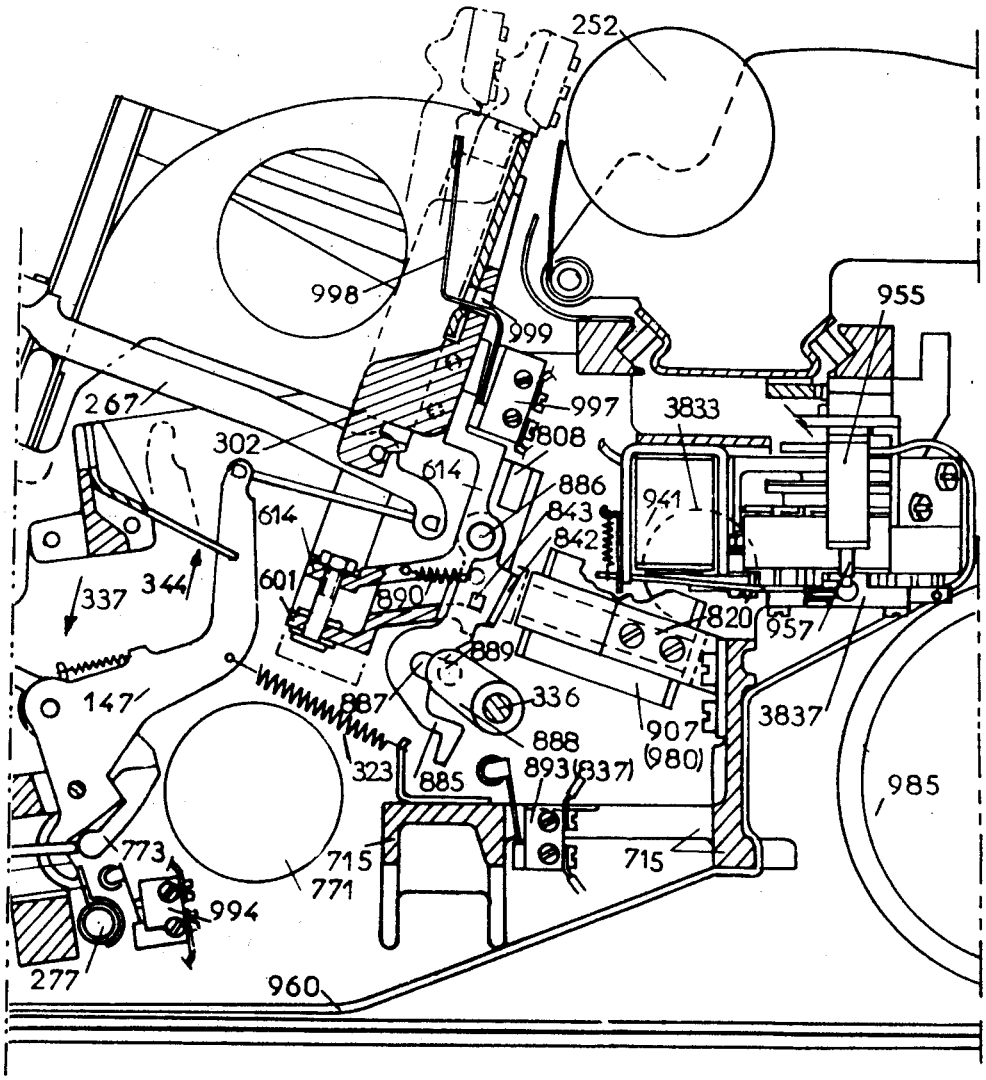

FIG. 49. comprising parts designated 49*a*–49*c*. The whole machine in the version comprising a keyboard made up of swiches that actuate the engagements on the driving cylinder and the escapement mechanism by electromagnetic means. Longitudinal section seen from the right.

Figure 50:
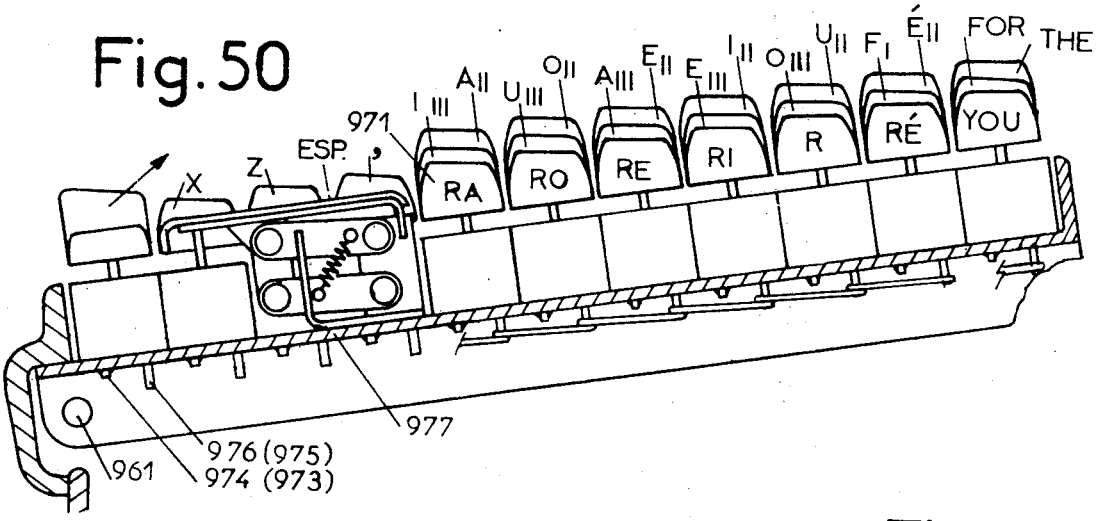
Figure 49:
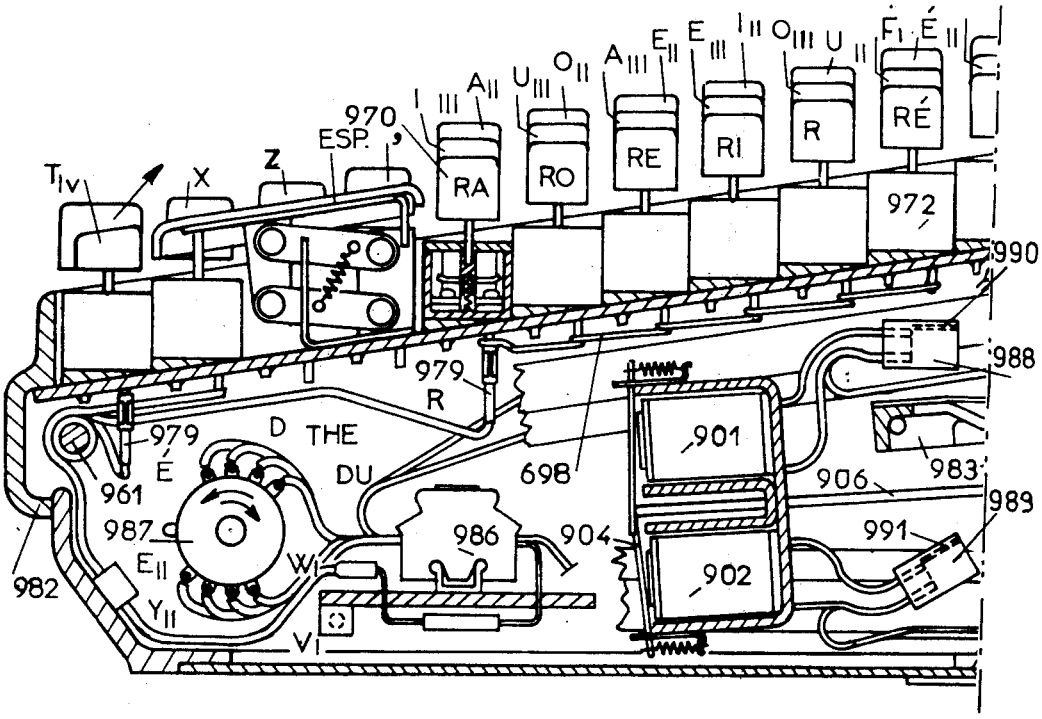

FIG. 50. Variant relating to the shape of the keys, the arrangement of the keyboard switches and the shape of their support.

Figure 51:
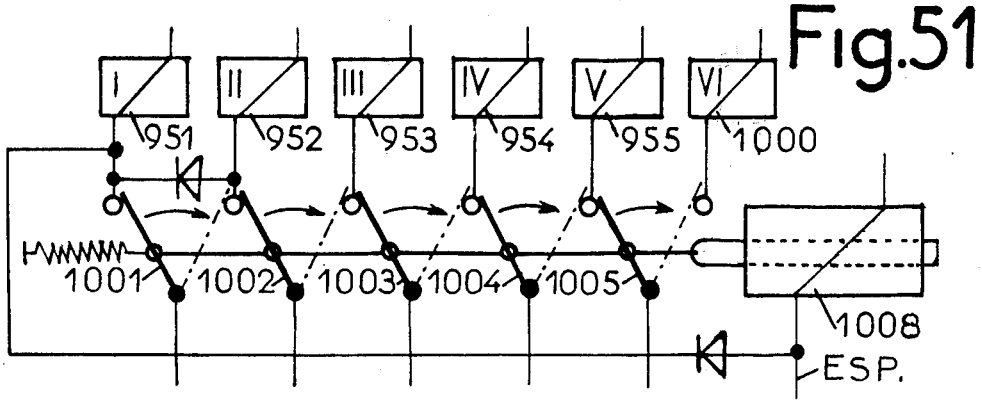

FIG. 51. Integration, through a transposition, of the spacing in the escapement, by means of an electromagnetic relay. Scheme of the device. (This device may replace the escapement anchor).

DESCRIPTION

General Considerations.

In the embodiments presented, the power of a smooth motor-driven cylinder is employed for printing and for different associated functions, as well as intermediary levers and other elements normally used in non-syllabic electric typewriters.

The machine described may evidently be adapted so as to employ similar elements borrowed from electric typewriters of another type. For example, a grooved motor-driven cylinder and levers similar to those normally used in such cases could be employed.

The associated devices, such as those for back-spacing, for return of the carriage, for tabulation and for advancement of the ribbon, which are well-known and which undergo no modification in this invention, are neither described nor illustrated.

Different parts of the machine that do not form part of the invention are shown only schematically and insofar as is necessary to situate the new devices or make their connections with the latter understandable.

Thus it is, for example, with the motor, the motor-driven cylinder, and the type-bars.

In the first example of realization described hereafter, it is presumed that the keyboard is similar to that described in U.S. Pat. No. 3,073,427.

Figure 1:
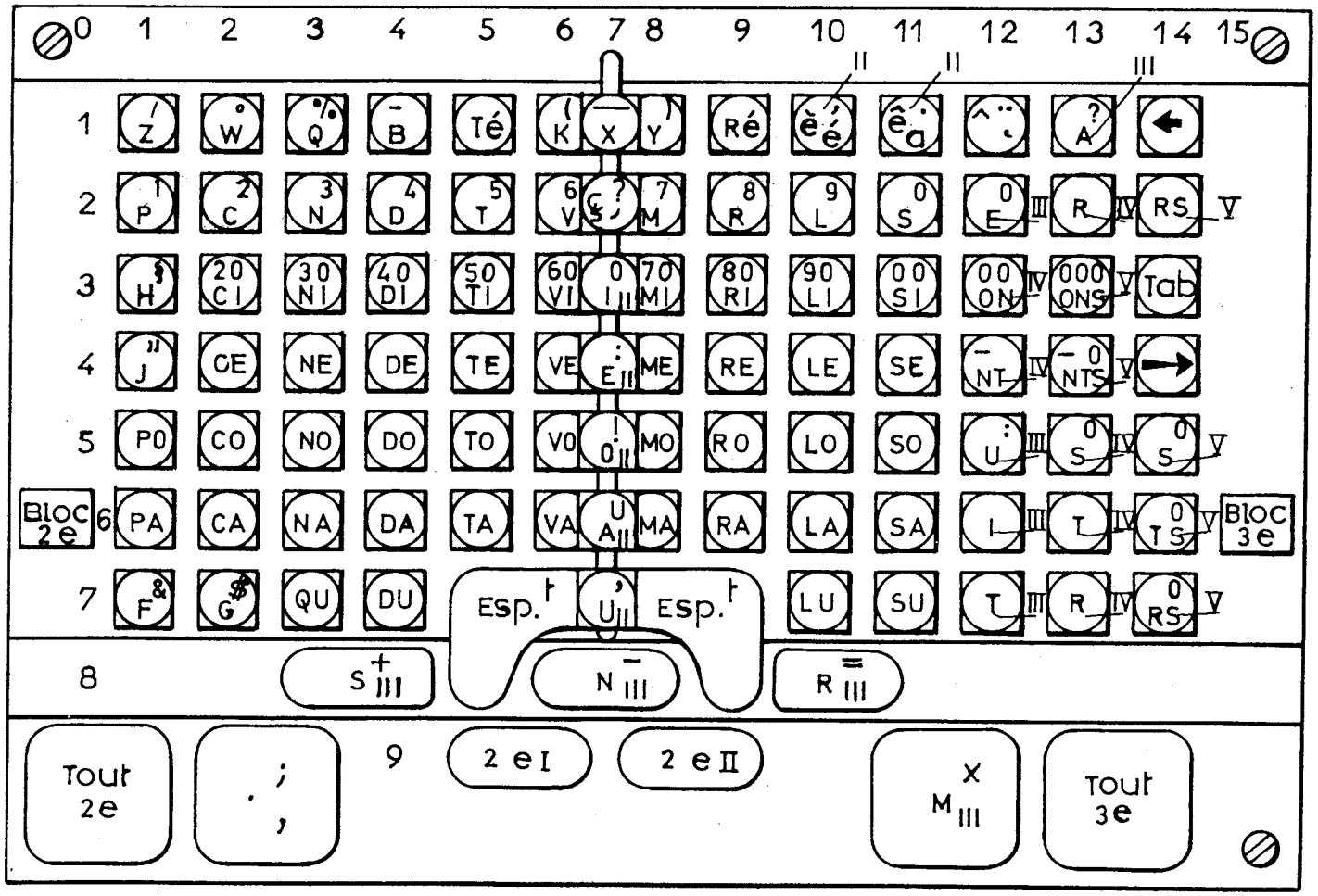
FIG. 1. Keyboard of the type that allows the use of only-mechanical connections. Layout for the French language. Top view.

FIG. 1 recalls the structure and layout of this keyboard.

In a second embodiment, the machine is provided with electromagnets. Electrical and electronic connections then replace numerous mechanical connections, giving greater freedom for the layout of the keyboard.

FIG. 1 is an example of a keyboard that may be adapted when the connections are solely mechanical, and also when they are electrical and electronic.

FIG. 42 shows a type of keyboard that can only be adopted when the machine is furnished with electromagnets. This keyboard includes, among other features, keys for large combinations ("that", "heir", "tion". . . ) that enable, at the depression of a single key, the printing of up to four characters at a time, and the simultaneous production of the space that has to follow them. On the other hand, numerous keys corresponding to Groups III and IV (EIII, NIII, TIV) are situated at the centre of the keyboard to facilitate the fingering.

Description of a syllabic striking mechanism (in which the escapement mechanism is utilized First will be described a complete embodiment in which the connections by which the keys produce the engagements on the driving cylinder and the connections for control of the escapement are purely mechanical. Then will be described other embodiments in which these connections are electromagnetic and electronic.

Figure 2:
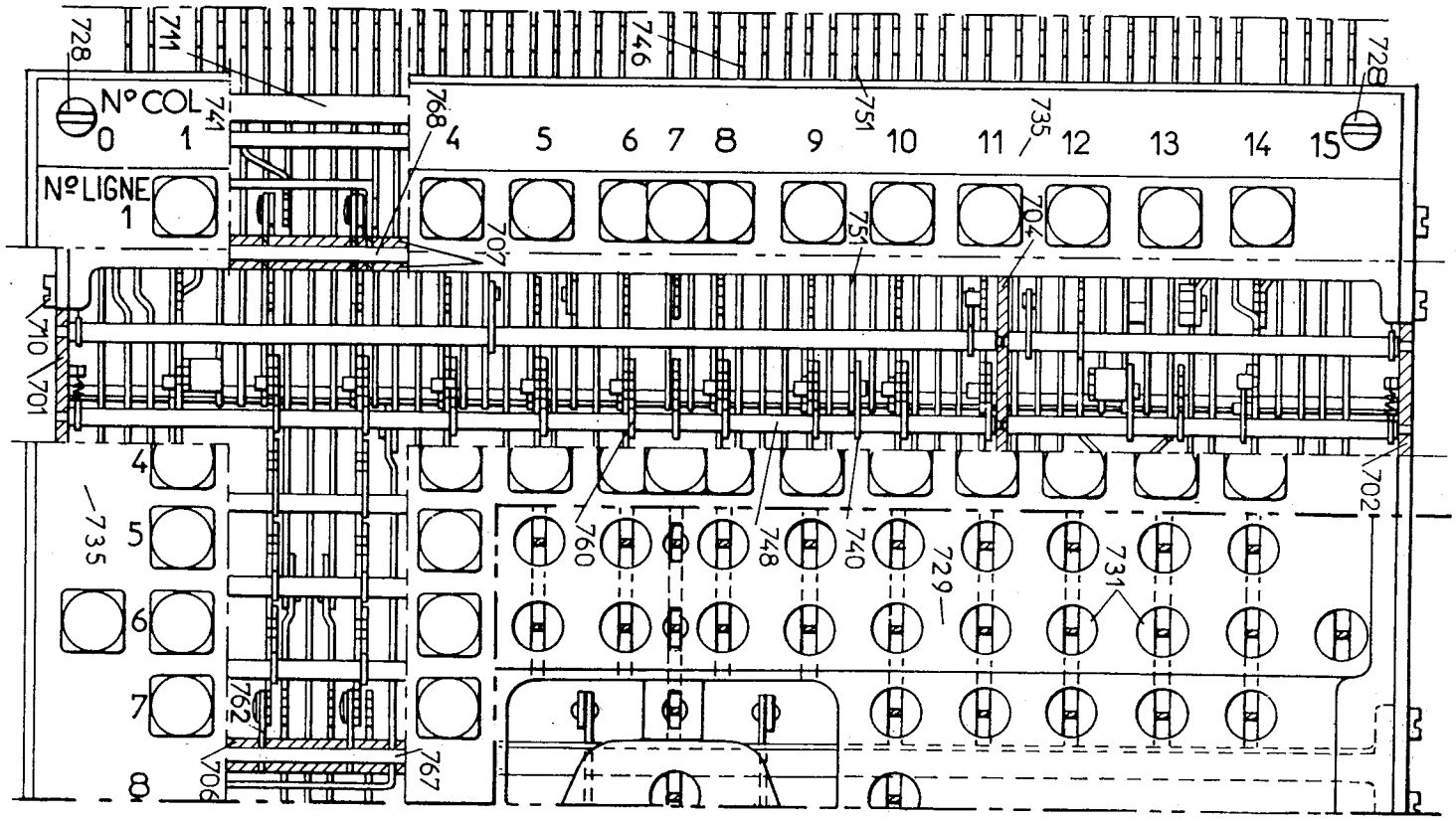
FIG. 2. Part of the mechanical connection box superimposed on the longitudinal levers, the keyboard being partly removed to show the articulated parallelograms combined with the devices for transverse deflecting of the movement (counter-motion device). Top view.
Figure 3:
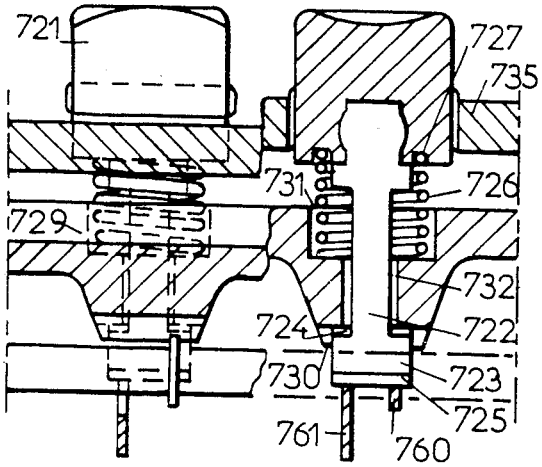
FIG. 3. Two keys each with its double-angular-edge knife, simultaneously driving a parallelogram that corresponds to the key column and a transverse counter-motion device corresponding to the key row. Front view.

The keyboard in FIG. 1 is based on a connection-box. The latter is situated above the forward part of the longitudinal levers (FIG. 2). The keyboard (FIG. 1) is laid out for the French language. The connections and mechanisms remain the same for other languages.

Escapement mechanism for the forwards movement of the carriage. Recalling of the principles of the escapement The escapement mechanism comprises essentially a cog-wheel of which each cog can be displaced in relation to the wheel, from a "stop position" to an "escapement position" so as to produce an escapement. This mechanism comprises also a mobile stop which, in its rest position, called stop position, is in the path of movement of those cogs of the wheel that have not been put into their escapement position. This stop can be put into a second position, called the escapement position, in which the cogs do not come up against it even if they are in their stop position.

In order to obtain an escapement whose length corresponds to one or several characters, one or several cogs are caused to be displaced, either by the action of group escapement paddles or by electromagnetic means that will be described.

To obtain a spacing of one single interval or to increase by a single interval the escapement that corresponds to the printing of one or several characters, the stop is made to move to its escapement position.

Description of the escapement wheel

Figure 8:
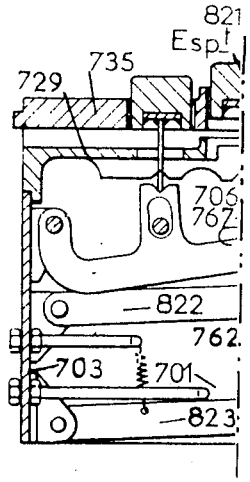
FIG. 8. comprising parts designated 8*a*–8*c*. Escapement mechanism and printing mechanism. Longitudinal section, seen from the right.
Figure 9A:
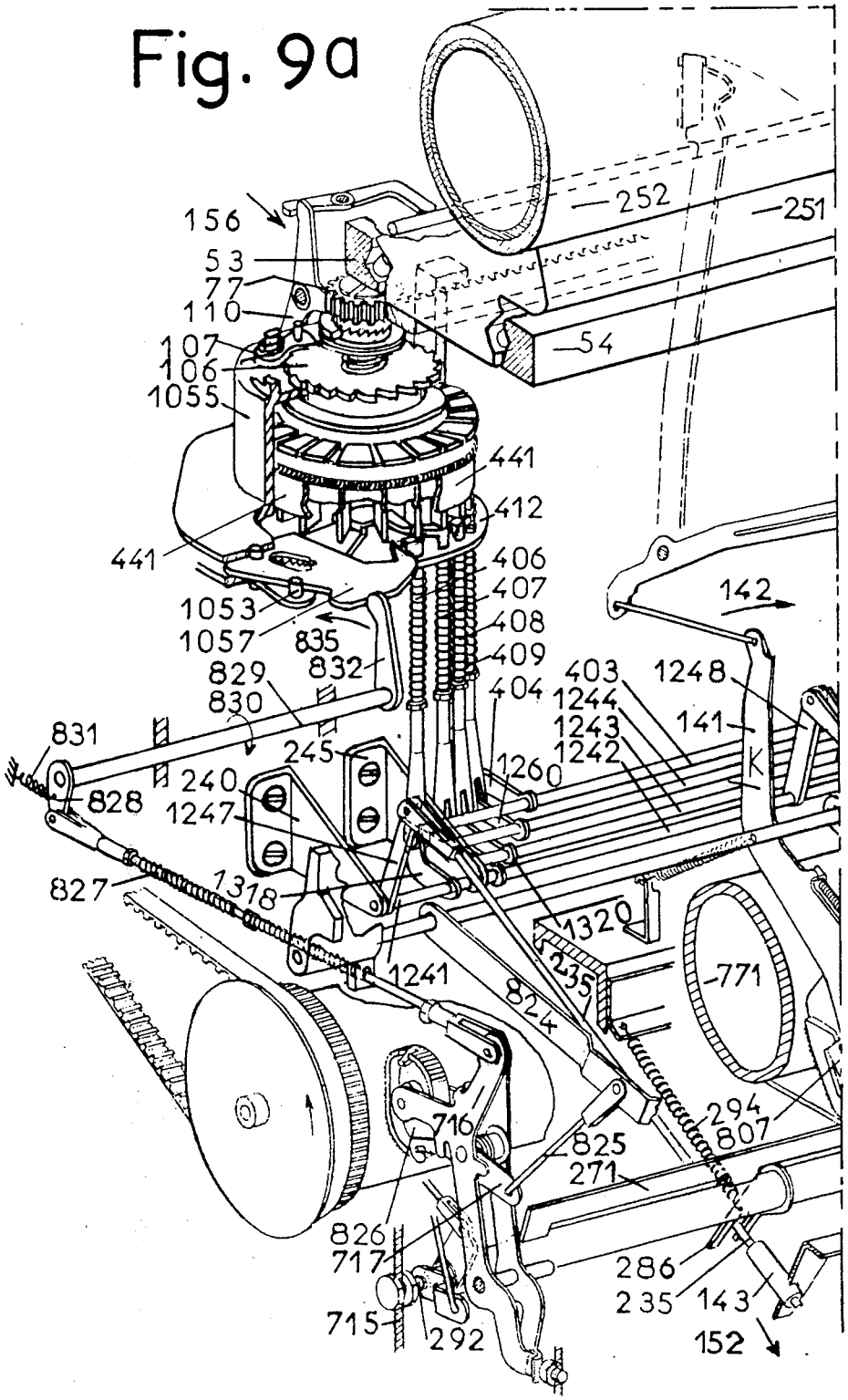
FIG. 9. comprising parts designated 9*a*, 9*b*. Escapement mechanism. Perspective.
Figure 9B:
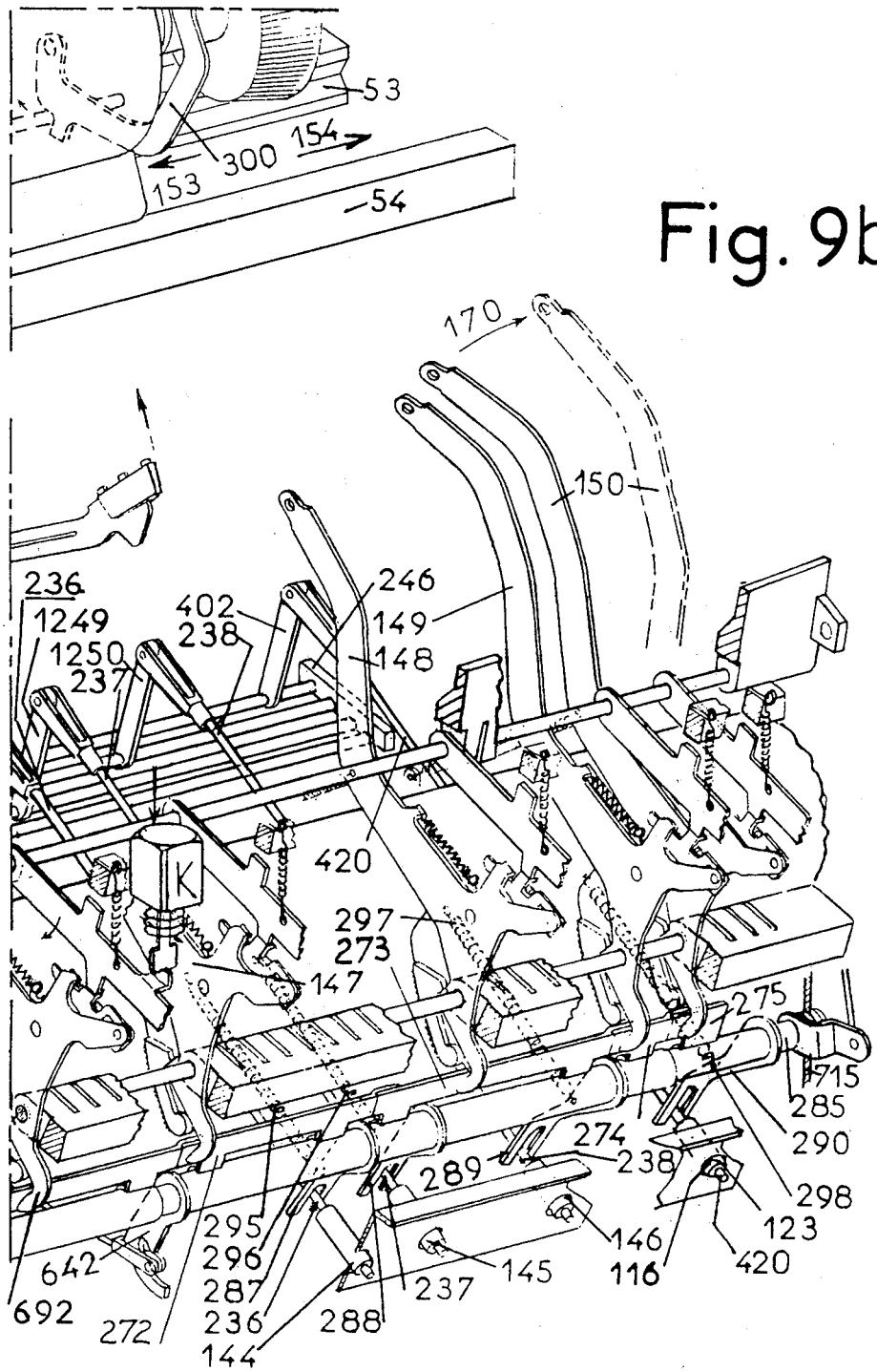

The localization of the wheel is shown in FIGS. 8 and 9. The wheel itself is shown enlarged: in front view in FIG. 24, from below in FIG. 27; from above in FIG. 28; and seen from the right in section in FIG. 25.

In this embodiment, the assembled wheel comprises sixteen identical mobile cogs 1021 (FIGS. 25 and 27) disposed in sixteen slots presented by the periphery of the barrel 1020 of the wheel. They are parallel to the axis of rotation of the wheel and equidistant. From the outside, all the cogs are held in the slots by a ring 441. Each cog has two preferential positions and can slide from one to the other. In a first solution (FIG. 26) it is held in each of its two positions by a positioning-spring 415 and by a positioning-ball 416 that is pushed by the spring. In the low position, it is held, in addition, by its own weight. In the high position, the ball is in a positioning-notch such as 417 in the cog. Each spring is situated, with its corresponding ball, in a cylindrical hole 414 pierced in the barrel of the wheel.

In a second solution (FIGS. 24 and 25) each cog has a notch 423, which replaces the notch 417 and is situated on the side opposite to the axle of the wheel. The barrel 1020 of the wheel has a flange 443. The upper edge of the ring 441 is situated at a slight distance from the flange 443. Between this flange and the ring is placed a ring-spring 442 whose diameter is equal to the distance between these parts. The two ends of this spring are hooked to one another so as to constitute an elastic ring. This single spring, therefore, presses on all the teeth. When one or several of the cogs are put into its escapement position (top position) the spring contracts in the notch 423 of each of these cogs. It thus prevents the cogs from redescending under their own weight. This solution is less expensive than the preceding one.

A third solution, using a permanent magnet in the shape of a crown, will be described below.

The stop position of each cog is its escapement position. The bottom position (position shown in the figures) is its stop position. The barrel 1020 (FIG. 25) of the wheel has a prolongation 422 in the shape of a crown that stops each cog when it arrives in its escapement position. The upper part of each cog (FIG. 24) is folded back. It is blocked against the barrel of the wheel when the cogs is moved into the stop position. In the variant where the shifting of each cog is made directly by the electro-magnetic field, this bended end augments the efficacity of the magnetic field.

The escapement wheel so assembled is mounted to rotate free on a support 1055 (FIGS. 24 and 25) by means of two ball bearings 51 and 52, FIG. 25, fitted on to the axle 1068 of the barrel 1020 of the wheel and embedded in the support 1055. This support is attached by screws to the back rail 53 of the carriage (FIGS. 25 and 9).

Figure 7:
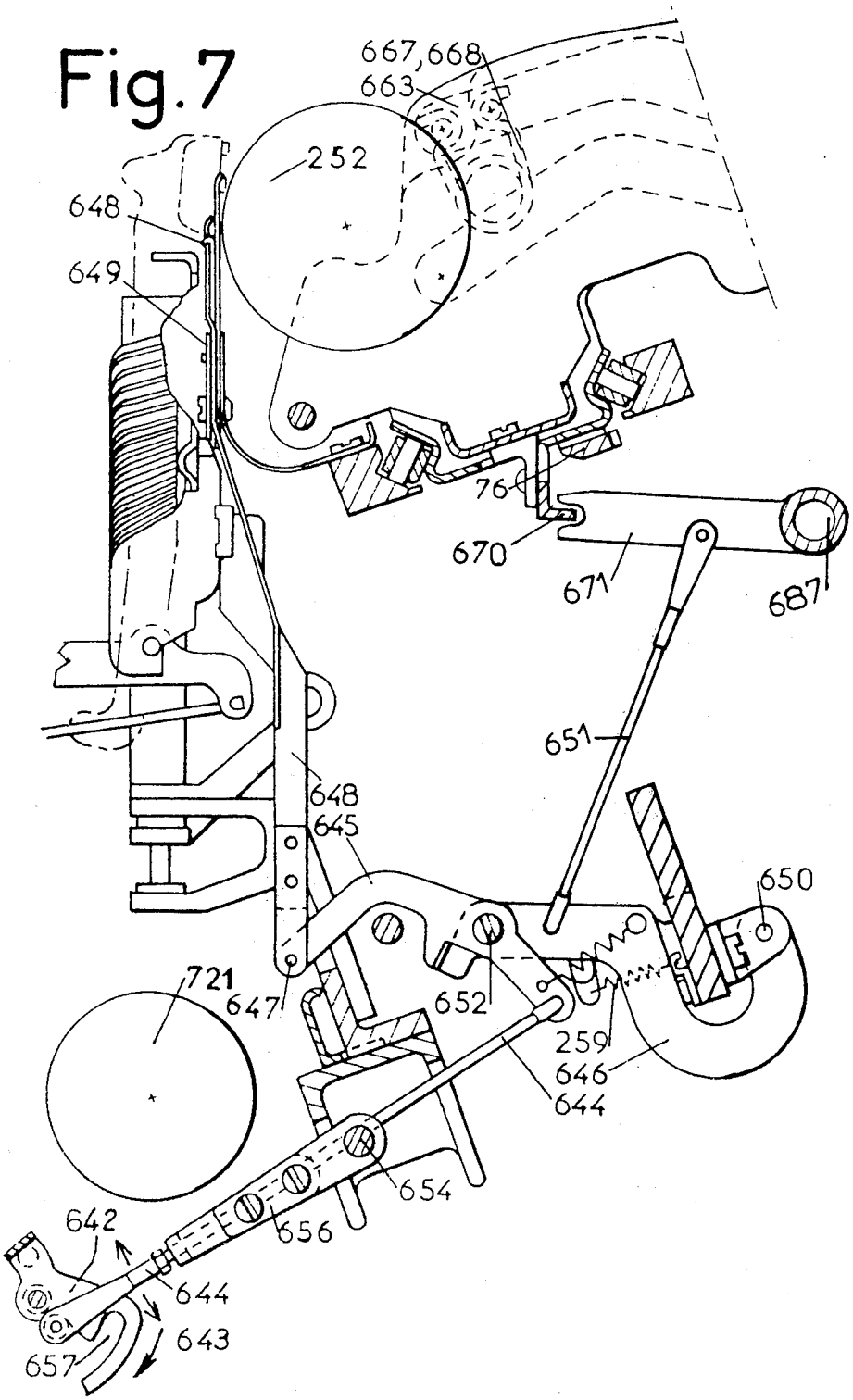
FIG. 7. Mechanism for raising the ribbon, the vertical displacements of which are controlled by the vertical displacements of the carriage cylinder (platen). View from the right side.

The carriage 251 (FIG. 9) moves on the back rail 53 and the front rail 54 in the usual way. It is continually drawn in the direction of the arrow 153 by a main spring not shown here, and is moved in the direction of the arrow 154 by conventional means that will not be described. An escapement-rack 76 (FIGS. 7 and 25) is fixed on to the carriage and engaged with a rack-pinion 77. This pinion is mounted free to rotate on the axle 1068 of the wheel.

The pinion 77 is linked with the wheel, in unilateral fashion, by its toothed crown 98 (FIG. 24) whose ratchet-teeth are normally engaged with the teeth of another toothed crown 99. The latter can slide backwards and forwards on the axle 1068 (FIG. 25) but cannot turn without it, because at this point the axle and the hole in the crown are square in section. The mobile toothed crown 99 is held engaged with the crown 98 of the pinion 77 by compression-spring 100. This spring bears on a ratchet-wheel 1106 that is an integral part of the axle 1068. A pawl 107 (FIGS. 25 and 28) whose axle is situated on the support 1055 of the wheel, is pushed against the ratchet-wheel by a plate-spring 109 fixed to the support 1055. This ratchet-wheel and this pawl prevent the escapement wheel from turning in the reverse direction during the return of the carriage 251 (arrow 154) (FIG. 9) or from bouncing back after each escapement. When the carriage moves in the opposite direction to the writing (arrow 154) without the crown 99 (FIG. 25) having been disengaged, this crown has a ratchet motion owing to the spring 100.

The carriage includes a hand lever 300 (FIG. 9) which by means of connections of well-known type, allows the disengagement of the carriage from the escapement wheel by displacing a forked lever 110 (FIGS. 9 and 25) in the direction of the arrow 156, which pushes the toothed crown 99, which disengages the latter from the toothed crown 98 borne by the pinion 77.

The cogs 1021 of the wheel, in their stop position (FIGS. 24 and 25), extend beneath the body 1020 of the wheel. When the wheel turns in the direction of the arrow 158 (FIGS. 28 and 27) each cog comes up against a mobile stop 1018. On the other hand, the cogs that have been put into their escapement position, that is to say raised against the crown 422 (FIG. 25) of the wheel-barrel do not come up against the stop 1018 when the wheel turns.

A fixed cam 1120 (FIG. 24) in the shape of a spiral, shown in dotted lines in FIG. 27 lies in the path of movement of the upper parts of the cogs that have been put into the escapement position. At each turn of the wheel, it pushes these cogs into the stop position for the next turn. This cam is fixed under the support 1055 of the escapement-wheel.

Description of the group escapement paddles and the connections that transmit their movements to the cogs of the wheel In the given example, the printing mechanism includes typebars 267 (FIG. 8) of which the part 268 situated at the back of their shaft has a different length according to the position of the type-bar in relation to the middle of the general grouping of the sectors. The central type-bars 267 are those in which this part 268 is the shortest, and the farthest bars 269 (FIG. 5) are those in which this part 270 is the longest. Thus all the intermediate levers 772, 141, 150 have an equal angular displacement. This is a well-known method. In the present embodiment, it allows the group escapement paddles such as 271 to be set in motion by the lower ends 692 of the intermediate levers 772.

These group paddles have three functions : to set the mechanism for advancing the ribbon in motion; to set the mechanism for raising the ribbon in motion, and each, to make one cog of the escapement wheel move into its escapement position.

For Group I, the paddle 271 (FIG. 14) is fixed on a tube 281 which bears a fork 286 and also a lever 280. This lever causes the engagement of a cam (not shown) on the motor-driven cylinder to produce the forward movement of the ribbon.

For Group II, the paddle 272 (FIG. 16) is fixed on the tube 282 which bears the fork 287. For Group III, the paddle 273 (FIG. 18) is fixed on the tube 283 which bears the fork 288. For Group IV, the paddle 274 (FIG. 19) is fixed on the tube 284 which bears the fork 289. For Group V, the paddle 275 (FIG. 20) is fixed on the tube 285 which bears the fork 1290.

The side view of the assembling in FIG. 14 corresponding to Group I, is shown in FIG. 15. The side view of the assembly in FIG. 16, corresponding to Group II, is shown in FIG. 17. The assembly in FIG. 18, corresponding to Group III, the one (FIG. 19) corresponding to Group IV, and the one in FIG. 20 corresponding to Group V have the same side view shown in FIG. 21. A lever in the form of a stirrup 291 (FIG.22) receives the movement from the paddles I to V. On the left-hand end of this stirrup is fixed a lever 642 that makes the ribbon rise. The side view of this assembly is shown in FIG. 23. All these assemblies corresponding to Groups I to V are mounted, free to pivot, on the shaft 277 (FIG. 11) which controls the forward movement of the ribbon in the usual way through the levers 278 to the left and 279 to the right. The shaft 277 is supported in the centre by a bearing 693 (FIGS. 12 and 13).

This whole is mounted on the pivots 292 and 293 (FIG. 10) screwed to the frame of the machine 715 (FIG. 9). Return springs 294 to 298 pull on the forks 286 to 289 and 1290 which holds the paddles against the ends of the intermediate levers.

Between the cogs of each fork 286 to 289 and 1290, a connecting-rod 235 to 238 and 420, is situated, made up of a rod bearing a screwed forkhead at the back and a sleeve, 143 to 146 and 116, fixed to the front. Each of these connecting-rods is attached, by its forkhead, to a lever, 1247 to 1250 and 402. The lever 1247 corresponds to the group escapement paddle 271 of group I and the lever 402 corresponds to group V. These levers are respectively fixed on the shafts 1241 to 1244 and 403 whose ends pivot within the supports 240, 245, 246 (FIGS. 9 and 29). Each of these shafts bears a second radial lever 1318, 1319, 1320, 1260, 404 (FIGS. 8 and 9) for the Groups I to V.

At the rear end of each of these second levers is mounted a vertical push-rod 406 to 410 (FIGS. 8 and 9) articulated by a screwed forkhead such as 411 screwed onto the rod. These rods are guided at their upper end by a plate 412 with holes wherein each of them is engaged. Plate 412 is mounted on frame 715 of the machine.

The upper end of each push-rod is placed opposite the cog of the wheel stopped at the place which corresponds to the character group to which the push-rod considered is related (places 1 to 5 for the Groups I to V). Each of these rods (FIGS. 9 and 29) has a horizontal extension 516, 512, 513, 514, 515 (FIG. 29) oriented in the direction of rotation of the cogs, for the case where a push-rod should displace a cog already displaced horizontally by the beginning of the rotation of the wheel. The horizontal extension 516 (FIG. 29) of rod 406 (FIG. 9) of character Group I is located between the two branches 1018 and 1019 of the escapement anchor 1057 (FIG. 27). The rod 407 (FIG. 29) of group II has an extension 512 (FIG. 29) opposite the cog stopped at place 1 which corresponds to Group I. This is because if one strikes a character in Group II without striking any in group I, the corresponding cog for Group I should nonetheless be put in the escapement position, otherwise the wheel will not rotate. This is the case where the initial letter of a group of letters to be struck simultaneously, belongs to Group II.

The way in which the group escapement paddles work and how their movement is transmitted to the cogs of the wheel If one struck a key in Group I, the corresponding intermediate lever such as 141 (FIG. 9) pivots in the direction of the arrow 142 onto shaft 807. Its lower end 692 carries with it the group paddle 271 and pivots the parts shown in FIG. 14 against the action of its spring 294 (FIGS. 9 and 8). The fork 286 at the end of its movement pushes the sleeve 143 in the direction of the arrow 152. The connection 235 by its forkhead causes the group made up of the lever 1247, the shaft 1241 and the radial lever 1318 to pivot. The latter lifts the push-rod 406 whose upper end moves the cog stopped at place 1 into escapement position which, being against the stop, would prevent the wheel to turn.

When a character is printed in Groups II, III, IV or V the corresponding intermediate lever such as 147, 148, 149 or 150 makes the same movement, by similar parts corresponding to the groups in question, what pushes the cog stopped at the corresponding place to its escapement position.

It has been seen that the push-rod 407, which corresponds to group II, pushes not only the cog stopped facing it, but also that stopped at the place corresponding to Group I.

Description of the escapement anchor

It has been seen that the wheel with movable cogs is stopped by a stop 1018 (FIG. 24). It is advantageous to make possible to obtain a space following the character, or group of characters, printed simultaneously and this by striking at the same time on a normal spacing key, and that this spacing key may be the same whatever the group, or groups, to which the characters in question belong. A means to obtain this possibility is that the stop of the escapement wheel be movable. This stop is constituted by the extremity 1018 of one of the two arms 1018 and 1019 of an escapement anchor 1057 (FIG. 27). This anchor is similar to the escapement anchors used in watch-making, but has new characteristics. The other arm 1019 of the anchor is the "return arm"; its function will be described later.

The anchor 1057 has two preferential opposed positions in relation to an equilibrium point. The first, is its rest position (FIG. 27, which is the stop position. The second, (dot-dash lines) is its escapement position. In order to pivot from one to the other the anchor is mounted on a shaft 1058. The anchor is pushed by a spring 1060 towards one or other positions immediately after its equilibrium point.

The same effect can be achieved by a permanent magnet as it will be explained later. The anchor is positioned in a support 1056 (FIG. 24) in two parts which support its shaft 1058. The upper end of this support is made up by the lower part of support 1055 for the wheel. The lower part of the anchor support is fixed by screws to the support 1055 of the wheel. In FIG. 27, this lower part of the anchor support is removed so as to show the whole anchor. Stops 1053 and 1054 limit the movements of the anchor. The spring 1060 and ball 1059 are guided by a groove in both parts of the support. The spring bears on the support.

The edge of the return arm 1019 of the anchor is inclined in relation to the direction of arrow 158, direction followed by the cogs of the wheel so as to constitute a cam on which act the first of the cogs that have remained in stop position. The stop 1018 had enabled this cog to pass because the anchor was in the escapement position. The action of this cog on the cam 1019 returns the anchor to stop position.

The anchor has a groove 401 (FIGS. 25 and 27), so as to enable passage of the cogs remaining in the stop position.

Description of the device which controls the escapement anchor

The movement of the anchor into escapement position is controlled by either of the two spacing keys "Esp." (FIG. 1). Each of these keys is fixed on a rod 821 FIG. 8 articulated on two connecting rods 822 and 823. These connecting rods constitute, with the rod 821, an articulated parallelogram. Each of the rods 821 by a catch-pin, pushes a deflecting device of the movement. This device is not shown. It controls the longitudinal lever 824 (FIG. 9). This lever is linked through a connection 825 to a lever 717; the effect being to unbolt a cam of well-known type 826 and to engage this onto the driving cylinder 771. The cam is shafted on lever 716 whose upper end is linked by an elastic connection 827 to a lever 828 fixed on a shaft 829. This shaft carries a second lever 832 whose upper end is located in front of the escapement anchor. A return spring 831 has one end fixed on the frame of the machine and its other end hooked onto the lever 828.

From longitudinal levers 824 to the lever 832 the device is identical to that used in certain electric machines. Its working is therefore well known.

Working of the escapement anchor and of the device that controls it

It has been seen that while the anchor is in stop position (FIG. 27) its stop arm 1018 lies in the path of movement of those of the cogs of the escapement wheel which are themselves remained in stop position. The anchor thus stops the wheel by stopping the first of these cogs. On the contrary when the anchor is in escapement position (dot-dash lines) its arm 1018 is not on the path of movement of any of the cogs of the wheel; it stops thus neither those in stop position, nor those in escapement position. On the contrary, in this position, its return arm 1019 lies in the path of movement of the cogs which are in stop position.

The anchor is moved from its stop position into escapement position when either of the two normal spacing keys is struck. In this case, the key Esp (Space) (FIG. 1) that has been struck, by the connections mentioned engages the cam 826 FIG. 9 on the driving cylinder 721 and this cam causes the shaft 829 and the lever 832 to pivot in the direction of the arrow 835. In the end of its movement the lever 832 pushes the anchor 1057 from its stop position to its escapement position. The spring 831 immediately brings the control device back to its rest position. But the anchor is maintained in its escapement position (shown in dot-dash lines in FIG. 27) by its spring 1060.

When the anchor has thus been put into escapement position, the first of the cogs that are in stop position and arriving near the stop 1018 does not encounter it and move beyond it. But is encounters the cam constituted by the inclined edge of the return arm 1019 of the anchor and its pushing restores the anchor in stop position. As a result, the stop arm 1018 lies once again in the path of movement of the cogs in stop position. It thus stops the second of these cogs.

The combination of the anchor with the wheel with mobile cogs allows to increase the amplitude of the escapement corresponding to the number of types printed simultaneously, this by striking one of the two spacing keys at the same time as striking one or more character keys. If the anchor is put alone into motion by a strike on one of the two spacing keys Esp (Space) (FIG. 1), it admits the passage of one single cog and the result is only a spacing of a single interval.

Designation of the places that can be taken up by a cog on the circumference of the cogged wheel and the action exercised on the cog at each of these places.

There are 16 cogs and 16 places numbered 1 to 16 (FIGS. 27, 28 and 24) starting from 1 for the place which is against the stop 1018 and going in the direction of the arrow 159 which is opposite to the direction of rotation of the wheel. Place 16 is thus taken up by the cog which has just passed the stop. When the wheel turns, each cog moves through the 16 places. At each place it stops or does not stop, depending on the number of simple intervals which constitute the escapement caused by the strikes in the different cases.

The places where a cog can be moved from its stop position into its escapement position are places 1 to 5. Their number is at least equal to the number of character groups with distinct printing points that comprises the keyboard. A printing in group I puts the cog in place 1 into escapement position, a printing in group II puts the cog in place 2 into escapement position and so on, a printing in group V putting into escapement position the cog in place 5. It has been explained that, besides, a printing in group II places the cog in place 1 into escapement position.

The cam 1120 (FIG. 24), in helicoidal form, is above the cogs stopped in places 6 to 9. While the wheel turns, each of the cogs that have been put into escapement position meet this cam which pushes them back into stop position for the next turn. This cam could be extended above places 10 to 15. In moving from place 1 to 16 in the direction of the arrow 158 (FIGS. 27 and 28), the first of the cogs that have remained in stop position, but which the stop 1018 has nonetheless allowed passage because the anchor was in escapement position, meets the return arm of 1019 of the anchor and thus pushes the anchor back into stop position.

Working of the escapement mechanism in the different cases

The rack 76 (FIG. 28 and 25) being fixed under the carriage and geared to the pinion 77, this pinion tends to turn the escapement wheel. The cog stopped in places 1 to 5 are in stop position. The cog stopped in position 1 is against the stop arm 1018 of the anchor 1057 (FIG. 27). This anchor is in stop position. The wheel cannot therefore turn in the direction of the arrow 158 and the carriage cannot advance.

It is using this situation as a basis that the working of the escapement mechanism in each particular case will be explained.

First Case: Printing of one single character of group I without spacing.

This printing being actuated by a type key of group I, the corresponding intermediate lever such as 141 (FIG. 9) pivots. Its lower end carries the escapement-paddle 271 of group I along with it. This, by means already described, causes the rod 406 (FIGS. 9 and 8) to rise and this, through its upper end, pushes the cog of place 1 into escapement position. Immediately after this the several parts that have been moved to push the cog, return to their rest positions. But at the same time, the cog at place 1, having escaped from the stop arm 1018 and no longer stopping the wheel, this last starts to turn until the cog that was in place 2 is stopped by the stop arm 1018. The cog at place 1, after having passed above the stop, is then at place 16. The carriage has thus moved by a single space and this corresponds to the printing of the character of group I which has just been accomplished.

This result is the same as that obtained with each printing in a typewriter which prints only one character at a time without spacing. For this first case the mobile stop 1018 could be replaced by a fixed stop.

2nd Case : Simultaneous printing of a character from group I and of a character from group II without spacing.

The striking of a character key which controls the printing of a character from group I produces the movement into escapement position of the cog stopped at place 1 (FIG. 27) as in the first case, which frees the escapement wheel. But at the same time, the striking of a key which controls a type-bar of sector 302 of group II (FIG. 5) causes the pivoting of the corresponding intermediate-lever such as 147 (FIG. 9), whose lower end pushes the group escapement-paddle 272 of group II. This, by the means already described, causes the rod 407 to rise and its upper end moves the cog stopped at place 2 into escapement position.

The parts thus moved to displace this cog return immediately to their rest positions at the same time as the corresponding parts of group I. The wheel starts to turn as in the first case, but the cog that was at place 2 moves above the stop 1018. The wheel thus turns until the cog that was stopped at place 3 is stopped at place 1 by this stop. The escapement thus obtained corresponds to two single intervals, that is to say, to the printing of two characters.

For this second case, as for the first case, a fixed stop could replace the mobile stop 1018.

It has been seen that rod 407, corresponding to group II, thus also pushes the cog in place 1; but in the case described here, this action duplicates the one of rod 406 which corresponds to group I.

It is known that many keys of the keyboard (FIG. 1) can each be used to print simultaneously a character from group I and a character from group II. In the second case described here, one generally depresses only a single key, but the escapement obtained is the same as that obtained with two keys each actuating a single type-bar.

3rd case: The simultaneous printing of more than two characters, one from group I and the other from several adjacent higher groups, without spacing.

The assumption here is that none of the groups of rank below that of the rank of the highest group wherein a character is printed remains without printing.

The parts of the escapement mechanism displaced in this case for groups I and II are the same as in the 2nd case and the effects are the same, but in addition, in each of the ensuing groups wherein a character is printed, the similar parts are moved by the corresponding intermediate-lever and in the same manner. They push into escapement position the cogs stopped at the places respectively corresponding to their group. The wheel starts to turn as soon as the cog in place 1 is in escapement position, as in the two earlier cases but all the cogs corresponding to the adjacent groups wherein a character is printed simultaneously, having been put into escapement position, pass above the stop 1018. The rotation of the wheel is thus stopped only by the cog that was at the place corresponding to the group of lowest rank in which no character is printed; this cog having remained in stop position. For example, it is the cog in place 4 if a character in each of the groups I to III were printed, or the cog in place 6 if a character in each of the groups I to V were printed.

Whatever the number of adjacent groups starting from group I, in each of which a character has been printed, the length of escapement is always equal, in number of simple intervals, to the number of characters printed.

4th Case: The printing of a character in one or several adjacent groups starting from group II, without printing any character in group I and without spacing.

It has been explained that the upper end 512 of the rod 407 (FIGS. 9 and 29) is extended under the cog stopped at the place corresponding to group I and that, as a result of this, the rod 407 always pushes back the cog of place 2 and also that of place 1 into escapement position.

In this 4th case, the cog stopped in place 1 is thus put into escapement position although no character in group I has been printed. The escapement is thus of the same length as it would be if a character from group I had been printed with the others. It has thus the same length as in the 3rd case. The 4th case occurs particularly when the initial letter of a word exists only in group II. For instance, a vowel.

5th case: Striking a normal spacing key without striking any character key.

This striking causes the escapement anchor 1057 (FIG. 27) to move from its stop position into its escapement position, this by means already described. It is known that the parts that have been set in movement to displace the anchor come immediately back to their rest position, but that the anchor remains in escapement position until the first of the cogs of the wheel that have remained in stop position having moved beyond the stop arm 1018, meets the cam 1019 and thus returns the anchor to stop position. The stop 1018 returns to stop position in time to stop the second of the cogs remaining in stop position.

Since, in this 5th case, no character is printed, all the cogs have remained in stop position. p The anchor being put into escapement position enables the cog in place 1 which was against the stop arm 1018 to pass and stop the cog in place 2. The escapement is thus of a single interval just as that obtained when striking the space bar in a usual typewriter.

6th Case: The striking of one of the keys that produce a single space and, at the same time, one or more character keys.

The working of the anchor is the same as in the 5th case, but the cog of the wheel which corresponds to group I (even if no character in the group I has been printed), and those that correspond to all the following adjacent groups wherein a character has been printed, have been placed in escapement position, as in the first four cases.

The anchor having been placed in escapement position, as in the 5th case, stops only the second of the cogs that have remained in stop position. The result is to increase by a single interval the length that the escapement would have if the same characters have been printed without striking a space key.

One can thus drive simultaneously with the printing of a certain number of characters, the spacing which have to follow them. It has already been proposed means to achieve this result, but the means used here are more rapid and present a better reliability.

From what has been described concerning the different cases one can formulate the following general rule:

"If one prints one or more characters in adjacent groups, without causing at the same time an ordinary single space, by the means of the escapement anchor, the length of the escapement obtained is always equal, in numbers of single intervals, to the number expressed by the rank of the group whose rank is the highest in which a character is printed and if, at the same time, one causes a single space by means of the escapement anchor this length is increased by a single interval."

Second form of the escapement anchor

The escapement anchor 1057 (FIG. 27) may be replaced by an anchor 2057 which is seen enlarged in top view (FIG. 30) the wheel-removed, and in front view (FIG. 31). These views show schematically the cogs of the wheel positioned at places 1, 16 and 15. The anchor 2057 acts on the cogs according to the same principle as the anchor 1057, but it presents the following characteristics:

The shaft on which it oscillates is constituted by a boss-screw 2058 fastened on the support 2055 of the wheel by a nut 119. In rest position the stop arm 2018 of the anchor is located on the path of movement of the outer edge of the cogs that are in stop position. It thus stops the cog situated at place 1. The horizontal section of the return arm 2019 is triangular. In rest position, this return arm is outside the path of movement of the cogs. In escapement position, the two arms of the anchor are situated by dot-dash lines. The stop arm 2018 is then outside the path of movement of the cogs. It thus enables the first of the cogs which have not been put into escapement position to pass. The return arm 2019 is on the path of movement of the lower edge of this cog. This cog pushes this return arm, which returns the anchor to stop position. In this action of the cog on the return arm 2019, in comparison with this action where an anchor of type 1057 is used, the cam effect is diminished and the lever-effect is increased. The anchor 2057 is maintained in each of its two positions by a horseshoe-shaped permanent magnet 2060 fixed to the support 2055. The anchor 2057 has a shank 2061 which is drawn by one of the two poles of the magnet to which it is the closest when it is brought beyond the equilibrium position. The magnet thus helps the final part of the anchor movement, and then holds it. The function of this magnet is thus the same as that of the spring 1060 in the first form of embodiment. The magnet constitutes a double stop which limits the to and fro movement of the anchor.

When a space key is struck, either alone or simultaneously with one or several character keys, the lever 832 (FIGS. 9, 30 and 31) receives the same movement as when an anchor of the first type 1057 is used. It thus moves in the same way the anchor 2057 FIG. 30 and 31 into escapement position, then returns it to its rest position. The anchor 2057 remains in escapement position until the action of a cog of the wheel on the return arm 2019 brings it back into stop position.

When the machine is constructed with a switch-keyboard (FIG. 41), an anchor 3057 is used, this anchor is shown enlarged in FIG. 32 from above and in FIG. 33 in front view. This anchor 3057 is driven by an electromagnet made up of a coil 3833, a fixed armature 3835 and a fixed core 3834 fastened to the support 3055 of the wheel.

When one strikes a spacing key, either alone or together with character keys the coil 3833 is put into circuit by means that will be described later. The core 3834 attracts the shank 3061 of the anchor, which puts the anchor into escapement position. To allow this magnetic attraction and in order to enable the electromagnet to be positioned, the shank 3061 of the anchor has been given a different form to that of the shank 2061 of the anchor 2057 and also a different orientation. The other parts of the anchor 2057 and of the anchor 3057 are identical. The permanent magnet 3060 is identical to the permanent magnet 2060 and its action on the shank of the anchor is the same. It is fixed to the armature 3835.

The anchor 3057 has a catch-pin 3836. On the path of movement of this is the lever 3838 of a micro-switch 3837 seen from below in FIG. 44, which cuts off the circuit of the coil 3833. It follows that if the key does not move back up early enough, nevertheless the electromagnet does not in that case prevent the return of the anchor 3057 to its stop position.

If the key is held depressed, a spacing is produced repetitively, the anchor oscillating like the hammer of an electric bell.

With the anchor 3057, the movement of the driving cylinder 771 is not used to produce the spacing. Lever 832 (FIGS. 30 and 9) and all the parts by means of which the drove cylinder 771 drived this lever are suppressed.

This electromagnetic driving of an anchor 3057 also enable the keyboard to have character keys automatically controlling a spacing. This will be explained later.

The only change to the wheel support 1055 (FIGS. 24 and 28) to enable it (2055 FIGS. 30 and 31) to be used with the second form of the anchor 2057 or to be used (3055 FIGS. 32 and 33) with the latest form of the anchor 3057 is the reduction of its lower horizontal section which serves as a support for the anchor.

Figure 4:
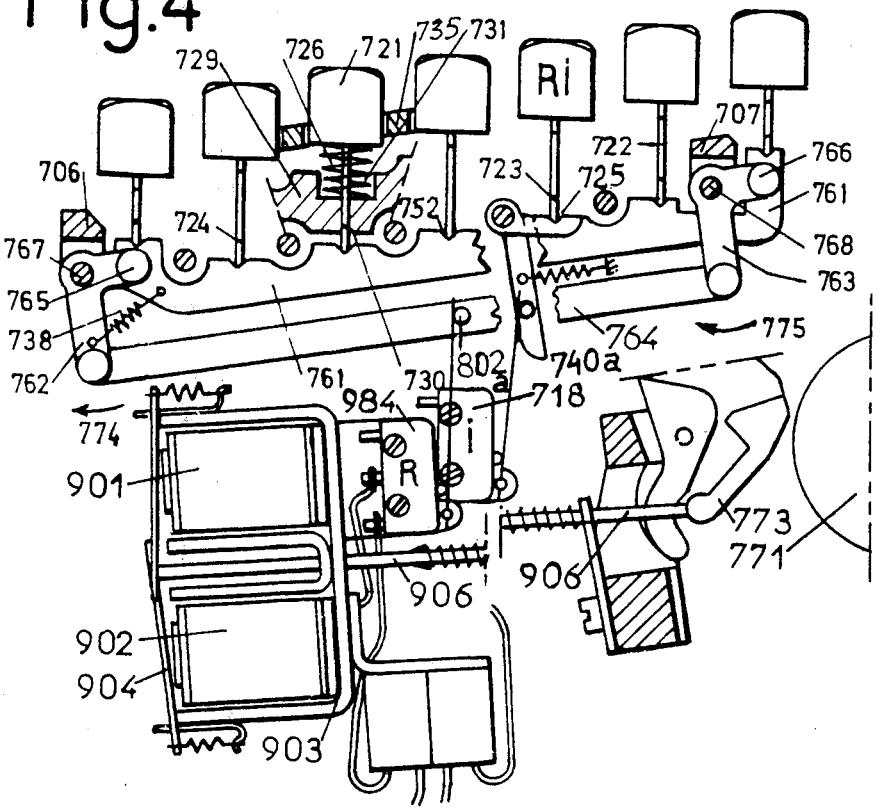
FIG. 4. One of the articul ated parallelograms, the keys that actuate it, one of the counter-motion devices, and electromagnets for engagements on the driving cylinder. View from the right side.

The machine equipped with a keyboard of switches which control the electromagnets for printing and spacing In ordinary electric typewriters equipped with electromagnets such as 901, 902 (FIG. 4) these electromagnets are used usually only for the remote or automatic control of the machine. In these usual machines, for manual typing, one conserves generally the longitudinal levers (FIG. 5) which each have one key and each control mechanically the engagement of a cam such as 773 (FIG. 8) on the smooth driving cylinder 771 or another part on a grooved driving cylinder. In these usual machines, this choice is due to the mechanical liaison between each key and the cam or another corresponding part to effect engagement on the driving cylinder can be very simple.

In the syllabic machine described the mechanical connections (FIG. 5) between each key and one or more cams 773 (FIG. 8) is more complex. The result is that when this machine is equipped with electromagnets, such as 901, 902 (FIG. 4) for remote or automatic control, it could seem advantageous to replace the mechanical connections by which the keys engage the cams on the driving cylinder, for example, the simple longitudinal levers or longitudinal levers with parallelogram, together with the transverse counter-motion devices by a keyboard of electric connections completed by electronic components. The striking of each key then produce one or more electric impulses that simultaneously excite one or more electromagnets for engaging on the driving cylinder and for producing the printing of one or more characters simultaneously, with or without spacing.

Syllabic writing is thus produced as when the keys control mechanically the engagements on the driving cylinder, which is the way in the first described embodiment.

The machine equipped with such a keyboard of electric switches is shown in FIG. 49. It consists of a network of electric conductors in the form of printed circuits and wires.

The principal advantages achieved by a keyboard of electric switches controlling electromagnets are:

- simplification of mechanical construction;
- reduction of the force necessary to depress keys;
- uniformity of this force for all keys;
- greater ease in locating each key on the syllabic keyboard;
- the possibility of simultaneously controlling with the same key a great number of letters together with spacing; and
- the possibility to obtain control of the escapement mechanism with the help of electromagnets which in certain cases are switched on by a character key.

Certain of these advantages will now be detailed.

In syllabic typewriters, where the keys control the engagements on a driving cylinder mechanically the majority of keys are each situated in the region of the keyboard where the corresponding longitudinal lever passes. However, in those machines that use a keyboard of the type shown in FIG. 1, in addition to the keys of the rectangular matrix which combine the letters of group I and II, some keys have been displaced in relation to their respective longitudinal levers. Thus the thumb keys corresponding to the letters R, N, S of group III, whose longitudinal levers are nonetheless inevitably on the right-hand side of the machine, have nevertheless been located in the front center of the keyboard. But when one uses only mechanical connections it is impossible to increase much the number of displaced keys, in order to improved the fingering. On the contrary with a keyboard made up of switches and a network of electrical connections, one can arrange all the keys in such a manner as to suit and simplify fingering and also assign the same letter to several keys. Thus, for example, one can use a keyboard of the type shown in FIG. 41. The keys of this keyboard are each made up of the push-button of a switch of well-known type shown in FIGS. 43 and 49. The depressing of each key closes two circuits and its release cuts them off. But one can use any other type of electric switch and specially those where the depression of the key causes an impulse without mechanical contact, either through a change in capacity or by displacing a magnetic field. These well-known devices will not be described.

Characteristics of the keyboards shown in FIG. 42.

In the keyboard shown in FIG. 41 the characters have been assigned to the different keys for the French language. Keyboards for other languages can be composed by applying the same principles and using the same means. Thus, for example the keyboard shown FIG. 42 is made up for the English language, but its material construction is identical to that of the French keyboard shown in FIG. 41. The description that follows refers to the drawing of FIG. 42.

The letters on the keys correspond to small letters situated in the first case on the type bars and to the same letters in capital situated in the second case. The character or characters at the rear of some keys (digits or signs) are in 3rd case on the type bars.

As for groups, that is to say, the printing point of each letter, the keys which, in the first and second case positions bear only one consonant which is not followed by a Roman numeral (Z, P, C, N . . . ) belong to group I. When a key controls a single letter belonging to a group other than group I, the group is indicated in Roman numerals ($U_{II}$, $I_{II}$, $E_{II}$, $U_{III}$, $N_{III}$, $R_{IV}$, $S_V$ for example).

The keys that bear a consonant followed by a vowel and which are situated in the rectangle K, PA, WA, WH correspond to a rectangular matrix similar to the one included in the keyboard shown in FIG. 1 and already described. On each of these keys, the first letter belongs to group I and the second to group II.

This is also the case for the keys FE and FA.

On the keys of column 14 and 15 which carry two letters the group to which belongs the second letter is indicated by a Roman number. The electrical circuits are established in such a way that these keys automatically cause a simple spacing at the same time as the letters are printed. On the following keys of columns 13 to 15 : HEIR, MAN, TION, FOR, THAT, WAS, YOU, THER, the first letter belongs to group I. On the key OUR, where the first letter is a vowel, this belongs to group II. On all these keys the letters following the first one belong to the groups that are numerically next. Thus, for example the key TION simultaneously controls letters of groups I, II, III, IV. These keys automatically cause a single space in addition to the printing of the letters.

The working of each of the six keys for obtaining different shift positions (case positions) is the same in FIG. 41 and 42. They are the keys Tout 2*e* (All 2nd), Bloc of Tout 2*e* (Bolt All 2nd), 2*e*I (2ndI), 2*e*II (2nd II), Tout 3*e* (All 3rd), Bloc of Tout 3*e* (Bolt All 3rd).

Certain keys with auxiliary functions are included in the keyboard.

| | |
|---|---|
| → | = return of the carriage |
| → | = backspace |
| ← V | = spacing of group V (producing a space of five intervals) |
| Neut. Spa. | = neutralization of automatic spacing. |

Certain keys for well-known functions could be placed on the edges of the keyboard. For example : Tabulation, Placing stops, Removal of stops. These have not been shown.

On this keyboard, several keys that each control a vowel of group III are located in two central columns (7th and 9th) though the corresponding type bars are situated more to the right. This removes the necessity of striking these keys through the displacement of the less adroit fingers of the right hand. Each of these keys (with the exception of $O_{III}$ of less frequent use) is besides duplicated and is found in each of the two columns 7 and 9. This increases the percentage of the groups of strikes by only one hand.

In comparison with keyboards with mechanical connections, such as that shown in FIG. 1, the number of thumb keys has also been increased. The horizontally extended keys as well as the two large keys "SP." are thumb keys. The keys "All 2nd" and "All 3rd" are palm keys and therefore are higher than the adjacent keys in the same row (FIG. 43). All the keys of the consonants of group III: $T_{III}$,$D_{III}$,$N_{III}$,$S_{III}$,$R_{III}$ and the keys of the consonants of group IV: $T_{IV}$,$R_{IV}$,$S_{IV}$,$N_{IV}$, are each adjacent to one of the two spacing keys SP. and at the same level as the latter. This allows each of them to be struck at the same time as this spacing key, by using one of the two thumbs held horizontally. The other fingers could thus at the same time strike keys that correspond to letters of group I and II. This further increases the number of cases where the total of the number of simultaneous strikes is effected by just one hand only.

The most often used of these keys: $N_{III}$,$S_{III}$,$R_{III}$ are situated between the two spacing keys and this allows each to be struck by either one of the two thumbs at the same time as a spacing key.

The use of electrical connection also allows an increase in the number of letters whose printing is controlled by the same key. Thus the keyboard FIG. 42 comprises keys corresponding to the combinations: "heir", "tion", "was", "you", "for", "our", "ther", "that", "man"; and these combinations are each automatically followed by a space. The key $S_V$ also causes a space automatically. One can thus make up electric circuits such as to control simultaneously by one key up to one character in each of the character groups; thus up to five characters plus a simple space automatically when the machine is constructed with five groups. The most frequently occuring combinations of letters are retain in the language for which the keyboard is composed. The key "NEUT SPA" (neutralization of automatic spacing) prevents automatic spacing from occuring when depressed and held depressed before a key equipped with the device of automatic spacing is struck.

Automatic spacing

The escapement anchor 3057 (FIGS. 32 and 46) is actuated by an electromagnet 3833. This permits to situate the space keys in the most suitable places. It is equally easy to equip any character key so as it acts on the anchor. This is advantageous when the combination of letters controlled by the considered key is a whole word (you, that, the) or else occurs generally in the last set of letters struck for a word (nt, tion). Thus, for example, in the keyboard shown in FIG. 42 all these keys of great combination of letters in addition to printing the letters, produce a spacing automatically.

The escapement mechanism described places the spacing always the right of the character belonging to the group of the highest rank among those printed simultaneously, even if these characters are printed by operating several keys, and this whatever be the character keys depressed. The result is that, for example, if one strikes simultaneously the key "you" (Groups I, II, III) which automatically produces a spacing and the key "R" (group IV) which does not give a space, one gets your followed by a space, the spacing produced by the key you being placed after R of group IV. Statistics show, for each language, which character keys are profitably equipped with automatic spacing. The choice is made taking into account the fact that a key is available which allows the neutralization of the automatic spacing (this will be made clear later). For the automatic spacing to be useful the character or characters concerned should most frequently occur in the last group of simultaneous strikes for a word. Thus, for example, in the English keyboard (FIG. 42), this occurs for "THE" and "He", for each of the combinations assigned to the keys of columns 14 and 15, as well as for "WAS", "YOU", "THER" and $S_V$. To equip a key with automatic spacing, it is only necessary to add one wire and one diode.

Neutralization of automatic spacing

The keyboard (FIG. 42) comprises the key Neut. Spa (Neutralization of automatic spacing) column 4 line 10. When this key is depressed and is held depressed during the striking of one character key equipped with automatic spacing, or successively on several of these keys, this spacing is not effected. The electromechanic scheme (FIG. 47) shows in effect, that the key Neut.-Spa cuts off the circuit of the automatic spacing. It is useful to duplicate this key by a pedal having the same effect. The depression of this key or of this pedal cuts off the circuit of the coil 3833 (FIGS. 46 and 47) of the electromagnet which controls the escapement anchor 3057 (FIG. 46).

The existence of this neutralization key allows the use of each of the character keys equipped with automatic spacing where the corresponding characters are comprised in group of simultaneous printing which is not the last of the word.

The key or the pedal for neutralization can also be used to avoid a double space when one of the keys equipped with automatic spacing is used before a word starting with a letter of group II.

The simultaneous striking of several keys which each produce the same print wholly or in part or a spacing.

Given the way the electric and the electronic circuits are set up (sketch FIG. 47) there is no inconvenience involved in having one or more of the electromagnets put into circuit simultaneously by several keys depressed at the same time. The effect is the same, as if the electromagnet in question has been connected by a single key. One could, either by error or in order to get a certain group of characters without spacing, or with spacing simultaneously strike several keys, even if one or several parts of the actions engendered by the keys duplicate functions.

1st case: A character key equipped with automatic spacing and a simple spacing key are struck simultaneously For example the typist strikes the key "THAT" (FIG. 42) equipped with automatic spacing and inadvertendly also strikes a simple spacing key. Nonetheless only a single normal space is effected after the letters. The typing error was thus without effect.

2nd Case: Two keys each equipped with automatic spacing are struck simultaneously.

For example, by striking simultaneously on the English keyboard shown in FIG. 42, the key "HE" equipped with automatic spacing, and the key "AR" (groups III and IV) equipped with automatic spacing, it is possible to obtain in a single operation and while striking only two keys the word "HEAR". Only one space is effected of a normal single space and this occurs following the characters.

3rd case: Two keys are struck simultaneously, both being equipped with automatic spacing and both of which in addition actuate a character that is common to the two keys.

For example, to obtain by striking two keys the word "THEN", one simultaneously strikes the key "THE" (group I, II, III) and the key "EN" (groups III and IV) both of which are equipped with automatic spacing. The duplicating of the "E" (group III) and that concerning the spacing remain without effect.

Differences between the switch keyboard laid out for the English language and that laid out for the French language.

FIG. 42 shows a keyboard similar to that shown FIG. 41 but laid out for the English language. The main differences of this keyboard with reference to that laid out for French are the following:

FI (column 1) is cancelled and replaced by FE:

J (column 1) is exchanged with K (column 2);

Y (column 2) is displaced and replaced by HE;

In row 1, column 1 to 12 : the keys DU Té é Ré LU SU are replaced by GH TH THE $Y_I$ $Y_{-II}$ SH In column 13, rows 1 to 6 : V and its combinations have been replaced by W and its combinations and the letter V is substituted for W in column 1;

$M_{III}$ (thumb key) is cancelled and replaced by $D_{III}$;

The apostrophe (Col. 7) is put in case position 3 above V (col. 1);

In columns 13, 14 and 15 the combinations, corresponding to endings or whole words and equipped with automatic spacing are different. Since the corresponding keys each control the characters by a single wire with shunts, this last change does not modify the network of the printed circuit shown in FIG. 48. In this network the line $e_{II}$ becomes $H_{II}$.

Other uses of Electromagnetic means

The advantages obtained by using a keyboard of electric switches which control the engagements on the driving cylinder by means of electromagnets are so important that they may be used even for syllabic typewriter which are not controlled remotely or automatically.

FIG. 49 shows the whole of a machine thus equipped with a switch keyboard and with electric and electronic circuits allowing the keys of this keyboard to control electromagnets for the engagements on the driving cylinder. In this form of embodiment the escapement mechanism is also equipped with electromagnets which control the escapement wheel and the escapement anchor.

Control of the cogs of the escapement wheel by electromagnets

In the forms of embodiment that will now be described, the cogs of the wheel are displaced from their stop-position into their escapement position by electromagnetic means. In these variants all the parts by which the group escapement-paddles 271 to 275 (FIGS. 9 and 8) act on the cogs of the wheel are suppressed. The cases where the cogs are put into escapement position are the same as in the first embodiment where they are controlled by mechanical means.

The barrel 1020 (FIG. 25) of the wheel and the ring 441 are made of non-magnetic material, for example of bronze.

Control of the cogs of the wheel by means of electromagnets with mobile armature Each of the cogs located at places 1 to 5 (FIGS. 24 to 28) instead of being displaced by the rods 406 to 410 (FIGS. 8 and 9) can be pushed by one of the levers 946 to 950 (FIG. 44) which make-up the mobile armature of the electromagnets 941 to 945 whose cores are placed vertically and whose coils are oval in section in order to reduce the space occupied by the whole unit. It can be seen that each of these five electromagnets are similar to those (901 and 902 FIG. 49) used ordinarily to produce engagements of the cam on the driving cylinder.

In this solution the cogs can be held in escapement position by a magnetized ring, as will be explained in the solution that follows.

Direct control of the cogs of the wheel by a magnetic-field.

Each of the cogs of the wheel (FIGS. 24 to 28) which is stopped in one of the places 1 to 5 is displaced from its stop position into its escapement position, thus drawn upwards, directly by the magnetic field of one of the solenoids 951 to 955 (FIGS. 46 and 45). The cores of these five solenoids and their coils have an oval exterior form as in the preceding embodiment. The core 956 of each solenoid must extended above the cog on which it is to act. At its other end 957 it is extended up close to the outer edge of the cog, but higher than the lower end of the cog.

The displacement of each cog upwards is limited by the crown 958 fixed to the body of the wheel. The cog is thus stopped a short distance from the core 956 (FIG. 45) which attracts it. This crown is a permanent magnet. It thus holds in escapement position the cogs that have been put into this position and this until such time as the helicoidal cam 1120 (FIG. 24) pushes them again into stop position. Thus one can suppress the spring 442 (FIGS. 24 and 25) or 415 (FIG. 26. In stop position each cog is held by its weight. If the machine is built with the axis of the wheel put horizontally, one adds a permanent magnet 940 (FIG. 44). This magnet is fixed on the support 3055 of the wheel. Its surface extends at least beneath the cogs from place 1 to 8 (FIG. 27).

This arrangement has the advantage of having no moving parts to act on each cog. In addition it avoids the need of a return spring sufficiently strong to retract each mobile armature fast enough in order to prevent that they stop the wheel.

Mixed solution

In the solution shown in FIG. 49 solenoids have been used without mobile armature to put in escapement position the cogs stopped in places 2 to 5 corresponding to character groups II to V and an electromagnet with mobile armature has been used to displace the cog stopped in place 1 corresponding to the group I. This is justified by the fact that in order to displace the cog of place 1 a greater amount of force is required because this cog is against the stop arm of the anchor.

The machine as a whole when electromagnetic controls are used.

A form of embodiment of the whole machine (FIG. 49) will now be described which combines certain of these mechanical variants with electromagnetic variants.

Figure 5:
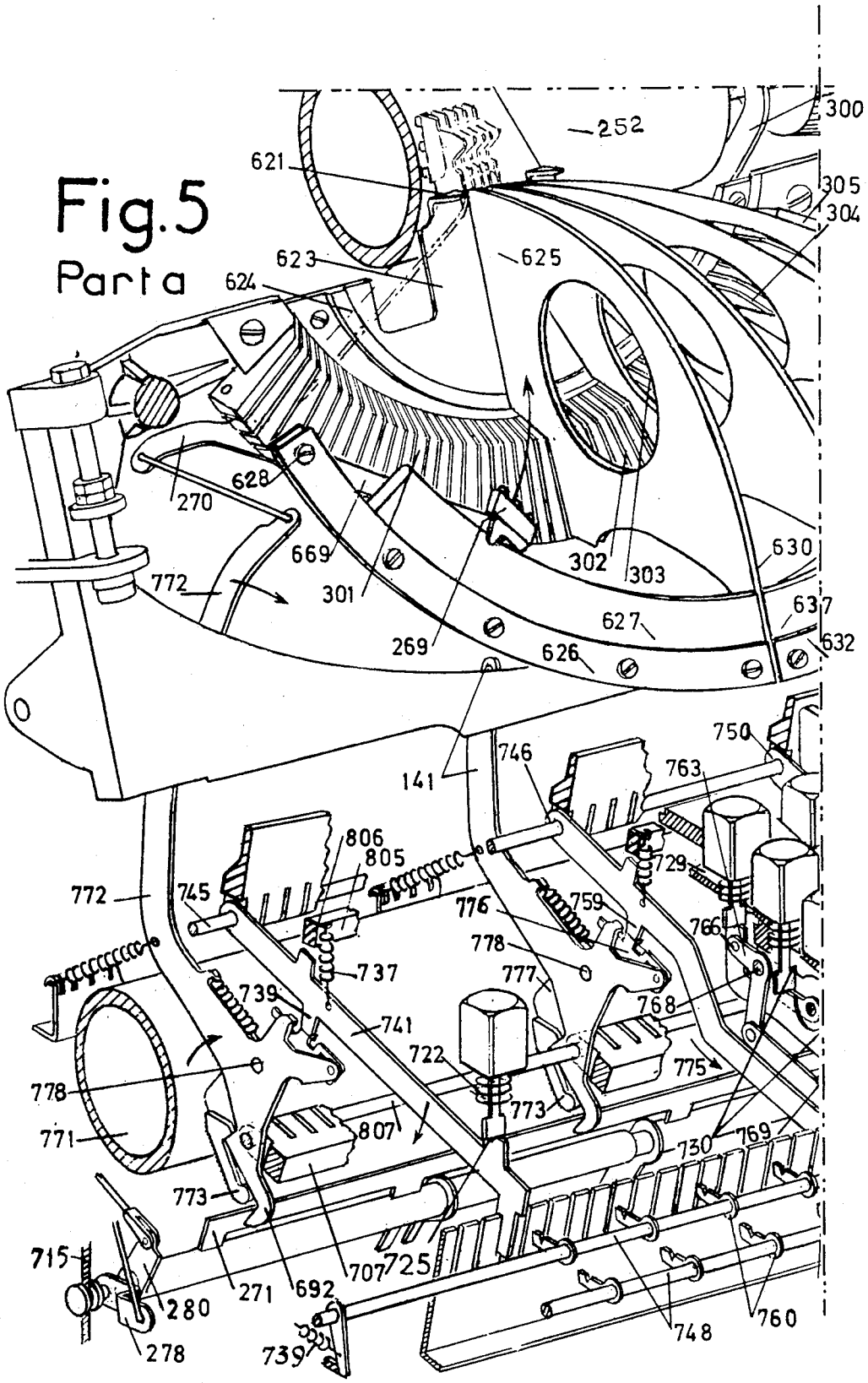
FIG. 5. comprising parts designated 5*a*, 5*b*, 5*c*. Printing mechanism. Partial view, in perspective.
Figure 5:
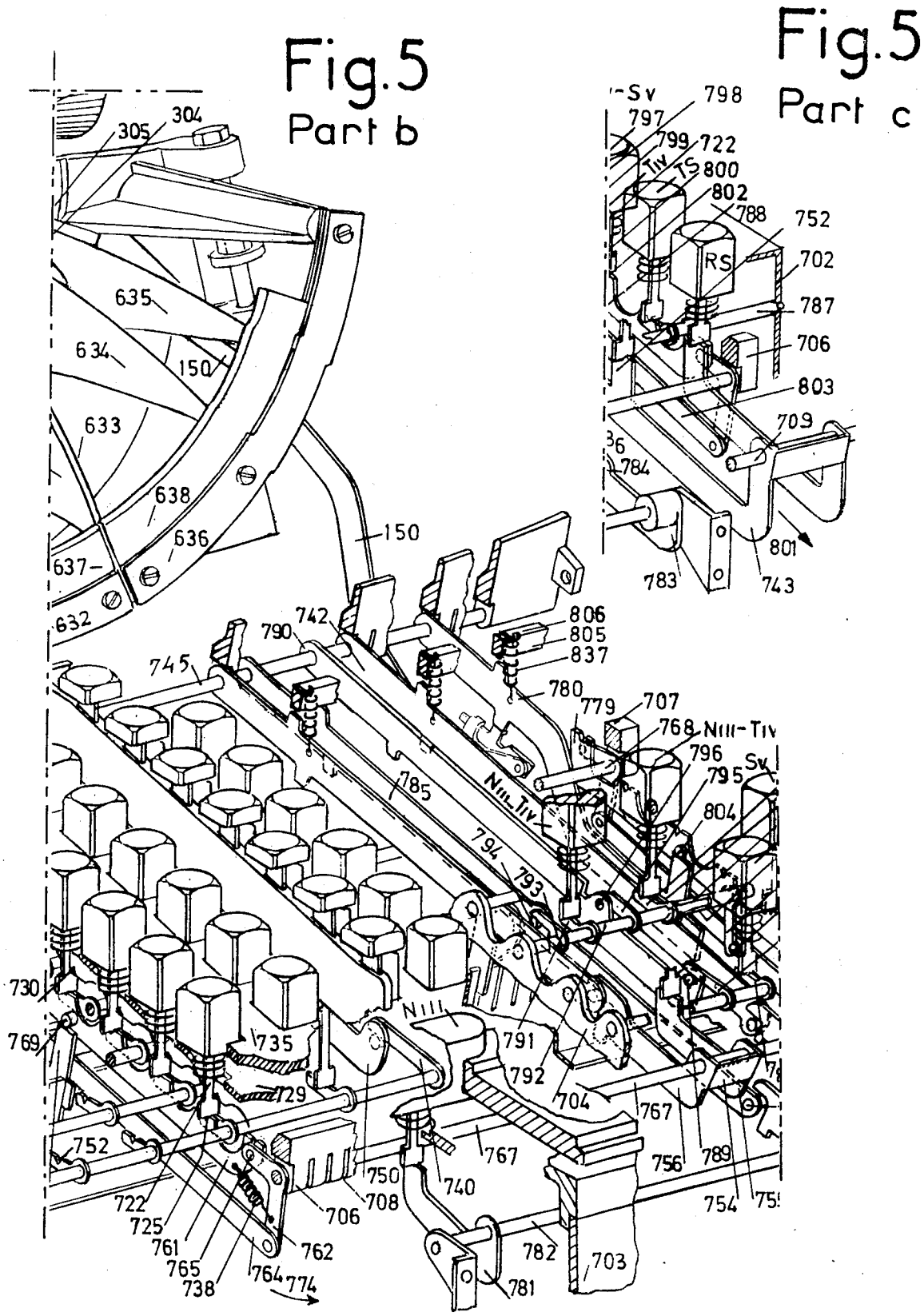
Figures 6A, 6B:
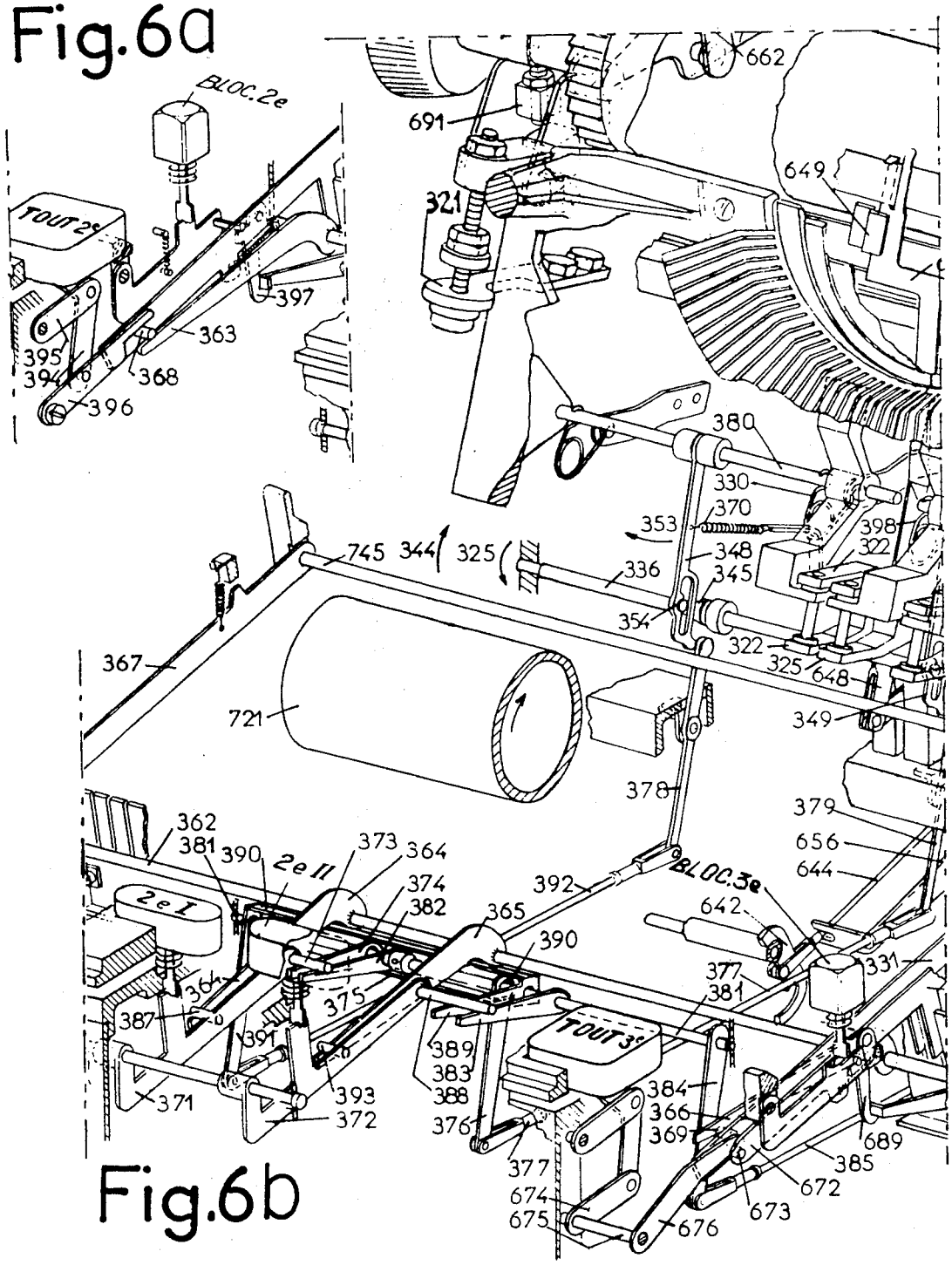
FIG. 6. comprising parts designated 6*a*, 6*b*, 6*c*. Shift mecnahism and mechanism for raising the ribbon. Perspective.
Figure 6C:
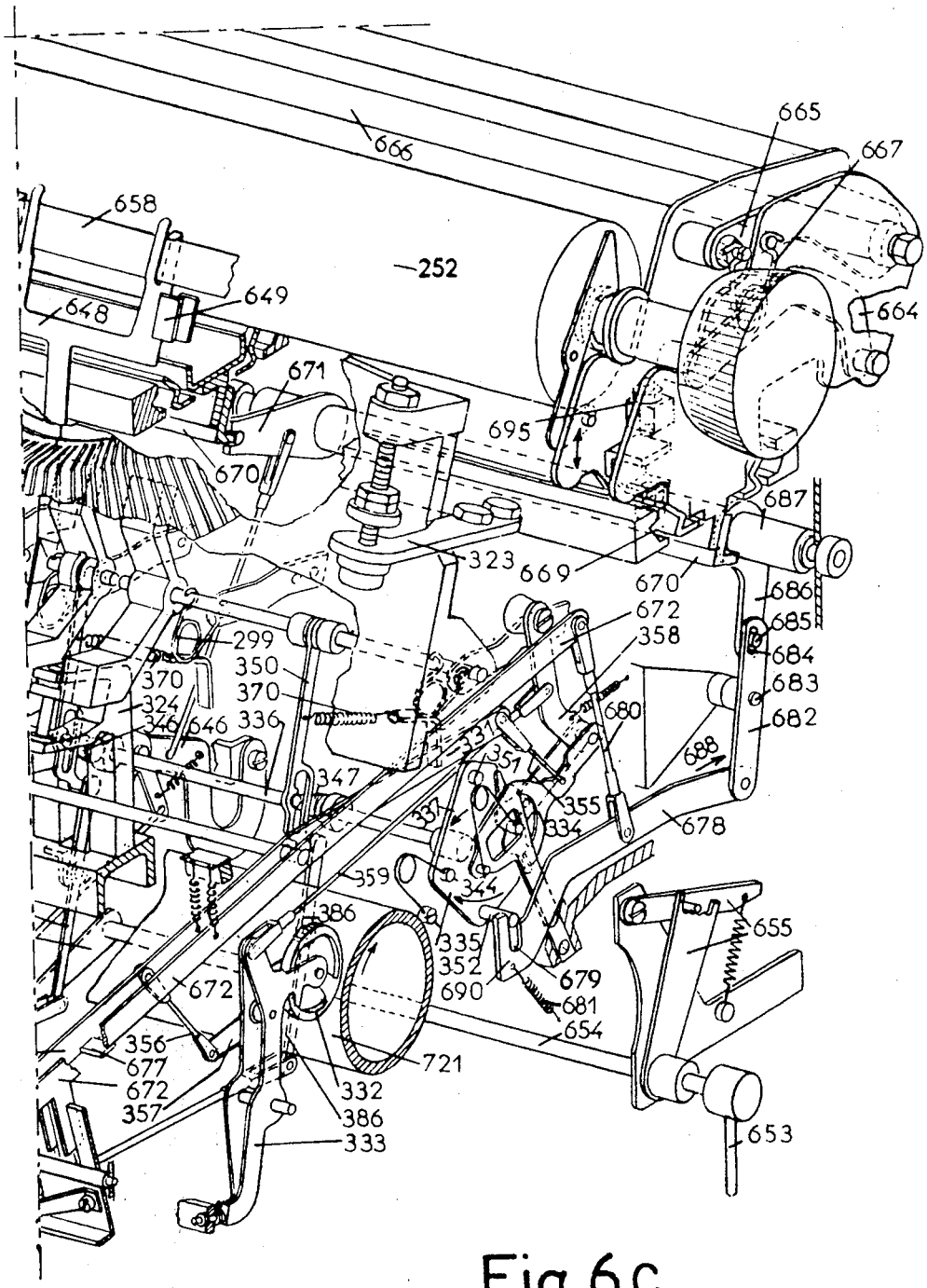

The following parts are replaced by electric connections:

- all the counter-motion device of the movement such as 748, 752, 740 FIG. 5;
- the longitudinal levers such as 741, 780 (FIG. 5) the parallelograms such as 761-766 (FIGS. 5 and 2);
- the sliding device that prevents repetition 776 (FIG. 8);
- all the parts which transmit the movements of these escapement-paddles (FIG. 9) to the cogs of the wheel.
- all the parts 716 and 826 to 832 (FIG. 9) by which the movements of the driving cylinder is transmitted to the anchor. The escapement group-paddles 271 to 275 (FIGS. 9 and 10) are replaced by a single paddle 992 (FIG. 49).

A keyboard of the type shown in FIG. 41 is used. The keys each constitute the push button of a contact-switch 972 of well-known type (FIGS. 49 and 43) which when a key is struck closes two circuits and cuts these off again when the key is released and rises back. Each contact switch presents 4 pins 973 to 976 placed in the form of a square.

The keyboard comprises a plate 977 whose lower face constitutes the support of a printed electric network shown in FIG. 48. This plate is perforated with holes at regular intervals which correspond to the distance between the pins of the contact switches. The contact switches are placed on the upper surface of the plate 977 with the equipment shown in FIGS. 41, 43 and 49. The four pins of each contact-switch pass through the plate by four neighbouring holes. The holes of the plate that are shown in scheme 48 are the ones actually used to allow passage of the pins. If keys with a normal surface 970 (FIG. 49) are used, the contact-switches are placed vertically on the steps in order to get a difference in levels between succesive rows. For this skew shims 978 are placed on the plate 977 which is inclined. These shims could be cast with the plate. As shown in FIG. 50 keys 971 of well-known type, with oblique surface may be used. This provides differences of level between the successive rows of keys by just placing the contact switches directly on the inclined plate 977 which in that case does not have a stepped surface.

A direct or rectified alternating current is used, for example at 48 volts or 24 volts. The two pins 973 and 974 (FIG. 43) in the fore part of each contact-switch constitute the entry point of each circuit. The length of these pins is limited to that which is necessary to solder them to the supply line of the printed network. The two pins, 975 and 976 (FIG. 50) at the rear of each contact-switch are longer to enable several of them to be connected with to the same wire 698 (FIG. 49) or for some of them to be each linked to a wire equipped with a movable socket 979.

The details of the printed circuit is shown in FIG. 48. This will be explained below.

The plate 977 (FIG. 49 or 50) is articulated in a shaft 961 and all the electric wires which link the keyboard to the machine pass close to this shaft. When the front guard 982 is removed, it is possible to lift and turn over the keyboard to have access to the switch circuits and to the arrangements located below the keyboard.

The device 983 which regulates the printing force, is identical to that used in certain electric alphabetic typewriters. The electromagnets such as 901 and 902, their mobile armature 904 and the rods 906 by which they engage the cams 773 on the driving cylinder 771 are identical to those used in usual electric typewriters to achieve automatic control.

In the printed network shown in FIG. 48, the single ramified line 524 starts from the source of electricity. From this line shunt lines issue which supply each of the two entry pins of all the contact-switches of the keyboard which correspond to each row of keys. The connections that link the two exit pins of each contact-switch to the electromagnet that the corresponding keys have to put into circuit will be described later. Some of these exit connections are made up in part by a line from the printed circuit (FIG. 48) and others are entirely wired (FIG. 49). All of them end finally at a connecting rod 986. This connecting rod allows easy dismounting and changing of assignements for certain keys or for certain type bars. The machine optionally comprises a commutator 987 of known type. Some of these electric connections between the contact switches of the keyboard and the connecting bar go through this commutator. The commutator allows the typist, by pivoting it, to change the characters assigned to certain keys. One can thus obtain a bilingual machine. This possibility will be fully explained later. The commutator allows instantaneous adaptation of the machine to a particular type of work in which certain terms occur frequently.

At the exit of the connecting bar 986, the wires are grouped in different strands, which travel alongside the fore part of the machine, some to the left and others to the right and then reenter the machine and distribute the wire-ends in the connecting bars 988 and 989. The entry wires of the upper electromagnets such as 901 are connected to the exits of the upper connecting bar 988 and the entry wires of the lower electromagnets such as 902 are connected to the exits of the lower connecting bar 989.

The exit wires of these electromagnets are connected in a detachable manner to a common exit condutor 990 or 991 located as well in each of the connecting bars 988 and 989. The electric circuits by which the keys engage the cams on the driving cylinder are thus defined in physical form. It will be seen that for certain character groups a shunt 960 is connected to certain of these circuits in order to control the escapement directly by the corresponding character keys. The movement of the intermediate levers 147 or those of the character bars 267 will not be reiterated here. The lower end 692 of each intermediate lever causes a same common paddle 992 to pivot around its shaft 277. This paddle controls the rise and advance movements of the ribbon. All the parts of these devices are identical with those of usual alphabetic type-writers.

The paddle 992, while pivoting meets in the end of its movement the lever of a switch 994 and pushes it. This cuts off the supply circuit for the keys so that the electromagnets for engagement such as 901 and 902 and those such as 941 for the escapement do not remain too long in circuit, and in order to avoid accidental repeats before the keys rise back. This technique is well-known.

The mechanism for obtaining a case change (shift mechanism) is that already described in the copending Application Ser. No. 502,190. It is shown in FIGS. 34–38. It allows the sectors to be placed in three different positions. It electrical connections are also shown by the scheme FIG. 39.

The carriage is identical or similar to that of an ordinary alphabetic typewriter. Its cylinder (platen) is not vertically mobile unless the machine has four characters on each type bar.

The escapement mechanism comprises the wheel with movable cogs already described, combined with an escapement anchor that produces the spacing. In the example, an anchor of the type 3057 described and shown in FIGS. 32 and 33 is used. The displacements of the cogs of the wheel and of the anchor are obtained by electromagnetic means already described and which will be detailed later.

Electric connections between, on the one hand the keys and on the other hand the electromagnets which control the printings The electric network that enables the keys to control the printings and the escapements is made up of elements already well known. The network could be entirely cabled, but, in the example, it is partly printed. In order to obtain that the descent of a given key produces the simultaneous printing of several characters (as many as five characters and possibly the space which must follow them) it is necessary that this descent put into circuit several electromagnets. To obtain this one can either cause the key to close simultaneously several contacts, or divide the impulse created by a single contact towards different electromagnets, this by means of shunts each equipped with a diode. In the described example these two means are combined.

In the electromechanic scheme in FIG. 47, the letters and combinations of letters, given as examples to indicate the different circuits, assume that the keyboard (FIG. 41) layed out the French language is used. This scheme shows the circuits only for a few keys each controlling one or several characters, some with automatic spacing, the others without automatic spacing. This scheme also shows the two space keys. Each key is marked by the inscriptions which it bears on the keyboard. In the scheme each of the electromagnets which engage, on the driving cylinder, the cam which controls the printing of a given letter is marked with this letter ($X_I$ to $S_V$) followed by the group number (I to V). The electromagnet which controls the escapement anchor is marked "SP" (spacing).

The electromagnets only marked with a group number (I to V) are those which each control on the escapement wheel, the retirement of the cog which, at the considered moment, corresponds to the indicated group (cog situated in one of the places 1 to 5). This question will be examined later. Here is described only the putting on in circuit of the electromagnets for the engagements on the driven cylinder by the character keys.

When a key controls only the printing of a single character without spacing (e.g.$X_I$,$T_I$,$I_{II}$,$O_{III}$,$N_{IV}$) the two exit contacts are linked. When a key controls the printing of two characters without spacing (e.g.$T_I$,$I_{II}$) each of the two contacts controls one of the two characters and no diode is necessary. When a key controls a single character with the automatic spacing ($S_V$ space), one of the two contacts is used for the printing of the character and the other for the automatic spacing. When a key controls several characters and the automatic spacing (e.g. ON space, TIONS space), one of the two contacts is reserved for the automatic spacing and the other is used to control the printing of all the characters, by means of shunts each equipped with a diode.

The keyboard shown in FIG. 41 comprises a key TION space but comprises no key TIONS space. In the scheme of FIG. 47 it is nevertheless supposed that such a key exists, this in order to show that one can, optionally, control up to five characters plus one spacing simultaneously by a single key.

It is obvious that the network as a whole may be transistorized. The necessary modifications for this are well-known.

The diverse electric circuits will be detailed later with indications concerning their localizations.

The parts of the electric circuits that are printed are shown in straight lines by scheme of FIG. 48 which is drawn as if the contact switches have been removed and that the support plate 977 is transparent. The network is so shown from above, which facilitates its comparison with the keyboard shown in FIG. 41. It is on this FIG. 41 that one will read the assignment to the key which corresponds to the contact switch whose the four pins are placed in each grouping of four of the holes shown by the scheme 48. This scheme shows only the holes effectively used, i.e. in which one of the pins of a contact switch of the keyboard is placed. The dotted lines represent parts of the circuit that are not printed, i.e.: wires such as 698 (FIG. 49) that are situated lower than the support-plate 977 and are each connected to a pin of certain contact switches.

When the free surface (FIG. 48) enables it, a printed line links all the exit pins of the contact switches that control only the same character.

It is known that a few contact switches each control an electromagnet other than those which cause, each one, the printing of a character. Some control the electromagnet corresponding to the escapement anchor. Others control an electromagnet of the shift mechanism. Finally, certain control an electromagnet that corresponds to an auxiliary function (return of the carriage, back space...).

In the embodiment shown in FIG. 49 which corresponds to the keyboard shown in FIG. 41, the electric lines which feed the contact switches of the keyboard and which enable them to transmit the pulses to the different electromagnets, may be classified in the following categories:

1st category

Network of the entrance electric lines which feed two pins of each contact-switch. It is the network (FIG. 48) for the transversal lines which start from the line 524; these are connected to the electric source. This feeding network comprises one electric line for each row of keys of the keyboard. These lines constitute a regular network of parallel lines, from row 1 to row 10.

2nd category

Exit lines each corresponding to one of the letters of group II. They are parallel to the preceding ones. These are the lines $A_{II}$,$O_{II}$,$E_{II}$,$I_{II}$,$U_{II}$,$\acute{e}_{II}$. Each links, on the one hand, an exit pin of each keyboard switch comprised in the rectangular matrix I-II and which bears the letter corresponding, on the other hand, to the electromagnet for engagement on the driving cylinder, such as 901 or 902 (FIG. 49) which corresponds to this letter.

3rd category

Exit lines each corresponding to a vowel of group III. They are parallel to those of the first two categories. They are the lines $I_{III}$,$U_{III}$,$A_{III}$,$E_{III}$,$O_{III}$. Each constitutes the exit line, either of the corresponding contact-switch ($O_{III}$), or of the two corresponding contact switches situated one in column 7 and the other in column 9. The two exit pins of each contact switch are linked.

4th category

Exit lines of one of the two pins of each of the contact switches which are equipped with automatic spacing. These lines also are parallel to those of the preceding categories. All are linked to the line Sp.auto, which controls the escapement anchor and which is found again in the scheme FIG. 47.

The line Sp.auto (scheme FIGS. 48 and 47) is distinct from the exit line of the two space keys "Sp" because the line Sp.auto must be able to be cut off by the key for neutralization of the automatic spacing "Neut.Sp." as well as by the pedal which, optionally, duplicates this key and does so without cutting the exit line of the space keys Sp.

The electric lines of categories 1 to 4, all being parallel, are parts of the printed network (FIG. 48) on the lower face of the support plate 977 (FIG. 49 or 50).

5th category

Exit line corresponding to the two space keys Sp. (scheme FIGS. 48 and 47). It has been said that this line is distinct from the line Sp.auto. It is nevertheless rejoined by this one after the above mentioned cut-off.

6th category

Lines, each corresponding to one or two pins of a contact switch whose key has one of the following assignments:

one letter of group I, not frequent and not combined with keys of group II in the matrix. These are: J,H,G,B,F, punctuation, Q,Y,Z,W,K,X FIG. 41;

one of the consonants of group III (N,S,R,T,M);

one of the consonants of group IV (N,S,R,T);

one of the auxiliary operations (back space, carriage return, shift keys . . . ).

For some of the lines of this 6th category, corresponding to a contact switch which is not on the edge of the keyboard, a part of the line parallel to that of the preceding categories is printed when the space required is available; for example, $Z_I$ and $K_I$. Each one of the other lines of this category is made up completely of a wire connected to one of the exit pins of the contact switch. The two pins are linked, except for the contact switch $Z_I$ of which one pin is connected to the line which gives the automatic spacing Sp.auto.

7th category

Frequent consonants of group I which, in the matrix, are each combined, with one of the letters of group II situated on different rows of keys. These are P,M,C,N,D,T,R,L,S.V. As the electric lines which correspond have to be perpendicular to the preceding ones, each is constituted by a wire which is connected directly to one of the two exit pins of each of the corresponding contact switches. In the scheme of FIG. 48, these lines, perpendicular to the preceding ones, are shown in dotted lines. In FIG. 49, by the example of wire 698 of the column "R", it is shown that the corresponding pins are longer than the others, and that, due to this, these wires form a second netword situated below the printed circuit network. This network could instead be made up of printed lines on the upper face of the support 977 (FIG. 49) on a distinct layer on the lower face of this support (FIG. 49 and FIG. 50) or on a distinct support, but modification and replacement of a contact switch would then be more difficult.

Each of the printed lines of the categories 1 to 7 is extended by a wire connected, by means of a socket such as 979 (FIG. 49) to one of the pins of the corresponding contact switches. It is preferable to select a pin situated close to the edge of the keyboard.

When a contact switch is the only one which controls a character or a given electromagnet and if no line corresponding to it has been printed, the wire is connected, in the same manner directly to one of the two exit pins of this contact switch and the two exit pins are linked.

8th Category

Electric lines going from a contact switch which controls one of the combinations of characters situated in the columns of keys, 14 and 15 (FIG. 41) or one of the three combinations of the column 13: Nous, Vous, Je FIG. 48 shows that one of the two exit pins of each of the corresponding contact switches, is situated on one of the printed lines which rejoin the line controlling the automatic spacing (Sp.auto).

On the other exit pin, is connected a socket attached to a wire controlling all the letters of the combination corresponding to the key. This wire splits in shunts each one equipped with a diode (not shown) and corresponding to one letter in this combination. Each electric line corresponding to one or several letters finally leads to the corresponding electromagnet for engagement on the driving cylinder, such as 901 or 902 (FIG. 49). The wiring (scheme FIG. 47) indicates these connections by an example for each case.

The different wires corresponding to the same category join into a strand that goes along the edge of the keyboard on the right or on the left and then distributes the opposite ends on the connecting bar 986 (FIG. 49) or in the commutator 987 if the machine includes this component. In this latter case, the commutator exits are connected, through other wires, to the entries corresponding to them in the connecting bar 986. The continuation of these circuits has been formerly defined. For the combinations of letters, situated in the columns of keys 14 and 15 (FIG. 41), as for the combinations NOUS, VOUS, JE in the column 13, on each of the left hand pins of each contact switch (FIG. 48), the number of characters has been conventionally indicated by as many diverging short strokes (e.g.: two strokes for the pins corresponding to ES, EN,ER . . . column 14, four strokes for NOUS, VOUS column 13).

In each group I to IV, the characters of the group are distributed among the type bars so as to have the characters frequently used born by type bars near the center, which, therefore, work better mechanically and, conversely, to place the characters not much used on the type bars far from the center. Characters which are frequently used consecutively are not placed on type bars next to one another, this to reduce the risk of collision. These means are well-known but cannot be used to a maximum in syllabic machines when the connections are mechanical. In the present embodiment it is sufficient to establish consequently the electrical connections between the connecting bars 986 and 990 or 991 (FIG. 49).

The use of connecting bars facilitates the changing in the assignement to of certain keys to adapt the machine to a particular class of work or to a different language.

Electromagnetic control of the cogs of the escapement wheels and of the anchor

The displacement of each cog of the escapement wheel from its stop position to its escapement position is controlled by one of the electromagnetic means shown in FIGS. 44 or 46 and 45. It has been seen that this concerns cogs situated in the places 1 to 5 (FIGS. 24 and 27) corresponding to the character groups I to V.

In FIG. 49, the electromagnet 941 whose mobile core controls the cog which is stopped in place 1, is shown. The solution adopted here for the group I is the one shown from below in FIG. 44 and which has already been explained. The cogs which are in places 2 to 5 could be controlled in an identical manner but, in FIG. 49 the solution shown to control the cog situated in the place 5 is the one in which the tooth is controlled directly by the magnetic field and which is shown from above in FIG. 46 and from the front in FIG. 45. This solution has already been described.

The cogs stopped in the places 1 to 4 can be controlled by the same means but the cog stopped in place 1 requires a greater force than the cogs stopped in places 2 to 5. This is because it cannot move without rubbing against the anchor. It is this which can justify the use for this cog of an electromagnet with a moveable armature (or with a plunging core), taking into account that the amount of available space is greater before this place.

Putting into circuit of the electromagnets which place into the escapement position the cogs of the wheel In order to put into circuit the electromagnets which control the cogs of the escapement wheel situated in places 1 to 5, one of the following solutions can be selected.

1st solution applicable to group I.

It consists in causing the single paddle 992, which controls the movements of the ribbon to act on the lever of a micro switch disposed like the micro-switch 994 (FIG. 49). The only disadvantage in this solution is that if, accidentally, a character is printed in one of the groups II to V before the printing in group I, the escapement is produced too soon for the printing in group I. This disadvantage is negligible when the simultaneity of the strikings is good.

Solution adopted for group I

In the embodiment shown in FIG. 49, the lever 996 (FIG. 35) of a micro switch 995, whose case is filed to the frame 607 of the basket of group I, is arranged in the path of movement of the upper part of the type bars of group I, in the region toward these paths of movement converge. The type bars push the lever 996, slightly before the printing. The micro switch puts into circuit, the electromagnet 941 (FIG. 49) which controls the cog stopped in place 1. As it has already been explained, occasionally, a character of group II is printed without any character of group I being printed. In this case the cog in place 1 must still be displaced. To obtain this a micro switch 997 (FIGS. 49 and 35) is disposed behind the sector 302 of group II. It is fixed on the frame 614 of the basket of group II. Its lever 998 is cranked and passes through an opening 999 in the sector. Its extremity is triangular and is arranged in the path of movement of the upper part of all the type bars of group II, in the region toward which these paths of movement converge.

The micro switch 997 is connected through to the electromagnet 941 which controls the cog in place 1 as shown in FIG. 47. The condition recalled above is thus realized.

Solution adopted for group II.

If a diode is fitted to the electrical connection between the micro switch 997 and the electromagnet 941 (FIG. 49) one can also connect the micro switch 997 to the electromagnet which controls the cog in the place 2. In this case the escapement for group II is realized using the same solution as for group I.

Solution adopted for groups III to V

The electromagnets which control the cogs stopped in places 3 to 5, corresponding to groups III to V, are each put into circuit by depression of the keys of the corresponding characters respectively, at the same time as the electromagnet, such as 901 or 902 (FIG. 49), which controls the engagement on the driving cylinder. To obtain this, a shunt 960 (FIG. 49 and scheme FIG. 47) is established in the line which controls each electromagnet, such as 901 or 902, of the considered group. The opposite extremities of all the shunts corresponding to a given group converge into one line which is connected to the electromagnet which controls the corresponding cog of the wheel.

This solution avoids the use of an additional contact switch for the escapement corresponding to groups III to V but, in groups III to V, each of the shunts 960 must be equipped with a diode (FIG. 47). Therefore, for each group there are as many additional diodes as there are type bars. The single shunt for group V is not fitted with a diode.

With this solution, the cogs corresponding to groups III to V are placed in the escapement position as soon as the key is depressed, therefore long before the printing. This presents no disadvantage. The wheel will only begin to turn when the cog in place 1 has been displaced by the action of a type bar of group I or II, or when the anchor has been displaced, (to obtain a satisfactory synchronisation, the inertia of the device must be such that the motion of the anchor be slightly delayed). The increases of the escapement length corresponding to printing in groups III to V, are thus memorised in the form of the corresponding displacement of the cogs. They will only be effected when the escapement corresponding to group I is produced.

This solution would not have been applicable to group I as the escapement would have been produced too soon. The same impossibility exists for the group II because of the electric line (FIG. 47) between the micro switch 997 and the electromagnet 941. Now this electric line is necessary to actuate the cog of place 1 when nothing is printed in group I.

With the solution adopted, when the group of strikes includes characters of groups III to V, it is possible, with no disadvantage to print these characters before printing those of groups I and II. This could be done voluntarily but may occur accidentally through lack of simultaneity in the descent of different fingers.

Group spacing keys

The keyboard can include a group space key for each of the groups. The theory of the corresponding devices is well-known. The spacing key for each group must produce an escapement of a number of single intervals corresponding to the rank of its group. Thus, a space key for group II must produce an escapement of two intervals, a key for group V must produce an escapement of five intervals.

In the embodiment where the cogs of the wheel are placed in the escapement position by mechanical connections a unilateral link between each group escapement-paddle of a given group and that of the group of the rank in a row immediately below is necessary to obtain this result. This link have disadvantages.

In the variations where the placing in escapement position of each cog is controlled by an electromagnet these unilateral links are avoided.

As an example, the keyboard of contact switches shown in FIG. 41 includes a space key for group V "Esp.V". The depression of this key controls the placing in escapement position of the cogs situated in places 1 to five, thus producing an escapement of 5 intervals.

To obtain this result, the two exit pins of the contact switch corresponding to this key are connected, by wires fitted with a diode, to each of the electromagnets which control the cogs in the places 1 to 5. The scheme of FIG. 47 shows these connections.

The key Esp.V could be equipped with automatic spacing. For this, it would suffice to connect the second pin of its contact switch to the line Esp.auto, with a diode. This key would then control an escapement of six intervals. It was preferred not to do this. It therefore only controls an escapement of five intervals but, an escapement of six intervals is obtained by depressing one of the spacing keys at the same time.

Integration of spacing by means of "transposition"

The escapement anchor 1057 (FIG. 27) associated with the escapement wheel, has a first function, which is to control an escapement of one single interval when a space key is struck alone, and a second function which is to increase by one single interval, the total escapement when such a key is struck at the same time as one or several character keys.

If the anchor is suppressed and its stop 1018 is replaced by a fixed stop, the first result may be obtained by putting the cog which is in place 1 into its escapement position, through each spacing key and one can obtain the second result by making each spacing key realise, in addition, what will be called a "transposition".

This transposition consists of displacing the assembly of elements through which the character keys control the placing of the cogs in escapement position, in such a way that the characters of group I control the cog in place 2, that those in group II control the cog in place 3, and so on, the characters of group V controlling the cog situated in place 6. The cog in place 1 is always controlled by each spacing key as well as by each character key to which an automatic spacing is moreover assigned.

The transposition, completed by the action of the spacing keys and by the character keys to which an automatic spacing is assigned, on the cog in place 1, has therefore the effect of displacing one more cog than would have been displaced by the striking of the characters only. It suffices then that this transposition is effected by depressing one of the spacing keys or one of the character keys to which an automatic spacing is assigned.

Example of realisation

When the cogs of the wheel are placed in the escapement position through electromagnets, as described in the embodiment shown in FIGS. 45 and 46, or in the embodiment of FIG. 44, the device which realises the single spacing or the integration of spacing by transposition, is very simple.

An electromagnet VI, 1000 (shceme FIG.51) is added to control the cog in place 6. It is identical to the electromagnets I to V (951 to 955 FIG. 46 or 946 to 950 FIG.44). The electromagnet 3833, which controlled the anchor, and the anchor are suppressed.

The device includes an electromagnetic relay 1008 of conventional type (scheme FIG.51) which comprises five change-over contacts comprising the contact blades, 1001 to 1005, each one of which ensuring a rest-contact and a work-contact. The line Sp (schemes FIG. 48 and 47) instead of being connected to the electromagnet 3833 which is suppressed, is connected to the relay 1008 (scheme FIG. 51).

At rest, the five blades of this relay ensure, respectively, the connection of the electromagnets I to V which control the cogs in places 1 to 5. The striking of any spacing key or key with automatic spacing therefore puts this relay in circuit. In this case, that is, in work position, the contact-blades then ensure,respectively and in order, the connection of the electromagnets II to VI. The striking of each character in group I then controls the cog in place 2, the striking of each character in group II controls the cog in place 3 and so on, the striking of a character in group V controlling the cog in place 6. The transposition described above is therefore realised. But, for the escapement to be produced, it is necessary, in addition, that the cog in place 1 be placed in the escapement position by the electromagnet I (951), even when the striking of a space has produced the transpositon. This result is obtained by the connection fitted with a diode which connects the line Sp. with the feed line of the electromagnet 951.

If a space is struck thus producing a transposition, and, at the same time, a character of group II is struck without striking a character in group I, the contact-blade 1001 feeds the electromagnet II (952). Now, to produce the escapement, the cog in place 1 must be placed in the escapement position by the electromagnet I (951). For this the conductor which ends at the electromagnet 952 (FIG.46) or 942(FIG.44) which controls the cog in place 2 is connected with a diode, to the conductor which ends at the electromagnet I(951 or 941) which controls the cog in place 1 (FIG. 47 and 51). This latter connection already exists and it has been explained that it was already required for the same case in the solutions where an escapement anchor is used.

What I claim and desire to secure by Letters Patent is:

1. A keyboard-controlled device comprising:

a syllabic-keyboard, certain keys of which can be depressed simultaneously and certain keys of which each control simultaneously several characters belonging to groups which each correspond to a distinct printing point, the keyboard further comprising spacing keys, and a printing mechanism which includes a carriage; the improvements comprising:

an escapement mechanism which controls the advance of said carriage, this mechanism comprising a rotatable cogged escapement wheel (FIGS. 24 to 28) provided with mobile cogs, each cog being displaceable between a stop position (FIG. 25) and an escapement position; the cogged-wheel being combined with an escapement anchor (1057 FIG. 27) which is pivotally mounted about an axle so that it can be pivoted between a stop position and an escapement position, this anchor comprising a stop arm and a return arm, the stop arm being situated in the path of movement of the cogs which are in the stop position and the return arm being outside this path of movement when the escapement anchor is in its stop position, but the stop arm being outside this path of movement and the return arm being in this path of movement when the anchor is in its escapement position, the return arm being then encountered by the first cog in the stop position, so that this first cog returns the anchor in its stop position, the stop arm being then encountered by the first of the cogs remaining in stop position, which locks the wheel; the result being that: if only the cog which is halted against the stop is moved to the escapement position, the escapement obtained corresponds to a given interval; if the cog which is against the stop and one or more of the next successive cogs are simultaneously placed into the escapement position, the escapement corresponds to as many of such intervals as there are cogs moved to the escapement position; if, in addition to moving these cogs into the escapement position and at the same time, the anchor is placed in its escapement position, the escapement obtained is increased by one such interval; if the anchor alone is placed in the escapement position, the escapement obtained corresponds to one single such interval; the escapement mechanism further comprising: means controlled by one of the elements set in motion when printing any character belonging to a first character group, for shifing into escapement position the cog which is against the stop arm, means controlled by one of the elements set in motion when printing any character of each next character groups, for shifting into escapement position each of the next cogs respectively; the result being that the cog which is against the stop is placed into the escapement position when any character of the first group is printed, each of the next successive cogs being placed into the escapement position when any character of the corresponding character group is printed; the escapement mechanism further comprising means controlled by the spacing keys and by certain character keys for shifting the anchor into escapement position.

2. A device as claimed in claim 1, in which the keyboard is made up of electric switches (FIGS. 42 and 50) and including an electromagnet (3833 FIGS. 32 and 47) arranged opposite the escapement anchor to push it in its escapement position, each of the space keys (FIG. 42) controlling a switch (FIG. 47) connected to said electromagnet and several switches each controlled by a character key being connected to a common conductor (SP.auto.FIGS. 48 and 47) through a diode, this common conductor being connected to said electromagnet, so that each of said character keys, when depressed, provides automatically a space in addition to the printing of the character or characters assigned to the considered character key.

3. A keyboard controlled device comprising:

a syllabic-keyboard, certain keys of which can be depressed simultaneously and certain keys of which each control simultaneously several characters belonging to groups which each correspond to a distinct printing point, the keyboard further comprising spacing keys, and a printing mechanism which includes a carriage; the improvements comprising:

an escapement mechanism which controls the advance of said carriage, this mechanism comprising a rotatable cogged escapement wheel (FIGS. 24 ro 28) provided with mobile cogs, each cog being displaceable between a stop position (FIG. 25) and an escapement position, and with a stop (1018) arranged in the path of movement of the cogs in stop position, the length of the escapement thus corresponding to the number of cogs placed in escapement position, and the mechanism comprising a fixed helicoidal cam (1120 FIG. 24) arranged on the path of movement of the cogs in the escapement position to return them into the stop position;

the printing mechanism comprising type-bar groups each corresponding to a given character group, and a driving element, intermediary levers by means of which the driving element controls the type-bars of the corresponding group, for certain groups, a group escapement paddle (271–275 FIG. 9) arranged on the path of movement of the intermediary levers of the corresponding group, each group escapement paddle being connected through a bell-crank lever to one end of a push-rod (406–409) the other end of which is arranged opposite a cog of the escapement wheel, the push-rod corresponding to the first group being arranged opposite a first cog stopped against the stop, and the push-rods corresponding to the next consecutive groups (II-V) being arranged opposite the corresponding cogs respectively, so that the printing of any character belonging to a given group places in its escapement position the cog stopped at the place corresponding to this group; the push-rod of the second group being extended before the cog which is against the stop and corresponds to the first group, so that this cog is moved to its escapement position, and that the escapement is obtained even if a character of the second group is printed without simultaneous printing of a character in the first group.

4. A keyboard-controlled device comprising:

a syllabic-keyboard, certain keys of which can be depressed simultaneously and certain keys of which each control simultaneously several characters belonging to groups which each correspond to a distinct printing point, the keyboard further comprising spacing keys, and a printing mechanism which includes a carriage; the improvements comprising:

an escapement mechanism which controls the advance of said carriage, this mechanism comprising a rotatable cogged escapement wheel (FIGS. 24 to 28) provided with mobile cogs, each cog being displaceable between a stop position (FIG. 25) and an escapement position, and with a stop (1018) arranged in the path of movement of the cogs which are in stop position, the length of the escapement thus corresponding to the number of cogs placed in escapement position, and the escapement mechanism comprising a fixed helicoidal cam (1120 FIG. 24) arranged in the path of movement of the cogs in the escapement position for returning them into the stop position;

said device comprising type-bars and intermediary levers, and at least for certain character groups, a group escapement paddle situated in the path of movement of the intermediary levers by means of which the driving element controls the type-bars of the group under consideration, a switch (994 FIG. 49) arranged in the path of movement of said group escapement paddle (992) and an electromagnet (941) to which the switch is connected, said electromagnet being arranged opposite the cog stopped at the place corresponding to the group under consideration, so that the electromagnet places the cog in its escapement position each time that a character of the group under consideration is typed.

5. A keyboard-controlled device comprising:

a syllabic-keyboard, certain keys of which can be depressed simultaneously and certain keys of which each control simultaneously several characters belonging to groups which each correspond to a distinct printing point, the keyboard further comprising spacing keys, and a printing mechanism which includes a carriage, and a driving element; the improvements comprising:

an escapement mechanism which controls the advance of said carriage, this mechanism comprising a rotatable cogged escapement wheel (FIGS. 24 to 28) provided with mobile cogs, each cog being displaceable between a stop position (FIG. 25) and an escapement position, and with a stop (1018) arranged in the path of movement of the cogs in stop position, the length of the escapement thus corresponding to the number of cogs placed in escapement position, and the mechanism comprising a fixed helicoidal cam (1120 FIG. 24) arranged in the path of movement of the cogs in the escapement position to return them to the stop position;

the escapement mechanism comprising type-bars and intermediary levers, and for certain character groups, a group escapement paddle situated in the path of movement of the intermediary levers by means of which the driving element controls the type-bars of the group under consideration, a switch arranged in the path of movement of said group escapement paddle (992 and 994 FIG. 49b) and an electromagnet (941 FIG. 49c) to which the switch is connected, arranged opposite the cog stopped at the place corresponding to the group under consideration, so that the electromagnet places the cog in its escapement position each time that a character of the group under consideration is typed;

the electromagnet (941 FIGS. 44, 47) for displacing the cog of the wheel corresponding to the second character group having its energization coil connected to that of the electromagnent corresponding to the first character group through a diode, so that when a character in the second group is printed, without simultaneous printing of a character in the first group, the cog corresponding to the first character group is moved to the escapement position, with that of the second character group, but not vice versa.

6. A keyboard-controlled device comprising:

a syllabic-keyboard, certain keys of which can be depressed simultaneously and certain keys of which each control simultaneously several characters belonging to groups which each correspond to a distinct print point, the keyboard further comprising spacing keys, and a printing mechanism which includes a carriage and a driving element; the improvements comprising:

an escapement mechanism which controls the advance of said carriage; this mechanism comprising a roatatble cogged escapement wheel(FIGS. 24 to 28) provided with mobile cogs, each being displaceable between a stop position (FIG. 25) and an escapement position, with a stop (1018) arranged in the path of movement of the cogs which are in stop position, the length of the escapement thus corresponding to the number of cogs placed in escapement position, and the escapement mechanism comprising a fixed helicoidal cam (1120 FIG. 24) arranged in the path of movement of the cogs which are in escapement position to return them into stop position;

the printing mechanism comprising type-bars and intermediary levers, and the escapement mechanism comprising, at least for certain character groups, a group escapement paddle situated in the path of movement of the intermediary levers by means of which the driving element controls the type-bars of the group under consideration, a switch arranged in the path of movement of this group escapement paddle (992 and 994 FIG. 49*b*) and an electromagnet (941 FIG. 49*c*) to which the switch is connected, arranged opposite the cog stopped at the place corresponding to the group under consideration, so that the electromagnet places the cog in its escapement position each time that a character of the group under consideration is typed; for certain groups the consideration is typed; for certain groups the electromagnet (FIG. 45) being arranged so that the cog whose displacement it controls is situated in its magnetic field, the cog being of a magnetic material so that it is placed in its escapement position directly by the magnetic field when the electromagnet is energized.

7. A keyboard-controlled device comprising:

a syllabic-keyboard, certain keys of which can be depressed simultaneously and certain keys of which each control simultaneously several characters belonging to groups which each correspond to a distinct printing point, the keyboard further comprising spacing keys, and a printing mechanism which includes a carriage and a driving element; the improvements comprising:

an escapement mechanism which controls the advance of said carriage, this mechanism comprising a rotatable cogged escapement wheel (FIGS. 24 to 28) provided with mobile cogs, each cog being displaceable between a stop position (FIG. 25) and an escapement position, and with a stop (1018) arranged in the path of movement of the cogs which are in stop position, the length of the escapement thus corresponding to the number of cogs placed in escapement position, and the escapement mechanism comprising a fixed helicoidal cam (1120 FIG. 24) arranged in the path of movement of the cogs in the escapement position for returning them into stop position;

the printing mechanism comprising type-bar groups each of which corresponds to a character group, and a driving element which drives the type-bars; the escapement wheel being provided at least with as many electromagnets as there are character groups, a first electromagnet corresponding to the first character group being arranged opposite the cog which is against the stop, for shifting this cog in escapement position, each of the other electromagnets corresponding to each of the other character groups respectively being arranged opposite one of the next consecutive cogs for shifting each of them in escapement position; the escapement device comprising switches each corresponding to one of the character groups and being connected to the electromagnet which corresponds to said group, each of said switches having a lever situated in the path of movement of parts set in motion for printing the characters of the corresponding group, so that each electromagnet places in escapement position the cot stopped at the place corresponding to the group under consideration each time that a character of this group is typed;

for certain groups of type-bars each corresponding to a given character group, the lever (996, 998 FIG. 35) of the switch (995, 997 FIGS. 35 and 47) which connects the corresponding electromagnet for displacing the cog of the escapement wheel stopped in the place which corresponds to the group under consideration being arranged in the path of movement of the upper parts of the type-bars of the considered group, in the region toward which these paths of movement converge, this lever being struck by each type-bar of this group, said groups having then no escapement paddle.

8. A keyboard-controlled device comprising:

a syllabic keyboard, certain keys of which can be depressed simultaneously and certain keys of which each control simultaneously several characters belonging to groups which each correspond to a distinct printing point, the keyboard further comprising spacing keys, and a printing mechanism which includes a carriage; the improvements comprising:

an escapement mechanism which controls the advance of said carriage, this mechanism comprising a rotatable cogged escapement wheel (FIGS. 24 to 28) provided with mobile cogs, each cog being displaceable between a stop position (FIG. 25) and an escapement position, and with a stop (1018) arranged in the path of movement of the cogs which are in stop position, the length of the escapement thus corresponding to the number of cogs placed in escapement position, and the escapement mechanism comprising a fixed helicoidal cam (1120 FIG. 24) arranged in the path of movement of the cogs which are in escapement position for returning them into stop position;

the printing mechanism comprising type-bar groups each of which corresponds to a character group; the keyboard being constituted by electric switches; the escapement wheel being provided, for each group of type-bars, with an electromagnet (941 to 945 FIG. 44 or 951 to 955 FIG. 46) disposed opposite the cog of the escapement wheel stopped at the place which corresponds to the respective group, so that, when it is energized, the electromagnet displaces the cog, the electromagnet which corresponds to the third group and that which corresponds to each of the next consecutive groups respectively being each connected through respective diodes (FIG. 47) to each of circuits closed by the character keys of the group to which it corresponds, so that the cog corresponding to each of these groups is shifted into its escapement position as soon as one of the corresponding key is struck, but the wheel is unable to turn until the cog corresponding to the first group is no longer halted by the stop, the electromagnet (942 FIGS. 47 and 44, or 952 FIG. 46) corresponding to the second group being connected in circuit by a switch (997 FIGS. 35, 49 and 47) the lever of which (998 FIGS. 35 and 49) is arranged in the path of movement of the upper parts of the type-bars of this second group, the electromagnet corresponding to the first group being connected in circuit by a switch (995 FIGS. 35 and 47) the lever of which (996 FIG. 35) is situated in the path of movement of the upper parts of the type-bars of this first group and also, through a diode (FIG. 47), by the switch (997 FIGS. 35, 49 and 47) the lever of which (998 FIG. 35) is arranged in the path of movement of the upper part of the type-bars belonging to the second group, so that an escapement is produced even if a character of the second group is printed without printing of a character in the first group, but not vice versa.

9. A keyboard-controlled device comprising:

a syllabic-keyboard certain keys of which can be depressed simultaneously and certain keys of which each control simultaneously several characters belonging to groups which each correspond to a distinct printing point, the keyboard further comprising spacing keys, and a printing mechanism which includes a carriage; the improvements comprising:

an escapement mechansim which controls the advance of said carriage, this mechanism comprising a rotatable cogged escapement wheel (FIGS. 24 to 28) provided with mobile cogs, each cog being displaceable between a stop position (FIG. 25) and an escapement position, and with a stop (1018) arranged in the path of movement of the cogs which are in stop position, the length of the escapement thus corresponding to the number of cogs placed in escapement position, and the escapement mechanism comprising a fixed helicoidal cam (1120 FIG. 24) arranged in the path of movement of the cogs which are in escapement position for returning them into stop position;

the syllabic-keyboard (FIGS. 49 or 50) being made up of electric switches and comprising character keys and spacing keys; the cogged escapement wheel (FIGS. 44 to 46) being provided with electromagnets which each correspond to one of the character groups, that (941 FIG. 44 or 951 FIGS. 46 and 51) which corresponds to the first group being arranged opposite the cog stopped in place ( 1 FIG. 32) against the stop (3018), and each of the others electromagnets (942 to 945 FIG. 44, or 952 to 955 FIG. 46) being arranged opposite one of the cogs stopped in the next consecutive places (2 to 5 FIGS. 24 and 27) which corresponds to the other groups (II to V) respectively, each electromagnet being supplied by a circuit which is closed by one of the elements which are set in motion when a character of the corresponding group is printed and thus displacing the cog halted opposite it, so that if one or more character keys are simultaneously depressed, without depressing any of the keys controlling a space, the number of cogs placed in the escapement position and the length of the escapement obtained are represented by the order of the highest group in which a character has been printed; the circuit of the second group (II 942 FIG. 47) being also connected through a diode to the input of the electromagnet associated with the first group (I 941) so that the cog against the stop is moved into its escapement position even if a character of the second group is printed without printing a character of the first group; the wheel being provided with a supplementary electromagnet (VI 1000 FIG. 51) arranged opposite the first cog which does not correspond to a character group, the mechanism comprising an electromagnetic relay (1008 FIG. 51) with as many pairs of change-over contacts (1001 to 1005) as there are character groups, the electromagnets (951 to 955) corresponding to the character groups (I to V) respectively being normally connected through the normally-closed contacts of the relay when the relay (1008) is not energized, but being connected through the normally-open contacts of the relay when the relay is energized, this providing a transposition by virtue of which the circuit corresponding to each group supplies the electromagnet of the next group, so that the circuit which normally supplies the electromagnet (955) corresponding to the final character group (V) supplies the supplementary electromamgnet (VI 1000 FIG. 51); the circuit (ESP.) which is connected to the relay being closed by each space key, and by each character key that must provide a space automatically in combination with characters, and being, in addition, connected through a diode to the input circuit of the electromagnet (951) associated with the first group, so that depressing any of these keys places the cog stopped against the stop in its escapement position and simultaneously carries out the transposition to increase by one unit the number of cogs placed in the escapement position.

* * * * *